US008024948B2

(12) United States Patent
Kitamura et al.

(10) Patent No.: US 8,024,948 B2
(45) Date of Patent: Sep. 27, 2011

(54) DRUM TYPE DRYING AND WASHING MACHINE

(75) Inventors: Susumu Kitamura, Kishiwada (JP); Hitoshi Fujita, Sakai (JP); Hiroichi Shibasaki, Sakai (JP); Masanori Komori, Matsubara (JP); Nobutaka Matsunishi, Fujiidera (JP); Toshinari Miyoshi, Sennan (JP); Masashi Matsumoto, Yao (JP); Takahisa Ikegami, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 592 days.

(21) Appl. No.: 11/996,889

(22) PCT Filed: Jul. 18, 2006

(86) PCT No.: PCT/JP2006/314181
§ 371 (c)(1),
(2), (4) Date: Jul. 25, 2008

(87) PCT Pub. No.: WO2007/013327
PCT Pub. Date: Feb. 1, 2007

(65) Prior Publication Data

US 2008/0276656 A1 Nov. 13, 2008

(30) Foreign Application Priority Data

Jul. 28, 2005 (JP) ..... 2005-218373
Jul. 28, 2005 (JP) ..... 2005-218462
Aug. 2, 2005 (JP) ..... 2005-224420
Aug. 5, 2005 (JP) ..... 2005-227673

(51) Int. Cl.
*D06F 25/00* (2006.01)

(52) U.S. Cl. ..... 68/18 F; 68/20

(58) Field of Classification Search ..... 68/18 C, 68/18 F
See application file for complete search history.

(56) References Cited

U.S. PATENT DOCUMENTS 2,434,476 A * 1/1948 Wales ..... 68/19.2
2,777,313 A * 1/1957 Dodge ..... 68/20
(Continued)

FOREIGN PATENT DOCUMENTS

GB 2 044 297 * 10/1980
(Continued)

OTHER PUBLICATIONS

European Patent Office 0 501 747 Sep. 1992.*
(Continued)

*Primary Examiner* — Frankie L Stinson
(74) *Attorney, Agent, or Firm* — Renner, Otto, Boisselle & Sklar, LLP

(57) ABSTRACT

A drum type washing and drying machine has a water tank (4), a rotary drum rotatably provided in the water tank (5), a dehumidifying heat exchanger for dehumidifying air introduced from inside of the rotary drum (5), a heater unit for heating the air dehumidified by the dehumidifying heat exchanger, and a blower (131) for introducing the air in the rotary drum (5) into the dehumidifying heat exchanger and delivering into the rotary drum (5) the air heated by the heater unit. A filter (160) is placed in a suction-side channel between the rotary drum (5) and the blower and on an upstream side of air flow produced by the blower (131) in a drying process. The filter (160) is placed so as to be soaked in water supplied into the water tank in a washing process or in a rinsing process.

17 Claims, 33 Drawing Sheets

U.S. PATENT DOCUMENTS

| | | | | | |
|---|---|---|---|---|---|
| 2,910,854 | A | * | 11/1959 | Hughes | 68/18 R |
| 3,007,334 | A | * | 11/1961 | Pall | 73/38 |
| 3,018,562 | A | * | 1/1962 | Orr | 34/75 |
| 3,038,324 | A | * | 6/1962 | Hubbard | 68/19.2 |
| 3,083,557 | A | * | 4/1963 | Decatur | 68/20 |
| 3,111,018 | A | * | 11/1963 | Bonner | 68/20 |
| 3,292,347 | A | * | 12/1966 | Hodgkinson | 261/83 |
| 4,204,339 | A | * | 5/1980 | Muller | 34/75 |
| 4,727,733 | A | * | 3/1988 | Huber | 68/12.15 |
| 5,107,606 | A | * | 4/1992 | Tsubaki et al. | 34/596 |
| 5,493,745 | A | * | 2/1996 | Hauch | 8/158 |
| 5,967,760 | A | * | 10/1999 | Howie et al. | 417/80 |
| 6,709,499 | B2 | * | 3/2004 | Moschutz | 96/153 |
| 7,275,399 | B2 | * | 10/2007 | Park et al. | 68/18 C |
| 2003/0089138 | A1 | * | 5/2003 | Kawamura et al. | 68/17 R |
| 2005/0066538 | A1 | * | 3/2005 | Goldberg et al. | 34/218 |
| 2005/0081575 | A1 | * | 4/2005 | Park et al. | 68/18 C |

FOREIGN PATENT DOCUMENTS

| | | | |
|---|---|---|---|
| JP | 50-107774 | | 8/1975 |
| JP | 60-234699 | * | 11/1985 |
| JP | 3-026292 | | 2/1991 |
| JP | 07-236796 | * | 9/1995 |
| JP | 10-071292 | * | 3/1998 |
| JP | 2001-149689 | | 6/2001 |
| JP | 2004-305295 | * | 11/2004 |
| JP | 2005-143790 | | 6/2005 |
| SU | 1011181 | * | 4/1983 |

OTHER PUBLICATIONS

WIPO WO 01/96647 Dec. 2001.*

International Search Report for corresponding Application No. PCT/JP2006/314181 dated Oct. 3, 2006.

* cited by examiner

DRUM TYPE DRYING AND WASHING MACHINE

TECHNICAL FIELD

The present invention relates to a drum type washing and drying machine.

BACKGROUND ART

FIG. 1 shows a schematic cross-section of a conventional drum type washing and drying machine (see JP 2001-149689 A, for example).

The drum type washing and drying machine includes an outer casing 1, a water tank 4 placed in the outer casing 1, a rotary drum 5 placed in the water tank 4 and intended for accommodating a wash, a transparent inflexible outside door 3, an automatic door opening/shutting mechanism 10, and a dryer unit 24 for drying the wash.

On a front face of the outer casing 1 is formed an outer casing opening 1*a*. A wash is put in and taken out through the outer casing opening 1*a*. The outer casing opening 1*a* is opened and shut by the outside door 3 that is slidable upward and downward with respect to the outer casing 1. On upper part of the front face of the outer casing 1 is provided an operation panel 11 having operation keys, display units, and the like. A control unit 2 for controlling operation of the drum type washing and drying machine is provided on reverse side of the operation panel 11 (on a side of the water tank 4), and thus input into the operation panel 11 allows successive or separate performance of a washing process, a rinsing process, a dewatering process, and a drying process. The outer casing 1 elastically supports the water tank 4 through medium of a suspension 8 as an example of an elastic support unit.

The water tank 4 has a shape of a bottomed cylinder with a water tank opening 4*a* that opens in face of the outer casing opening 1*a*, and is positioned transversely and slantly so that rear side thereof (bottom side of the water tank 4) is in lower position. The water tank opening 4*a* and the outer casing opening 1*a* face each other with a space between. A transparent lid body 6 is mounted on the water tank with use of hinge mechanism, so that the water tank opening 4*a* can be opened and shut by the lid body. On the lid body 6 is formed convex part 6*a* that protrudes toward inside of the rotary drum 5 when the opening 4*a* of the water tank 4 is shut. A sealing member 41 is provided on inner circumferential surface part of the water tank opening 4*a* and, while the water tank opening 4*a* is shut by the lid body 6, the water tank opening 4*a* is held watertight by intimate contact between the sealing member 41 and the convex part 6*a*.

The rotary drum 5 has a shape of a bottomed cylinder with a drum opening 5*c* that opens in face of the water tank opening 4*a*, and is positioned transversely and slantly so that rear side thereof (bottom side of the rotary drum 5) is in lower position. A motor 9 is connected to backside of the rotary drum 5 through a shaft 5*e*, and drives the rotary drum 5 to rotate in accordance with control by the control unit 2. A plurality of small bores 5*a* are formed on a whole area of a circumferential wall of the rotary drum 5. The small bores 5*a* allow circulation of washing water (water such as tap water and bath water or water containing detergent or the like), dry air or the like between a space between the water tank 4 and the rotary drum 5 and a space in the rotary drum 5. On an inner wall surface of the rotary drum 5 are provided baffles 5*b* protruding inward in radial directions. The baffles 5*b* are provided circumferentially at three sites at intervals of 120°, for example, and repeatedly lift up and drop the wash with rotation of the rotary drum 5. When the rotary drum 5 is rotating, a fluid balancer 5*d* that surrounds the drum opening 5*c* from outside reduces unbalance caused by one-sided wash and washing water, through agency of motions of fluid sealed in the fluid balancer 5*d*.

The dryer unit 24, which has a blower 31 and a heater unit 32, is provided on top of the water tank 4. In the dryer unit 24, the blower 31 is positioned on rear side and the heater unit 32 is positioned on front side with respect to front and rear of the drum type washing and drying machine. The blower 31 includes blower blades 34 in a casing 33 and a fan motor 35 for driving the blower blades 34 to rotate, which motor is provided outside the casing 33. The fan motor 35 is directly connected to the blower blades 34 so as to drive the blower blades 34 to rotate with use of a direct drive structure. On the other hand, the heater unit 32 includes a heater 36 in a heater case 26, and inlet part of the heater case 26 communicates with outlet part of the casing 33 of the blower 31.

At bottom of the water tank 4 is provided a drain valve 20 that is opened/shut by a drain valve motor not shown. Upon opening of the drain valve 20, water in the water tank 4 is drained through a flexible drain hose 19 to outside.

In the outer casing 1, a blower duct 38 is placed on front side of the water tank 4. One end of the blower duct 38 communicates with outlet part of the heater case 26, and the other end of the blower duct 38 forms a jet 38*a* communicating with inside of the water tank 4 and inside of the drum opening 5*c* in peripheral part of the water tank opening 4*a*. That is, the blower duct 38 and the jet 38*a* act as a blower unit for supplying heated air toward inside of the rotary drum 5 through the water tank opening 5*c*.

In addition, a dehumidifier 27 is provided on back side of the water tank 4 in the outer casing 1. With water poured into the dehumidifier 27 through upper part thereof, the dehumidifier 27 performs dehumidification by cooling and condensing water content in air that passes therethrough. The dehumidifier 27, which is hollow as a whole, has a water inlet 27*a* and an air outlet 27*b* in the upper part and has an air inlet 27*c* doubling as a water outlet in lower part thereof. The air outlet 27*b* of the dehumidifier 27 communicates with inlet part of the casing 33 of the blower 31, and the air inlet 27*c* communicates with lower part of inside of the water tank 4. To the water inlet 27*a* is connected a feed water supply system not shown.

In accordance with the drum type washing and drying machine having the above configuration, a user opens the lid body 6 directly and manually, thereafter puts a wash into the rotary drum 5 through the outer casing opening 1*a*, and then shuts the lid body 6 directly and manually. Thus inner rim 41*a* of the sealing member 41 is brought into intimate contact with rim of the lid body 6 so that the water tank 4 is sealed. When the user manipulates the operation panel 11 so that a washing operation is started on basis of an instruction from the control unit 2, the automatic door opening/shutting mechanism 10 initially slides the outside door 3 in an upward direction in the drawing along a front panel 7. Then the outside door 3 shuts the outer casing opening 1*a*, as shown in FIG. 2, while making a track generally shaped like an arc. Upon termination of the washing operation, subsequently, the automatic door opening/shutting mechanism 10 slides the outside door 3 in a downward direction in the drawing along the front panel 7. Thus the outer casing opening 1*a* is opened again as shown in FIG. 1. After that, the user opens the lid body 6 directly and manually and subsequently takes the wash out of the rotary drum 5.

In a drying operation, the blower 31 is driven to rotate while the heater 36 is energized for heating. Thus air supplied by the blower 31 is heated by the heater 36 while passing through the heater case 26, and the air having got a high temperature is forwarded through the blower duct 38, the jet 38*a*, and the water tank opening 5*c* toward the wash in the rotary drum 5, so as to dry the wash. The hot humid air having absorbed moisture of the wash in the rotary drum 5 is exhaled, from the small bores 5*a* formed on a circumferential surface of the rotary drum 5, into the space between the rotary drum 5 and the water tank 4. The space between the rotary drum 5 and the water tank 4 communicates with a space around the dehumidifier 27, as described above, and the air flowing around the dehumidifier 27 comes into contact with a wall of the dehumidifier 27 cooled by cold water flowing through the dehumidifier 27, then forms dew, and thereby undergoes dehumidification. The dehumidified air is forwarded afresh by the blower 31 via the heater 36 into the rotary drum 5. In this manner, the process of drying the wash in the rotary drum 5 is carried out. Such a drum type washing and drying machine is disclosed in JP 2001-149689 A, for example.

In the drying process in the drum type washing and drying machine, however, the action of lifting up a wash by the baffles 5*b* and thereafter dropping the wash is repeated with the rotary drum 5 rotated at a low speed and, in progress of the drying process, minute dust such as lint, fluff, or fuzz appears from the dried wash. Such minute dust may enter into the casing 33 with the air circulation caused by the dryer unit 24.

In the washing process or the rinsing process, normally, such foreign matter as lint in washing water is removed by a filter unit or the like (not shown) provided before the drain valve 20; in the drying process, however, such foreign matter circulating with air passing through the dryer unit 24 is not removed and may adhere to a shaft linking the blower blades 34 to the fan motor 35 and may form a resistance against the rotation of the blower blades 34 and the shaft, which resistance may degrade blowing capacity of the blower 31 with long-term use thereof.

SUMMARY OF THE INVENTION

It is an object of the invention to provide a drum type washing and drying machine that prevents foreign matter in circulating air from entering a blower in a drying process and that has high reliability with regard to long-term use.

There is provided, according to an aspect of the present invention, a drum type washing and drying machine comprising:

a water tank;

a rotary drum rotatably provided in the water tank;

a dehumidification unit for dehumidifying air introduced from inside of the rotary drum;

a heater unit for heating the air dehumidified by the dehumidification unit;

a blower unit for introducing the air in the rotary drum into the dehumidification unit and for delivering into the rotary drum the air heated by the heater unit; and a filter unit placed in a suction-side channel between the rotary drum and the blower unit and on an upstream side of air flow produced by the blower unit in a drying process, the filter unit being placed so as to be soaked in water supplied into the water tank in a washing process or in a rinsing process.

In the drum type washing and drying machine having the above configuration, foreign matter such as lint produced in the rotary drum is collected by the filter unit provided on upstream side of the blower unit, and degradation in blowing function of the blower unit that may be caused by twining of the lint or the like is prevented.

In one embodiment, the filter unit is placed on a bottom surface of the water tank.

In the embodiment, an inner circumferential surface of the water tank may be shaped like a gentle arc and extends along directions of rotation of the rotary drum, and foreign matter such as lint having sunk to bottom of the water tank is therefore shaken in the directions of rotation by the water flow produced by the rotation of the rotary drum in the washing process or the rinsing process; however, the filter unit provided on the bottom surface of the water tank is resistant to readhesion of the foreign matter thereto.

The foreign matter conveyed by the blower fan initially adheres onto a part that faces a suction-side channel and decreases a suction force in the part.

Therefore, the filter unit extending only in the part that faces the suction-side channel clogs soon and degrades blowing capacity of the blower unit.

In view of this, in one embodiment, the filter unit has an area larger than a cross-sectional area of the suction-side channel.

In this embodiment, in spite of clogging in an area facing the suction-side channel, the larger area of the filter unit than the cross-sectional area of the suction-side channel allows a shift of suction area to another area, so that the function of the filter unit can be performed for a long term.

In one embodiment, the filter unit has a structure in which wires are woven reticularly.

Due to the provision of the reticularly woven wire structure, a filter having a resistance to adhesion of foreign matter, a large aperture area ratio, and a high efficiency of eliminating foreign matter is achievable.

In one embodiment, a length of one side of a mesh of the filter unit is not smaller than 1 mm and not larger than 3 mm.

Due to the length of 1-3 mm of the mesh of the filter, comparatively large foreign matter such as lint in washing water is collected which is prone to be entangled around a shaft linking the blower fan and a fan motor and which greatly influences the degradation in blowing capacity of the blower unit, and early clogging of the filter, which may be caused by comparatively small foreign matter such as lint, is thus prevented.

In one embodiment, crossings of the wires of the filter unit woven reticularly are fixed.

In the embodiment, because crossings of the wires of the filter unit woven reticularly are fixed, it is possible to prevent occurrence of problems such as trapping of foreign matter between the crossed wires and variation in the opening size of the meshes that may be caused by shift or replacement of the crossings or the like.

In one embodiment, the blower unit is placed so as to be soaked in the water supplied into the water tank in the washing process or in the rinsing process.

In the embodiment, because the blower unit is soaked in the water supplied into the water tank in the washing process or in the rinsing process, minute lint adhering onto the blower unit, which cannot be filtered by the filter unit in the drying process, is washed away and eliminated by water in the washing process or the rinsing process.

In one embodiment, the blower unit has a blower fan, a fan motor for driving the blower fan to rotate, and a shaft having one end connected to the blower fan and another end connected to the fan motor, the blower fan positioned so as to be soaked in water supplied into the water tank in the washing process or the rinsing process.

In the embodiment, because the blower unit is soaked in the water supplied into the water tank in the washing process or in the rinsing process, minute foreign matter that cannot be collected by the filter unit and that adheres onto the blower fan can be eliminated by the water.

In one embodiment, the drum type washing and drying machine further comprises a cleaning unit for producing a flow of the water and thereby removing foreign matter that has adhered to the filter unit.

In the embodiment, due to the flow of the water, the filter unit is cleaned in every washing process or every rinsing process, and is constantly kept in a state having satisfactory water and air permeability, so that degradation in capability of the filter for removing foreign matter is prevented.

Further, due to the flow of the water, clogging in the filter unit can efficiently be eliminated.

In one embodiment, the cleaning unit is provided on an outer surface of the rotary drum and produces the flow of the water according to rotation of the rotary drum.

In the embodiment, the cleaning unit provided on the outer surface of the rotary drum produces water flow by being rotated with the rotation of the rotary drum in the washing process or the rinsing process and therefore requires no additional driving force for producing the water flow.

In one embodiment, the filter unit is placed on a bottom surface of the water tank and wherein the cleaning unit is provided on a back face of the rotary drum.

In the embodiment, an inner circumferential surface of the water tank may be shaped like a gentle arc and extends along directions of rotation of the rotary drum, and foreign matter such as lint having sunk to bottom of the water tank is therefore shaken in the directions of rotation by the water flow produced by the rotation of the rotary drum in the washing process or the rinsing process; however, the filter unit provided on the bottom surface of the water tank is resistant to readhesion of the foreign matter thereto.

In one embodiment, the filter unit is provided along an arc of a circle centering on the rotation axis of the rotary drum.

In the embodiment, the cleaning unit rotates about the rotation axis of the rotary drum and thus causes the water flow along an arc, and the foreign matter eliminating efficiency can be increased by extension of the filter unit along the arc.

In one embodiment, the cleaning unit has a blade member protruding from the back face of the rotary drum toward the bottom surface of the water tank so that a side of the member facing in a rotational direction of the rotary drum in a dewatering process forms an obtuse angle.

In the embodiment, due to the thus arranged blade member of the cleaning unit, wind noise emitted by the blade member can be reduced in the dewatering process in which the rotary drum is rotated at a high speed.

In one embodiment, the blade member protrudes, inclining relative to a direction vertical to the rotation axis of the rotary drum.

In the embodiment, because the blade member protrudes, inclining relative to the direction vertical to the rotation axis of the rotary drum, it is possible to reduce the roar caused by the blade member in the dewatering process in which the rotary drum is rotated at a high speed.

In one embodiment, the drum type washing and drying machine further comprises a rotary drum rotation control unit that makes a shift from an ordinary rotation speed to a higher rotation speed in the rotary drum in the washing process or in the rinsing process.

In the embodiment, the drum rotation control unit changes the rotation speed of the rotary drum from an ordinary rotation speed to a higher rotation speed in the rotary drum in the washing process or in the rinsing process. As a result, water flow having a high efficiency of eliminating clogging in the filter unit is produced and performance of eliminating clogging in the filter unit is improved.

In one embodiment, the rotary drum rotation control unit comprises an operating speed control unit that controls the rotary drum to rotate, in the washing process or in the rinsing process, at a first rotation speed mainly for washing laundry and at a second rotation speed mainly for removing foreign matter having adhered to the filter unit, the second rotation speed being higher than the first rotation speed.

In the embodiment, the operating speed control unit controls the rotary drum to rotate, in the washing process or in the rinsing process, at the first rotation speed mainly for washing laundry and at the higher second rotation speed mainly for removing foreign matter having adhered to the filter unit. Due to this control, foreign matter that has adhered onto the filter unit can be eliminated more reliably in the washing process and/or the rinsing process.

In one embodiment, the rotary drum rotation control unit controls the rotary drum to rotate at the second rotation speed immediately before termination of the washing process or the rinsing process.

In the embodiment, because the rotary drum rotation control unit controls the rotary drum to rotate at the second rotation speed immediately before termination of the washing process or the rinsing process, foreign matter that has adhered onto the filter unit can be eliminated more reliably just before the termination of the washing process or the rinsing process, and thus a state in which foreign matter has adhered onto the filter unit hardly occurs when the washing process or the rinsing process is terminated.

In one embodiment, the drum type washing and drying machine further comprises a drain unit for draining the water out of the water tank, wherein the rotary drum rotation control unit controls the rotary drum to rotate at the second rotation speed when the washing water supplied into the water tank in the washing process or in the rinsing process is drained out of the water tank by the drain unit.

In the embodiment, an effect of the water flow for eliminating clogging in the filter unit is increased in vicinity of a water surface of the washing water and, therefore, the water flow for eliminating the clogging can be made to act on whole area of the filter unit as the water surface is lowered during the draining of the washing water.

In one embodiment, when controlling the rotary drum to rotate at the first rotation speed, the rotary drum rotation control unit controls the rotary drum to rotate in reciprocal directions alternately and to stop for a first interval before switching the directions of rotation of the rotary drum, and when controlling the rotary drum to rotate at the second rotation speed, the rotary drum rotation control unit controls the rotary drum to rotate in reciprocal directions alternately and to stop for a second interval shorter than the first interval before switching the directions of rotation.

In this embodiment, the water flow for eliminating clogging in the filter unit on occasion of the draining of the washing water can be made to act on the filter unit with little intermission.

The blower fan may be positioned so as to be soaked in the water and the blower fan being soaked in the water may be rotated when the water exists in the water tank. This operation allows elimination of foreign matter having adhered onto the blower fan and into a drying channel that is a passage of air flowing through the dehumidification unit, the heater unit, and the blower unit.

In the washing and drying machine that introduces the washing water from the water tank to a circulation channel and that feeds the water afresh through a circulating pump into the water tank, a circulation inlet that is an inlet from the water tank to the circulation channel may be positioned on downstream side of the water flow produced by the blower fan. This arrangement causes a change in water flow in the drying channel between operation time and non-operation time of the circulating pump and thus allows efficient elimination of foreign matter having adhered to the drying channel.

In one embodiment, the rotary drum rotation control unit includes a high-speed operation control section to control the rotary drum to rotate at a third rotation speed higher than the second rotation speed.

In one embodiment, the rotary drum rotation control unit includes a control status switching unit that carries out switching between a first control status under control of the operating speed control unit and a second control status under control of the high-speed operation control unit on basis of an input through an input unit.

In one embodiment, the rotary drum rotation control unit has:

an operating speed control unit that rotates the rotary drum in the washing process or the rinsing process at a first rotation speed mainly for washing a contained wash and at a second rotation speed mainly for removing foreign matter having adhered to the filter unit, the second rotation speed being higher than the first rotation speed; and a high-speed operation control unit that rotates the rotary drum at a third rotation speed higher than the second rotation speed, and the machine further includes a blower fan control unit that drives the blower fan to rotate in the status in which the rotation of the rotary drum is controlled by the high-speed operation control unit.

In one embodiment, the drum type washing and drying machine has:

the circulation inlet that is an inlet introducing the washing water in the water tank to the circulation channel and that is positioned on downstream side of the water flow produced by the blower fan;

the circulating pump that afresh feeds into the water tank the washing water introduced into the circulation channel; and a circulating pump control unit that controls and operates the circulating pump in the status in which the rotation of the rotary drum is controlled by the high-speed operation control unit.

In one embodiment, the drum type washing and drying machine has an operation exclusively for washing the filter unit and the rotary drum rotation control unit controls the rotary drum to rotate at a third rotation speed higher than the second rotation speed in the operation exclusively for washing the filter unit.

There is provided, according to another aspect of the invention, a drum type washing and drying machine comprising a water tank, a rotary drum rotatably provided in the water tank, a dehumidification unit for dehumidifying air introduced from inside of the rotary drum, a heater unit for heating the air dehumidified by the dehumidification unit, a blower unit for introducing the air in the rotary drum into the dehumidification unit and for delivering into the rotary drum the air heated by the heater unit, a filter unit placed in a suction-side channel between the rotary drum and the blower unit and on an upstream side of air flow produced by the blower unit in a drying process, an air temperature detector unit for detecting a temperature of the air passing through the heater unit, and a clogging detection unit for detecting occurrence of clogging in the filter unit based on the detection by the air temperature detector unit.

In one embodiment, the air temperature detector unit includes an outflow air temperature detector unit for detecting a temperature of air heated by the heater unit, and the clogging detection unit detects occurrence of clogging in the filter unit as the outflow air temperature detector unit detects a temperature increase rate not smaller than a predetermined value.

In one embodiment, the air temperature detector unit includes an inflow air temperature detector unit for detecting a temperature of air flowing into the heater unit and an outflow air temperature detector unit for detecting a temperature of air heated by the heater unit, and the clogging detection unit detects occurrence of clogging in the filter unit as an absolute value of a difference between the temperature detected by the inflow air temperature detector unit and the temperature detected by the outflow air temperature detector unit equals or exceeds a predetermined value.

In one embodiment, the air temperature detector unit includes an inflow air temperature detector unit for detecting a temperature of air flowing into the heater unit and an outflow air temperature detector unit for detecting a temperature of air heated by the heater unit, and the clogging detection unit detects occurrence of clogging in the filter unit as the outflow air temperature detector unit detects a temperature increase rate not smaller than a predetermined value and as an absolute value of a difference between the temperature detected by the inflow air temperature detector unit and the temperature detected by the outflow air temperature detector unit equals or exceeds a predetermined value.

In one embodiment, the air temperature detector unit detects temperatures only during performance of the drying process.

In one embodiment, the washing and drying machine has a frequency information acquiring unit for acquiring, as frequency information, a frequency of performance of the drying process, and the clogging detection unit detects occurrence of clogging in the filter unit on basis of the frequency information acquired by the frequency information acquiring unit.

There is provided, according to a further aspect of the present invention, a drum type washing and drying machine comprising a water tank, a rotary drum rotatably provided in the water tank, a dehumidification unit for dehumidifying air introduced from inside of the rotary drum, a heater unit for heating the air dehumidified by the dehumidification unit, a blower unit for introducing the air in the rotary drum into the dehumidification unit and for delivering into the rotary drum the air heated by the heater unit, a filter unit placed in a suction-side channel between the rotary drum and the blower unit and on an upstream side of air flow produced by the blower unit in a drying process, a frequency information acquiring unit for acquiring, as frequency information, a frequency at which the drying process is performed, and a clogging detection unit for detecting occurrence of clogging in the filter unit based on the frequency information acquired by the frequency information acquiring unit.

In one embodiment, the frequency information is the number of times of successive performances of only the drying process, or successive performance time during which only the drying process is successively performed, or performance number ratio between numbers of times of performance of the washing and rinsing processes and of the drying process, or performance time ratio between performance time of the washing and rinsing processes and of the drying process, or cumulative number of times of performance of the drying process from a specified point of time, or cumulative performance time of the drying process from a specified point of time.

A washing and drying machine according to one embodiment has an indication unit that indicates occurrence of clogging in the filter unit as the clogging detection unit detects the occurrence of the clogging in the filter unit.

In one embodiment, the washing and drying machine has a drying process interruption processing unit that interrupts the drying process as the clogging detection unit detects occurrence of clogging in the filter unit.

ADVANTAGEOUS EFFECT OF THE INVENTION

According to the present invention, due to the provision of a filter unit at the air suction side of the blower unit, foreign matter such as lint produced in the rotary drum is collected by the filter unit, which is provided on upstream side of the blower unit. As a result, the present invention provides a drum type washing and drying machine that is successful in preventing degradation of the blowing function of the blower unit caused by the lint twined therearound.

The present invention will become more fully understood from the detailed description given hereinbelow and the accompanying drawings which are given by way of illustration only, and thus are not intended to limit the present invention.

DETAILED DESCRIPTION OF THE INVENTION

Figure 1:
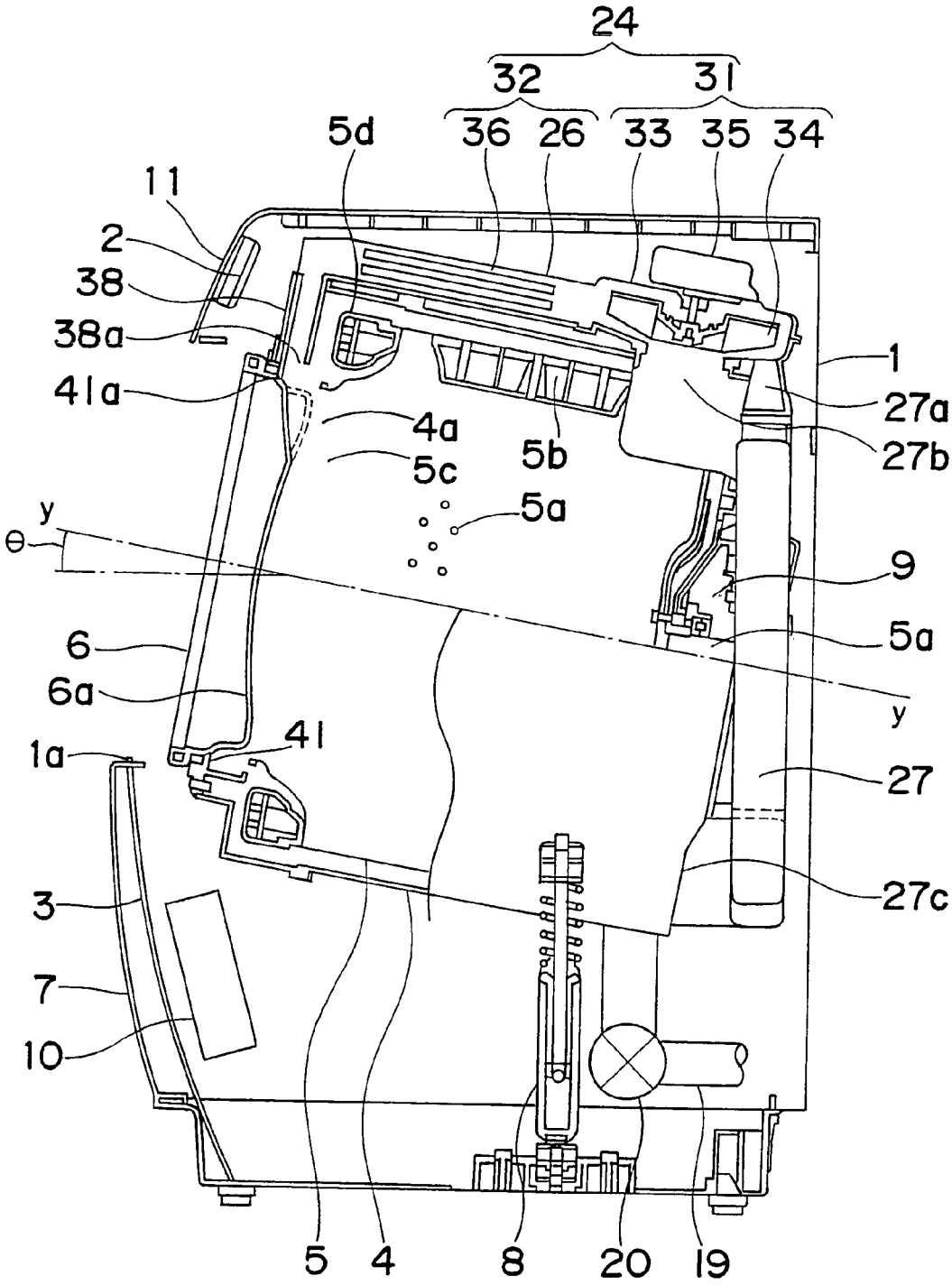
FIG. 1 is a schematic longitudinal section of a conventional drum type washing and drying machine as viewed from a side direction thereof.
Figure 2:
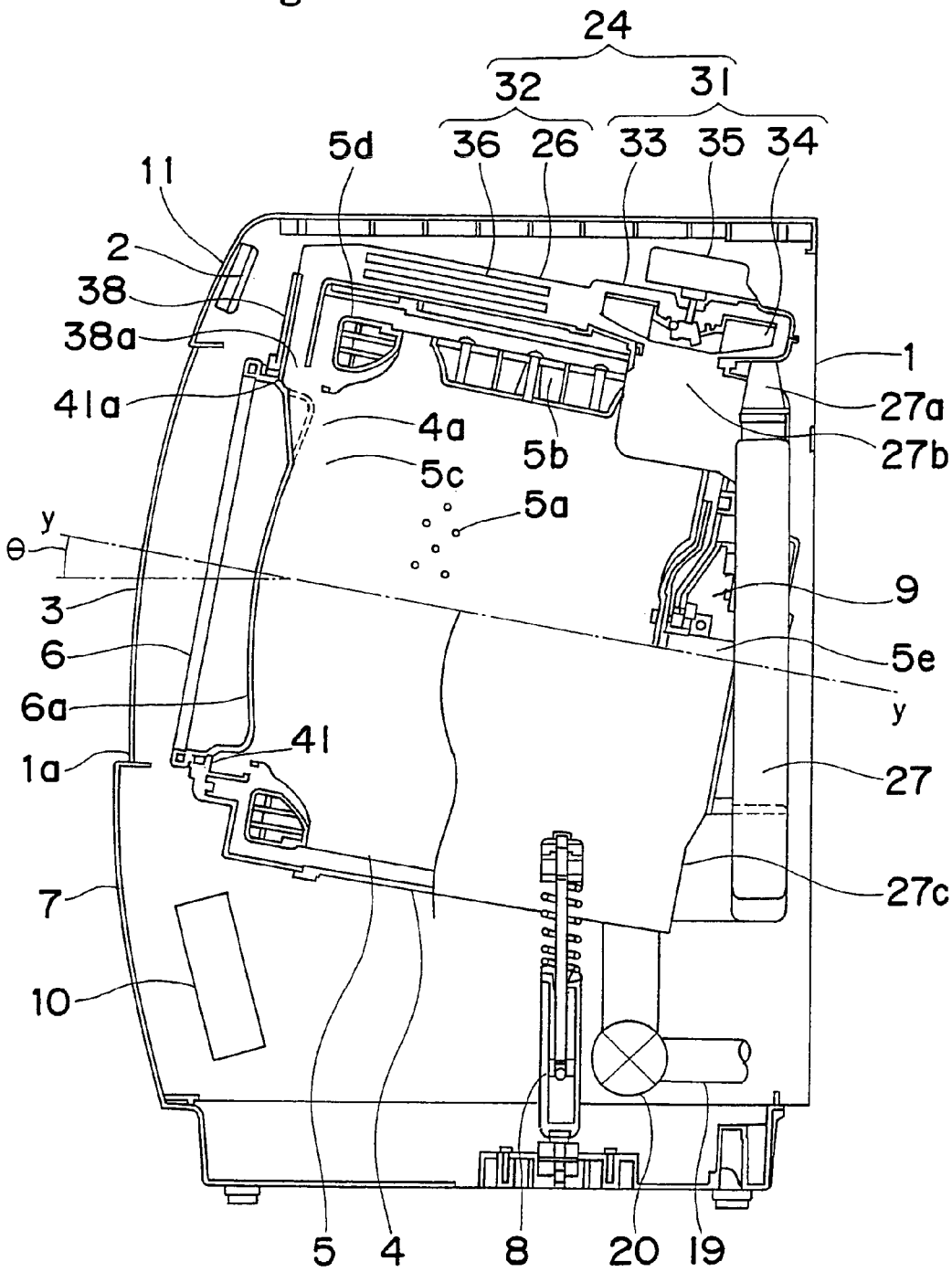
FIG. 2 is a schematic longitudinal section of the conventional drum type washing and drying machine of FIG. 1 as viewed from another side direction thereof.

Hereinbelow, a drum type washing and drying machine of the present invention will be described in detail with reference to embodiments shown in the drawings.

First Embodiment

Figure 3:
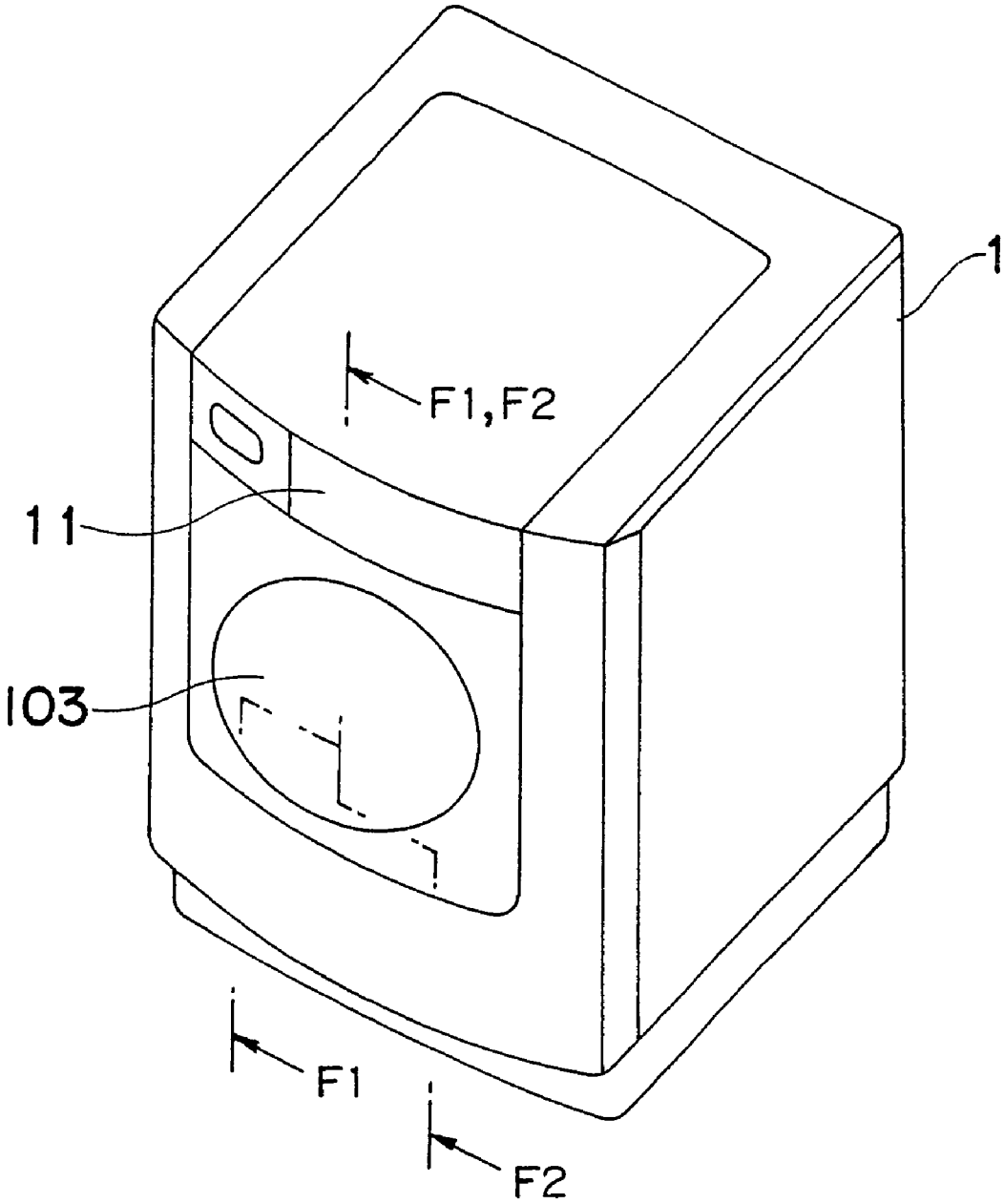
FIG. 3 is a sketch perspective of a drum type washing and drying machine according to a first embodiment of the invention.

FIG. 3 is a sketch perspective of a drum type washing and drying machine according to a first embodiment of the invention. The drum type washing and drying machine has an outer casing 1 which covers periphery thereof and which has an outer casing opening 111 (see FIG. 4), which will be described later, on a front face thereof, and a door 103 for opening/shutting the outer casing opening 111 is pivotably mounted on the outer casing 1 by a hinge mechanism. Reference numeral 11 in FIG. 3 denotes an operation panel.

Figure 4:
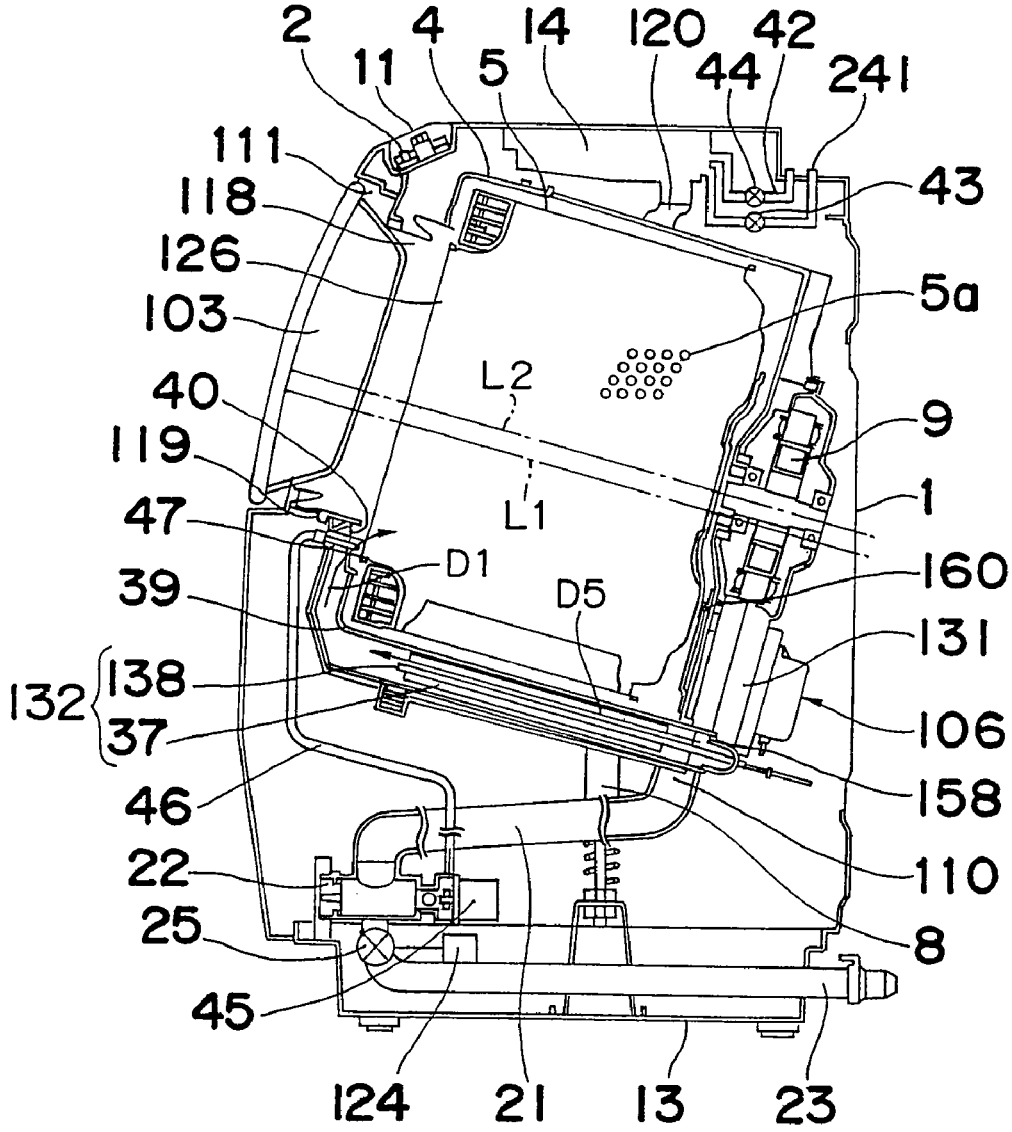
FIG. 4 is a section taken along line F1-F1 in FIG. 3.

FIG. 4 shows a schematic section taken along line F1-F1 in FIG. 3.

Formed on the front face of the outer casing 1 is the outer casing opening 111. The outer casing opening 111 is opened and shut by the door 103 that is pivotable with respect to the outer casing 1, as described above. An upper part of the front face of the outer casing 1 is provided with the operation panel 11 having operation keys, display units, and the like. A control unit 2 for controlling operation of the drum type washing and drying machine is provided on the reverse side of the operation panel 11 (on a side of a water tank 4), and thus input into the operation panel 11 allows successive or separate performance of a washing process, a rinsing process, a dewatering process, and a drying process. The outer casing 1 elastically supports the water tank 4, which will be described later, through the medium of a suspension 8 as an example of an elastic support unit.

The outer casing 1 houses the water tank 4 having a shape of a bottomed cylinder with a water tank opening 118 that opens in face of the outer casing opening 111. The water tank 4 is positioned slantly so that the rear side of a central axis L1 passing through the centers of gravity in sections perpendicular to a cylinder axis of the water tank 4 is lowered.

The water tank 4 contains a rotary drum 5 having a shape of a bottomed cylinder with a drum opening 126 that opens in face of the water tank opening 118. The rotary drum 5 is connected to a motor 9 residing on backside of the rotary drum 5 and is supported so as to be rotatable in the water tank 4. The rotary drum 5 is positioned slantly so that the rear side of a central axis (rotation axis) L2 thereof is lowered. A plurality of small bores 5*a* are formed in the whole area of a circumferential wall of the rotary drum 5. The small bores 5*a* allow circulation of washing water, air, or the like between a space between the water tank 4 and the rotary drum 5 and a space in the rotary drum 5. The central axis L2 of the rotary drum 5 is positioned above the central axis L1 of the water tank 4.

In a lower part of a space in the water tank 4, there is placed a blower duct 39 through which warm air to be supplied into the rotary drum 5 flows. A front end of the blower duct 39 communicates with a blower port 40 positioned between a lower edge of the water tank opening 118 and a lower edge of the opening 126 of the rotary drum 5. Therefore, the air flowing through the blower duct 39 in a direction of an arrow D1 is forced to blow via the blower port 40 into the rotary drum 5. A rear end of the blower duct 39 is connected to a discharge opening 158 of a fan case 134 (see FIG. 6) that will be described later.

Inside the blower duct 39 is provided a heater unit 132, which is composed of a heater case 37 and a sheathed heater 138 of which major portion is housed in the heater case 37. The heater case 37 is composed of a main body made of metal and a frame for fixing the main body. The frame is made of heat resistant resin, and a front end of the frame is connected to the blower duct 39. The sheathed heater 138 is capable of heating air in the water tank 4, and is also capable of heating washing water in the water tank 4 because the heater is placed in an area to be soaked in the washing water in the water tank 4.

The front face of the water tank 4 is provided with the water tank opening 118 that faces the outer casing opening 111. A packing 119 composed of an elastic material such as rubber and soft resin is fixed at the water tank opening 118. When the door 103 is shut, in this arrangement, the door 103 is brought into intimate contact with the packing 119, so that liquid in the water tank 4 is prevented from leaking out of the water tank 4. To top of the water tank 4 is connected a lower end of a feed water duct 120 for feeding washing water into the water tank 4. On the other hand, an upper end of the feed water duct 120 is connected to a lower part of a detergent case 14. To the detergent case 14 are connected a tap water feeding channel 241 and a bath water feeding channel 42. A feed valve 43 is provided in the middle of the tap water feeding channel 241, and a bath water pump 44 is provided in the middle of the bath water feeding channel 42.

The water tank 4 is provided, at a lower part, with a drain hole 110 for draining washing water in the water tank 4. The drain hole 110 communicates with the blower duct 39. The drain hole 110 is positioned on downstream side of the blower 131. To the drain hole 110 is connected an upper end of a drain duct 21. A lower end of the drain duct 21 is connected through a filter unit 22 to a drain hose 23. Liquid flowing through the drain duct 21 passes through the filter unit 22 before flowing into the drain hose 23 or into a circulation hose 46. The filter unit 22 eliminates foreign matter such as lint from washing water having flowed through the drain duct 21, and thus prevents the foreign matter from entering the drain hose 23 or the circulation hose 46.

The drain hose 23 is provided with a drain valve 25 that is opened/shut by a drain motor 124. The drain valve 25 is controlled so as to be opened when washing water in the drain duct 21 is made to flow into the drain hose 23 and so as to be shut when washing water in the drain duct 21 is made to flow into the circulation hose 46. An upper end of the circulation hose 46 is connected to a circulation nozzle 47 that is positioned at a lower part of the front face of the water tank 4 and that is directed to inside of the rotary drum 5. On the other hand, a lower end of the circulation hose 46 is connected to a circulating pump 45 that is positioned behind the filter unit 22. The circulating pump 45 is operable to suck washing water in the drain duct 21, through the filter unit 22, and discharge the sucked washing water into the circulation hose 46. By activation of the circulating pump 45, washing water drained out of the water tank 4 through the drain hole 110 can be made to pass through the filter unit 22 and can thereafter be returned into the rotary drum 5. In the washing process, washing water is kept clean by the removal of foreign matter while such circulation of the washing water is carried out.

A dryer system 106 is provided at an inlet to the drain hole 110 which communicates with the blower duct 39 to drain washing water from the water tank 4. The dryer system 106 has a blower 131 corresponding to the conventional blower 35, a heater unit 132 corresponding to the conventional heater 36, the blower duct 39, and a dehumidifying heat exchanger 133 (see FIG. 5 and FIG. 6) that will be described later. A filter 160 having metallic yarn woven reticularly is provided in a dehumidification channel 164 between the dehumidifying heat exchanger 133 and the blower 131. The blower 131, the heater unit 132, the dehumidifying heat exchanger 133, the filter 160, and the blower duct 39 are positioned below a plane including the center line L1 of the water tank 4 and including a horizontal axis orthogonal to the center line L1. Thus such members as the units of the dryer system 106 and the filter 160 are cleaned by being soaked in washing water in the washing process or the rinsing process. The heater unit 132, the dehumidifying heat exchanger 133, the blower 131, and the filter 160 are one example of the heater unit, the dehumidification unit, the blower unit, and the filter unit, respectively. Reference numeral 13 in FIG. 4 denotes a bottom platform.

Figure 5:
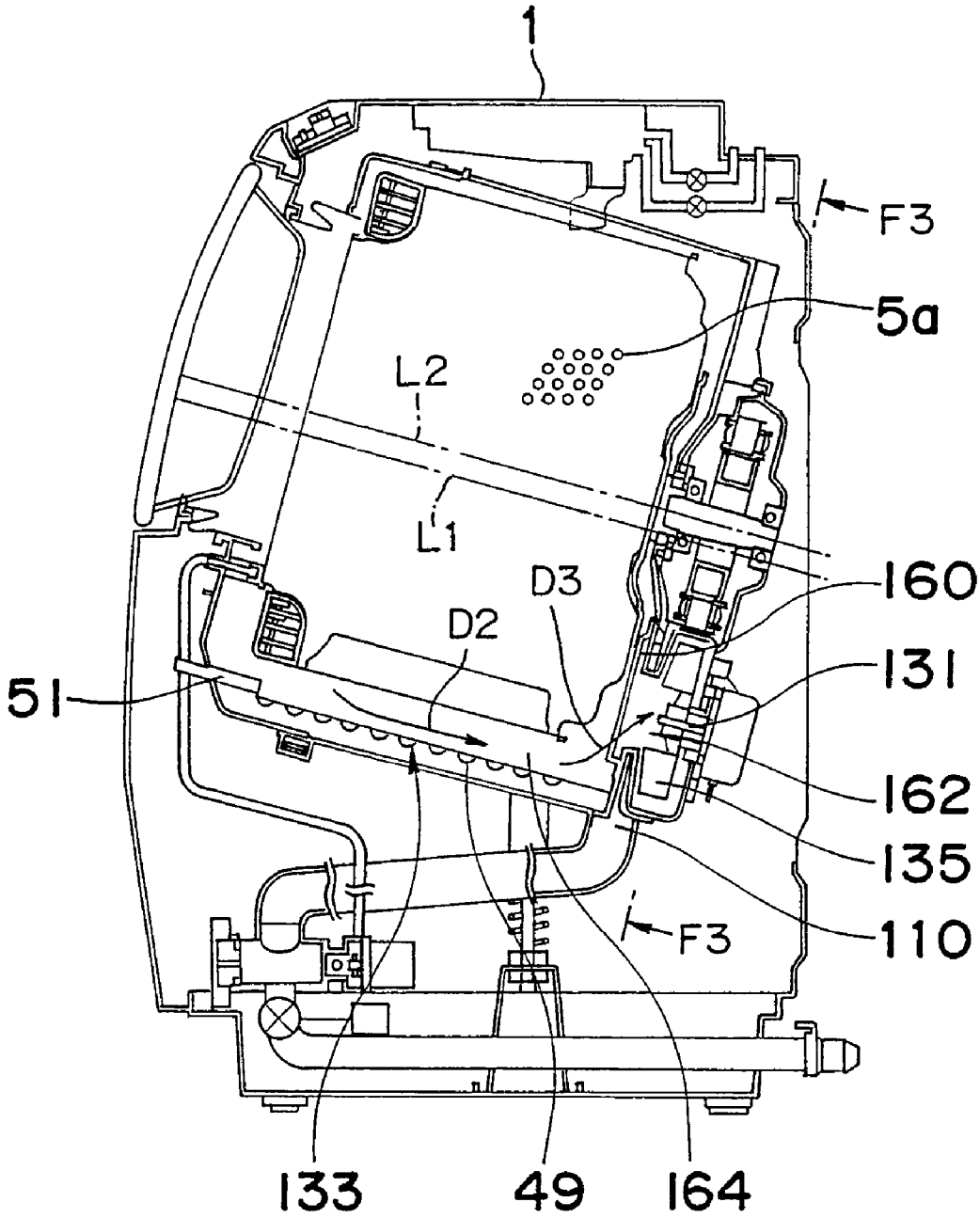
FIG. 5 is a section taken along line F2-F2 in FIG. 3.

FIG. 5 shows a schematic section taken along line F2-F2 in FIG. 3.

The dehumidifying heat exchanger 133 is connected upstream of the blower 131 mounted at a lower part of a rear face of the water tank 4. More particularly, the dehumidifying heat exchanger 133 is provided in a region that is between an inner circumferential surface of the water tank 4 and an outer circumferential surface of the rotary drum 5 and that is soaked in water in the washing process. The dehumidifying heat exchanger 133 has a metal plate 49 that is positioned slantly so that the front side thereof is heightened, and fixation members 50 (see FIG. 7) that are made of stainless steel and that are installed on ends of the metal plate 49. A cooling nozzle 51 is provided above a front end of the metal plate 49. In the drying process, cooling water supplied from the cooling nozzle 51 flows over an upper surface of the metal plate 49 so as to cool the metal plate 49. In this manner, air is cooled by the cooling water and the cooled metal plate 49, and moisture that the air flowing there contains is thereby condensed effectively.

The blower 131 is mounted in a lower position of the rear face of the water tank 4. The blower 131 communicates with the water tank 4 via the inlet 162 and sucks in air in the water tank 4 with rotation of a blower fan 135. The inlet 162 is an example of a suction-side channel.

Figure 6:
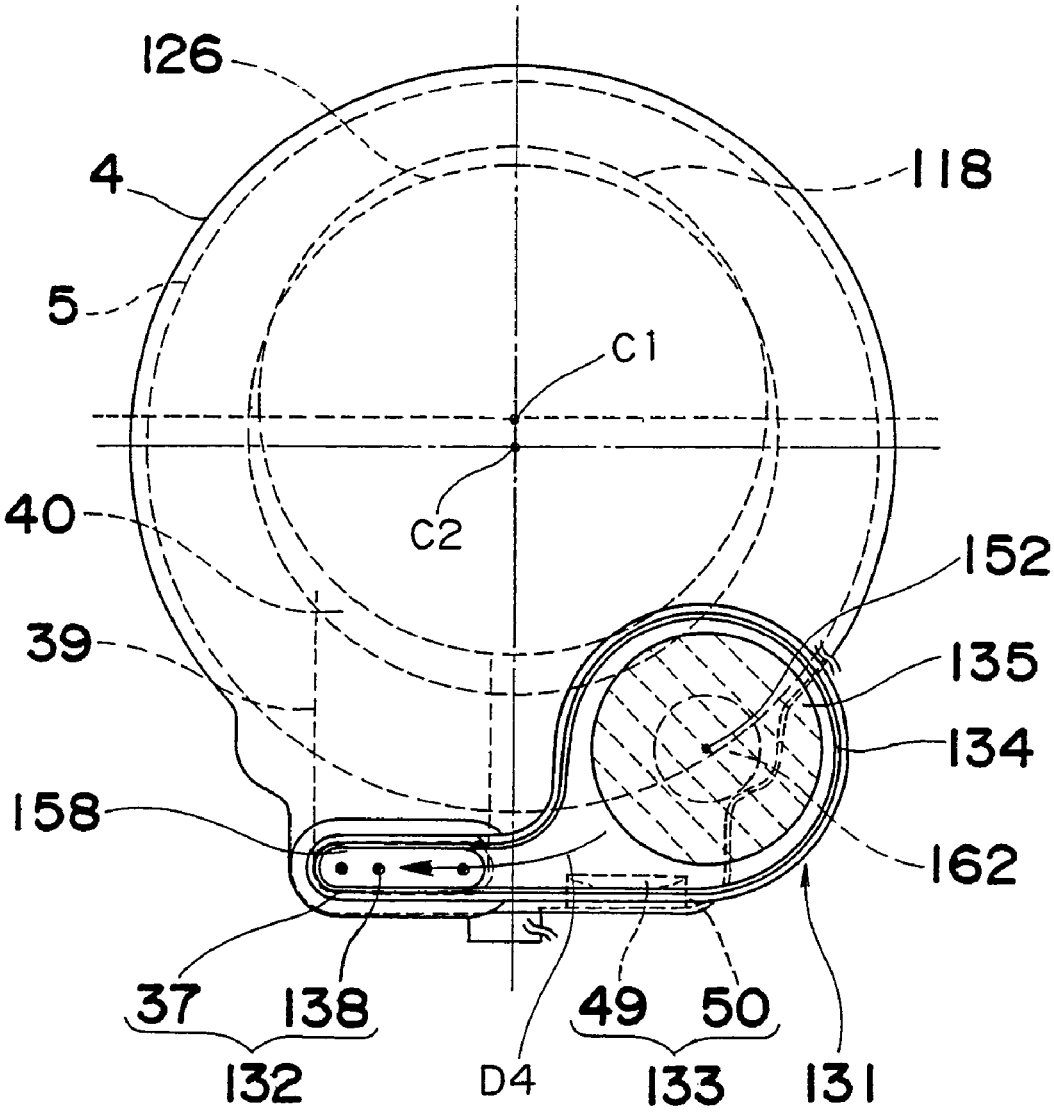
FIG. 6 is a section taken along line F3-F3 in FIG. 3.

FIG. 6 shows a schematic section taken along line F3-F3 in FIG. 5.

The water tank 4 has a shape protruding downward and the blower 131 is configured so as to fit the protruding shape. Periphery of the blower 131 is defined by a fan case 134, in which a blower fan is contained. The fan case 134 extends horizontally across the protruding shape in the lower part of the water tank 4 and communicates with the heater unit 132 and the dehumidifying heat exchanger 133 provided in the lower part of the protruding shape, through the inlet 162 and the discharge opening 158, respectively.

A center C1 of the water tank opening 118 is nearer to a top face of the outer casing 1 than a center C2 of the drum opening 126 is. That is, the water tank opening 118 is shifted toward the top face of the outer casing 1 relative to the drum opening 126. Reference numeral 152 in FIG. 6 denotes a shaft, one end of which is connected to the blower fan 135.

Figure 7:
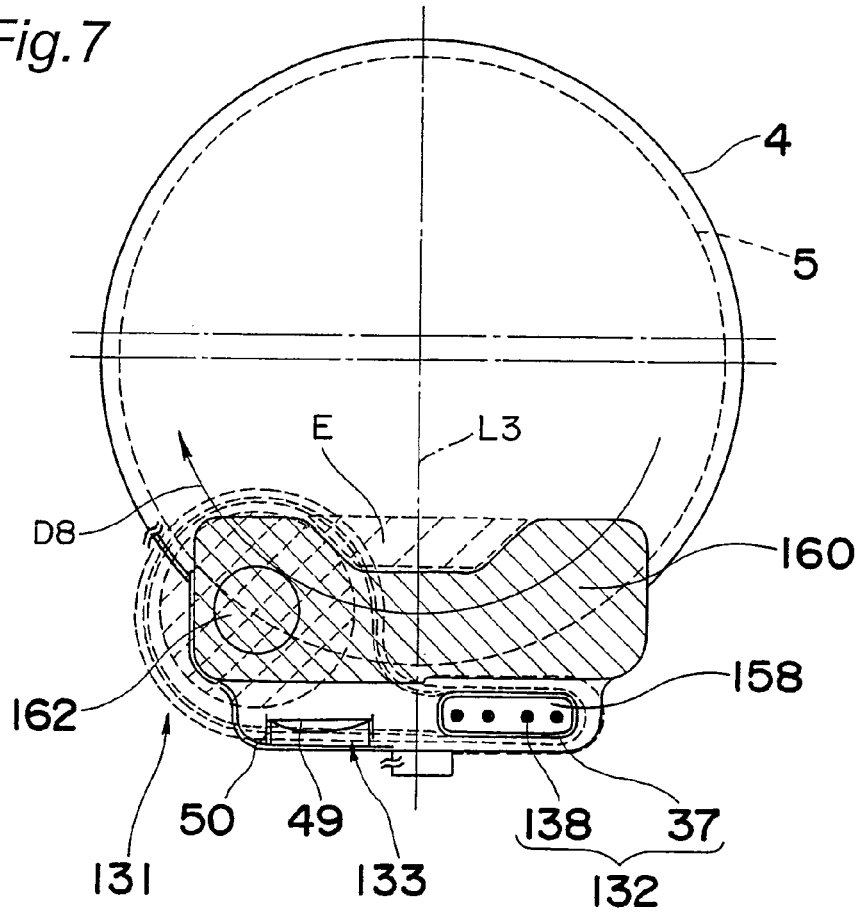
FIG. 7 is a schematic diagram of an inner bottom surface of a water tank of the drum type washing and drying machine according to the first embodiment of the invention.

FIG. 7 shows a schematic diagram of a bottom part of the water tank as seen from the front side.

Inside the lower part of the protruding shape of the water tank 4, the heater unit 132 is positioned on the right side, and the dehumidifying heat exchanger 133 is positioned on the left side. The heater unit 132 and the dehumidifying heat exchanger 133 are positioned so as to be parallel to the central axis L1 of the water tank 4 and, as will be described later, and the dehumidifying heat exchanger 133 and the heater unit 132 are located on upstream side and downstream side, respectively, with respect to circulating air, with the blower 131 therebetween.

Figure 10:
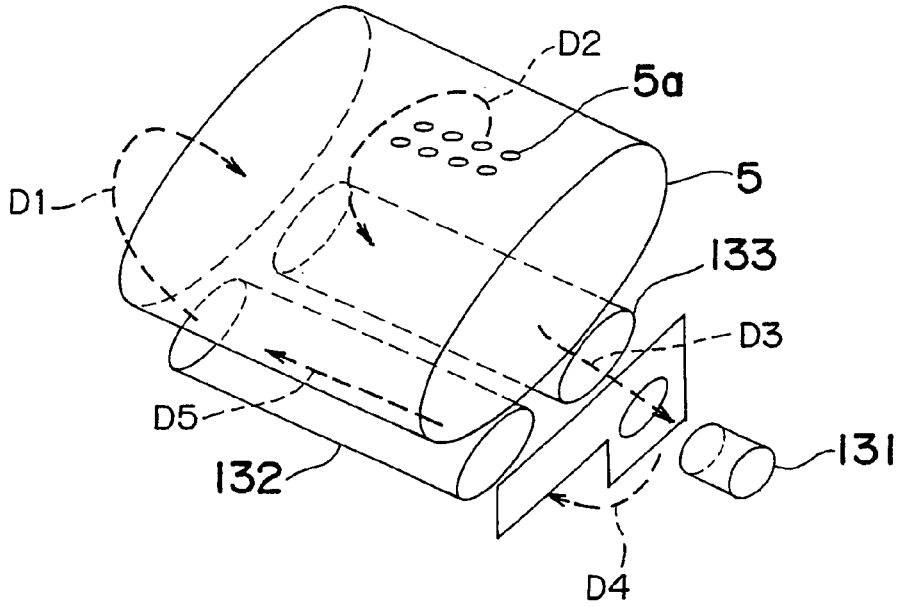
FIG. 10 is a schematic diagram showing a circulation circuit of air in the drying process.

In the drying process, as shown in FIGS. 4 through 6, air forwarded by the blower 131 is heated while passing through the heater unit 132 as shown by an arrow D5 (see FIG. 4) and is thereafter forced to blow from the water tank opening 118 into the rotary drum 5 as shown by an arrow D1 (see FIG. 4). The air, which has moisture vaporized from wet wash in the rotary drum 5 to become highly humid, flows out, through the small bores 5*a* in a circumferential surface of the rotary drum 5, into the space between the inner peripheral surface of the water tank 4 and the outer peripheral surface of the rotary drum 5 and further flows along the dehumidifying heat exchanger 133 as shown by an arrow D2 (see FIG. 5). The air having got highly humid is cooled and dehumidified by the dehumidifying heat exchanger 133 and the cooling water. The dehumidified air undergoes repetition of a cycle in which the dehumidified air enters through the inlet 162 into the blower 131 and is fed through the discharge opening 158 into the heater unit 132 as shown by an arrow D4 (see FIG. 6). The process of drying the wash advances in this way. FIG. 10 schematically shows the flow of air in the drying process described above.

In the drying process, a wash is thus dried with the air in the water tank 4 sequentially passed and circulated through the dehumidifying heat exchanger 133, the blower 131, and the heater unit 132. In this process, minute dust such as cotton waste from the wash enters the fan case 134 and adheres to inside an inner wall of the fan case 134, one end of the shaft 152 or the blower fan 135; in the next washing process or the next rinsing process, however, the inside of the fan case 134, the one end of the shaft 152 or the blower fan 135 are soaked in washing water having flowed into the fan case 134, and the dust such as cotton waste is therefore washed away and removed by the washing water. This prevents constriction of the air channel in the fan case 134 and an increase in resistance against the rotation of the blower fan 135, and allows constant, efficient circulation of air for drying a wash.

Figure 8:
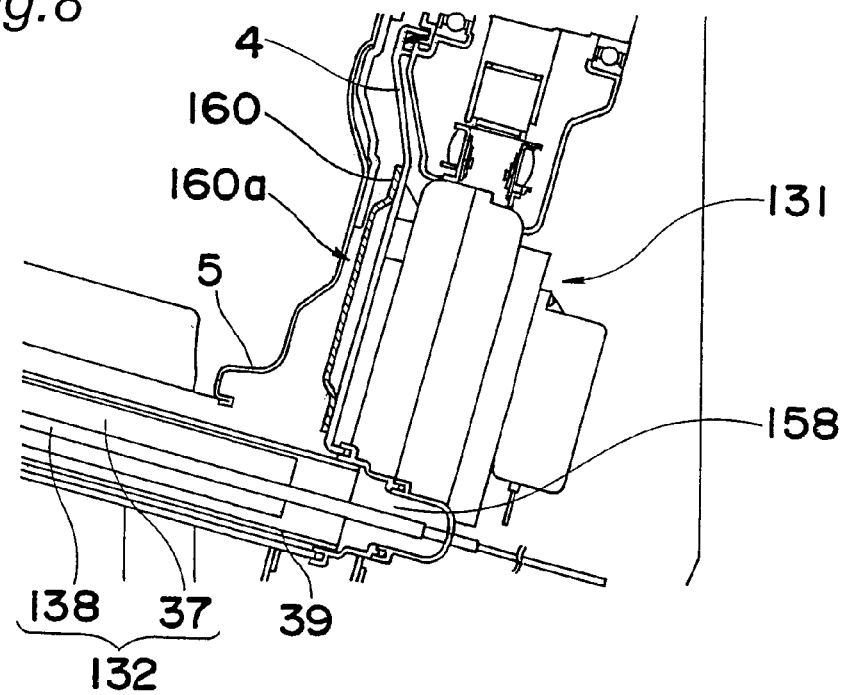
FIG. 8 is a detail of surroundings of a filter in FIG. 4.

FIG. 8 shows details of surroundings of the filter 160 in FIG. 4.

The blower 131 is mounted to the lower part of the rear face of the water tank 4. The blower 131 is connected to the water tank 4 through the discharge opening 158 that is an outlet of blast from the blower 131, and the discharge opening 158 is connected to the blower duct 39.

Figure 9:
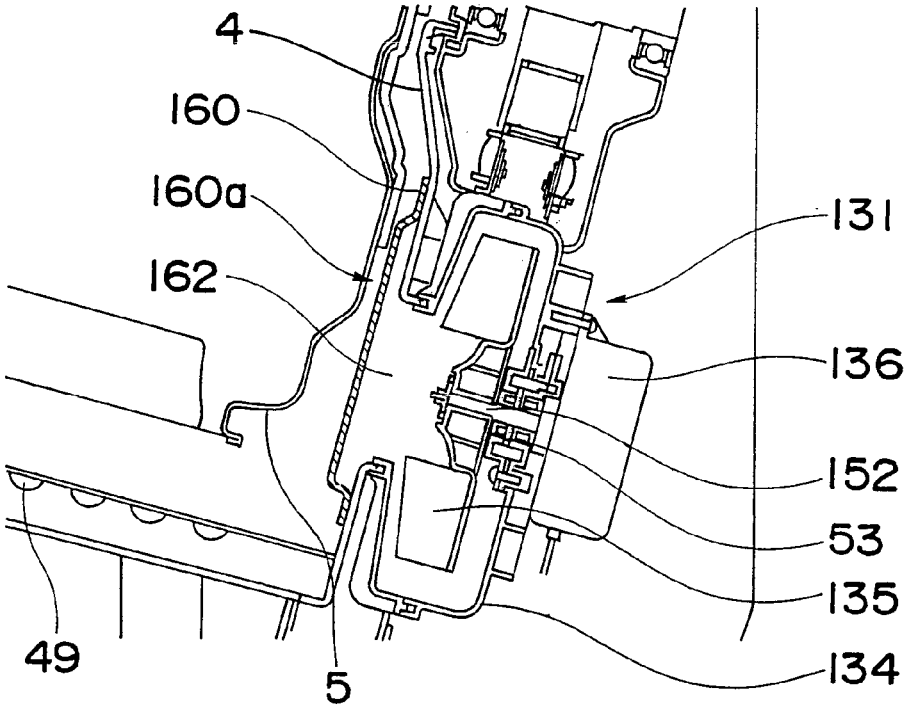
FIG. 9 is a detail of surroundings of a filter in FIG. 5.

FIG. 9 shows detail of surroundings of the filter 160 in FIG. 5.

The blower 131 has the fan case 134, the blower fan 135 that is positioned so as to be rotatable in the fan case 134, a fan motor 136 that drives the blower fan 135 to rotate, the shaft 152 that has one end connected to the blower fan 135 and the other end connected to the fan motor 136, and a seal receiving part 53 that is provided so as to radially surround the shaft 152. The shaft 152 receives a rotational driving force from the fan motor 136 and thus rotates with the blower fan 135. As described above, the one end of the shaft 152 is positioned so as to be soaked in washing water that flows into the fan case 134 in the washing process or the rinsing process. The blower fan 135, which makes air blow against the wash in the drying process, can be controlled so as to rotate also in the washing process and/or the rinsing process to produce water flow.

The blower 131 is also connected to the water tank 4 through the inlet 162 that is an entrance for blast of the blower 131. The filter 160 having metallic yarn woven reticularly is provided in a space between the inlet 162 and the metal plate 49, and is fixed so as to cover the inlet 162 in order that air in the water tank 4 may not pass through the inlet 162 without passage through the filter 160.

The filter 160 is provided inside and on a bottom face of the water tank 4, as shown in FIG. 7, is generally shaped like an arc in left-right symmetry about a center line L3 of the drum type washing and drying machine, in plan view as viewed from inside of the water tank 4, and faces the inlet 162 (see FIG. 5) from the water tank on left side of FIG. 7. As shown in FIG. 6, the blower fan 135 is provided so as to face the inlet 162. FIG. 7 shows the dehumidifying heat exchanger 133 provided on the channel to the inlet 162.

As a result, air (washing water) having flowed in a direction perpendicular to the paper sheet of FIG. 7 through the dehumidification channel 164 (see FIG. 5) to the inlet 162 flows through the filter 160 into the blower 131. In the washing process and the rinsing process, washing water flows in the water tank 4 and the blower 131 and foreign matter as lint contained in the washing water is thus collected by passage of the washing water through the filter 160, so that the foreign matter is prevented from intruding into the blower 131. The inner circumferential surface of the water tank is shaped like a gentle arc and extends along directions of the rotation of the rotary drum, and foreign matter such as lint having sunk to the bottom of the water tank is therefore shaken in the directions of the rotation by the water flow produced by the rotation of the rotary drum; however, the filter 160 provided on the bottom face of the water tank 4 is resistant to readhesion of foreign matter to the filter 160. In the drying process, air flows through the water tank 4 and the blower 131, and foreign matter contained in the air is thus collected with passage of the air through the filter 160, so that the foreign matter is prevented from intruding into the blower 131.

In order to merely collect foreign matter such as lint in washing water or air that is circulated by the blower 131 as described above, the filter 160 has only to cover an area on which the suction force of the blower fan 135 acts, that is, a part that faces the inlet 162 and that is shown on the lower left side of the water tank 4 in FIG. 7. The lint conveyed by the washing water or air in the actual washing process, rinsing process or drying process, however, is accumulated on the filter 160 in a long span and, sooner or later, a large volume of lint accumulated on the filter 160 facing the inlet 162 will cause a decrease in suction efficiency.

In the first embodiment, therefore, the filter 160 is not only provided on the part on which the suction force of the blower fan 135 directly acts and which faces the inlet 162 on the lower left side of the water tank 4 in FIG. 7 but is extended to a right side part which does not face the blower 131. That is, the filter 160 is positioned over an area larger than an opening area of the inlet 162, as viewed in the direction of the central axis L1 of the water tank 4. In such a configuration, the lint initially adheres only onto the area facing the inlet 162 of the blower 131 and, with prolongation of operating time, a suction force in the part to which the lint has adhered decreases. Accordingly, lint does not further adhere to the part where the suction force is nullified, but shifts to a part where lint has not adhered yet, so that the area onto which lint adheres gradually expands and so that the adhesion of the lint is concentrated on the left side in FIG. 7, in the course of time.

In the first embodiment in which the filter 160 is extended to the right side part in FIG. 7 as described above, the right side part where lint has not adhered can be used as a filter, and a filtering effect can be maintained for an extremely long term even if the suction force in the left side part in FIG. 7 is decreased with the prolonged operating time.

The filter 160 used in the drum type washing and drying machine according to the first embodiment is not shaped like a simple flat plate but includes a swelling part 160*a* that swells in a direction of the rotary drum 5, i.e., in the direction of the metal plate 49 constituting the dehumidifying heat exchanger 133, as clearly shown in FIG. 8 and FIG. 9. Such slight swelling in the direction of the water tank 4 forms a blast channel between the bottom surface of the water tank 4 and the filter 160 and thereby ensures a long-term availability of the filter 160.

Though the filter 160 may be of a plastic molding or a metal plate from which small bores have been punched out, instead of metallic yarn woven reticularly, such a molded or punched article, in practice, may have burrs and return scrap around the filter bores, on which lint, fuzz or the like may be hooked, resulting in a cause of clogging of the small bores. Therefore, the filter 160 is desirably composed of a net structure having wires woven reticularly. Such a net structure is not only free from above-mentioned worry of burrs and return scrap but allows an increase in ratio of a total area of small-bores to the area of the plate surface (i.e., aperture ratio), resulting in excellent capability as a foreign matter collecting unit.

As the wires constituting the filter 160, resin wires and the like are conceivable other than metal wires; however, metal wires are preferable because metal wires have smooth surfaces and resist catching lint, pieces of thread and the like. To fix crossings of meshes of the wires, e.g., by resin coating of metallic yarn woven reticularly, prevents occurrence of problems such as variation in the opening size of the meshes that may be caused by foreign matter caught between the crossed wires, shift of the crossings or the like.

In this arrangement, the opening size of the meshes of the filter 160 may be between 1 mm and 3 mm. With this configuration, comparatively large foreign matter, such as lint and pieces of thread in washing water, is collected which is prone to be twisted around the shaft linking the blower fan to the fan motor and which greatly influences the blowing capacity of the blower unit. Early clogging of the filter 160, which may be caused by comparatively small foreign matter such as fluff, is therefore prevented.

In the drum type washing and drying machine according to the first embodiment, as described above, the blower fan 135, the sheathed heater 138 for heating, and a metal plate 49 are soaked in the washing water during the washing process or the rinsing process, so that lint or the like adhering to those locations can be cleaned by washing water, rinse water or the like; however, the blower unit, the heater unit, or the dehumidifier unit may be provided at upper locations free from the washing water, as necessary.

By the provision of such a filter 160, inconveniences are avoided including twining of foreign matter such as lint or fuzz around the blower fan 135 or the shaft 152 thereof. Additionally, as described above, a region where the filter 160 is positioned extends not only over part which faces the inlet 162 and on which the suction force of the blower fan 135 directly acts but also to part distant from the blower fan 135, so that the suction force of the blower fan 135 can be kept strong for a long period.

In this embodiment, nevertheless, the filter 160 clogs as a whole in course of time, and it is therefore impossible to permanently maintain the suction force of the blower fan 135. In that case, some time and effort may be needed for an operator of the drum type washing and drying machine to eliminate lint or the like that has adhered onto the filter 160.

Though the clogging of the filter 160 is automatically eliminated in the first embodiment, blades 170 for producing water flow with the rotation of the rotary drum 5 and thereby cleaning surfaces of the filter 160 are provided on a back face of the rotary drum 5 facing the water tank 4, in order to eliminate the clogging of the filter 160 more reliably in one washing process or in one rinsing process. Herein, the blades 170 are an example of a cleaning unit.

Figure 11:
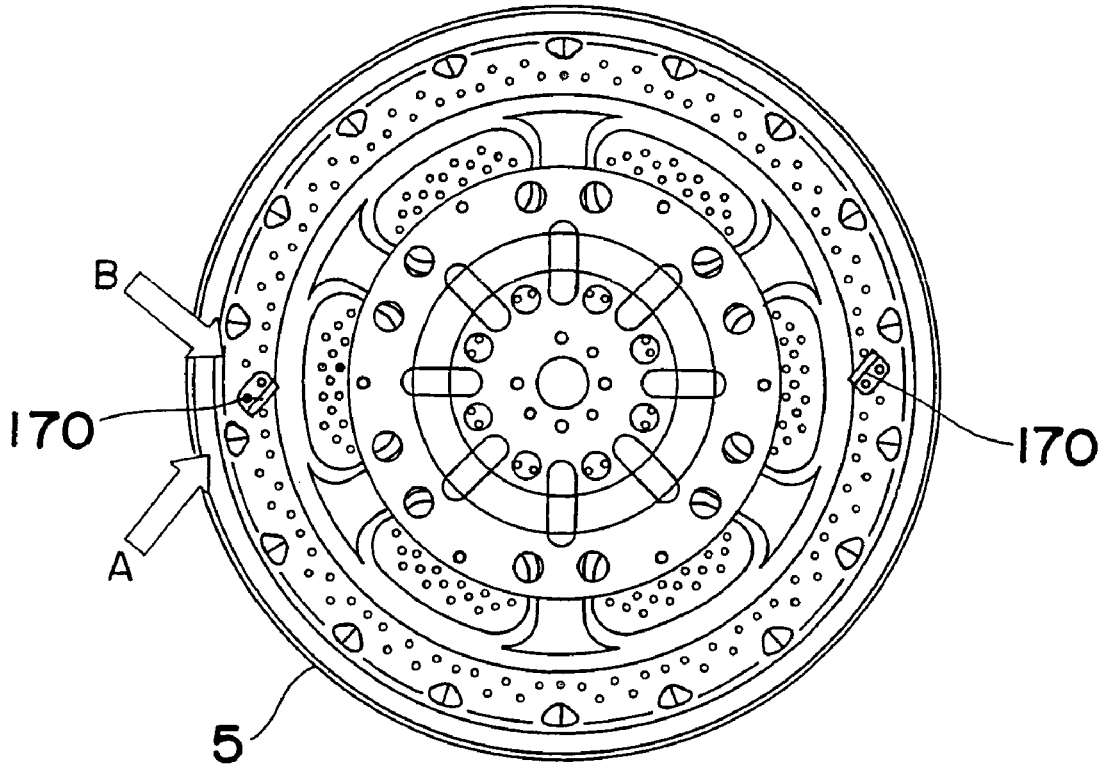
FIG. 11 is a schematic diagram of a back face of a rotary drum facing the water tank.
Figure 12A:
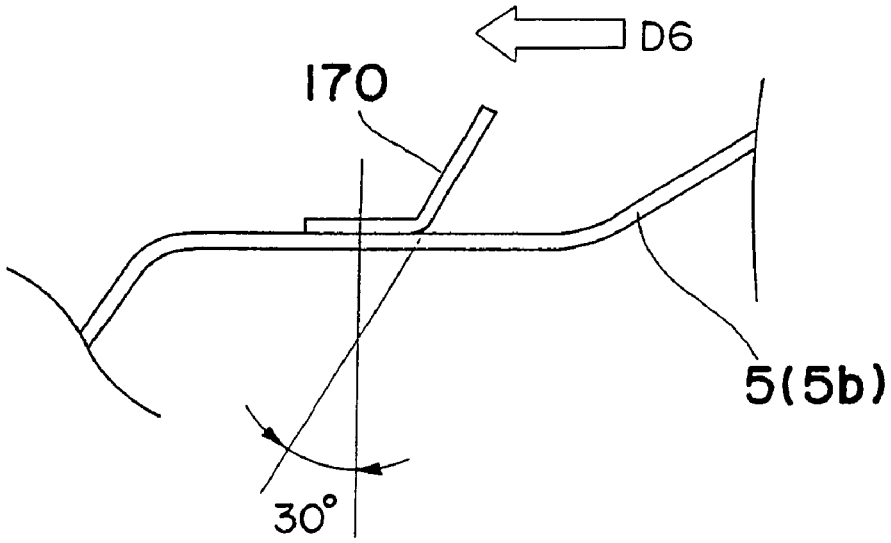
FIG. 12A is a schematic representation of a blade as viewed in a direction of an arrow A in FIG. 11.
Figure 12B:
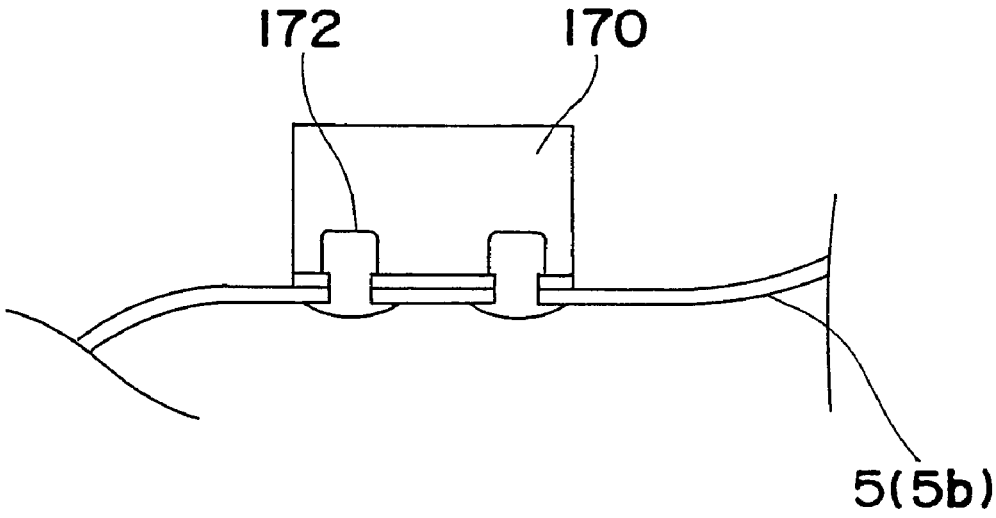
FIG. 12B is a schematic representation of the blade as viewed in a direction of an arrow B in FIG. 11.

FIG. 11 shows a schematic representation of the back face of the rotary drum 5 facing the water tank 4, FIG. 12A shows a schematic representation of the blade as viewed in a direction of an arrow A in FIG. 11, and FIG. 12B shows a schematic representation of the blade as viewed in a direction of an arrow B in FIG. 11.

On the back face of the rotary drum 5 facing the water tank 4, the blades 170 are mounted in positions in 180 degrees rotational symmetry. As shown in FIG. 11, the blades 170 are tilted by 45 degrees with respect to a direction of a diameter of the rotary drum 5 and are fixed onto the bottom surface of the rotary drum 5 by rivets 172 (see FIG. 12B). As shown in FIG. 12A, additionally, the blades 170 are tilted by 30 degrees with respect to an axis of rotation of the rotary drum 5. The tilt angles of 45 degrees and of 30 degrees are provided in order to prevent the blades 170 from emitting wind noise owing to the rotation, as fast as 1000 rpm, of the rotary drum 5 in the direction of the arrow D6 in the dewatering process. Though the blades 170 are tilted with respect to the direction of the diameter of the rotary drum 5 and with respect to the axis of rotation of the rotary drum 5 in the first embodiment, the wind noise in the dewatering process can be reduced by adjustment of either one of the tilt angle with respect to the direction of the diameter of the rotary drum 5 and the tilt angle with respect to the direction of the axis of rotation of the rotary drum 5.

The blades 170 rotate about the rotation axis of the rotary drum 5, with the rotation of the rotary drum 5, so as to produce the water flow of washing water in the washing process and the rinsing process, and tracks of the rotation pass through a plane of projection of the filter 160 as shown by an arrow D8 in FIG. 7. The water flow of washing water produced by the rotation of the blades 170 acts on foreign matter having adhered onto the surfaces of the filter 160 and releases the foreign matter from the filter 160. The release action is particularly greater in positions that are nearer to the track of the passage of the blades 170, and thus the filter 160 of the first embodiment may have a concave shape in an area E near to the center of the rotary drum 5 as shown in FIG. 7. The blades 170 can be configured so that a plurality of distances exist between the blades 170 and the rotation axis of the rotary drum 5, therefore, the filter 160 can be wider and the cleaning effect can be imparted even to such a recessed area E.

The blades 170 are composed of a plurality of metal pieces fixed onto the bottom surface of the rotary drum 5 and are preferably provided in rotationally symmetrical positions, so as not to disturb a rotation balance of the rotary drum 5. Alternatively, the blades 170 can be provided at least at one site for correcting unbalance based on caulking of a circumferential wall of the rotary drum 5. The blades 170 are not necessarily made of metal but may be made of resin, for example.

In the first embodiment, the filter 160 is employed that is shaped like an arc positioned equally in general on left and right sides of the vertical center line L3 of the washing machine, in order that a cycle of cleaning for the filter 160 may be kept long by an increase in the area of the filter 160 on basis of the fact that foreign matter is accumulated locally in the part of the filter 160 facing the inlet 162 that is provided on lower left side of the water tank 4, as described above. Provided that the clogging of the filter 160 does not occur so frequently, accordingly, it is not necessary to ensure such a large filter area as in the first embodiment and the filter 160 can be provided only in the lower left side of the water tank 4 in FIG. 7, for example.

Second Embodiment

Figure 13:
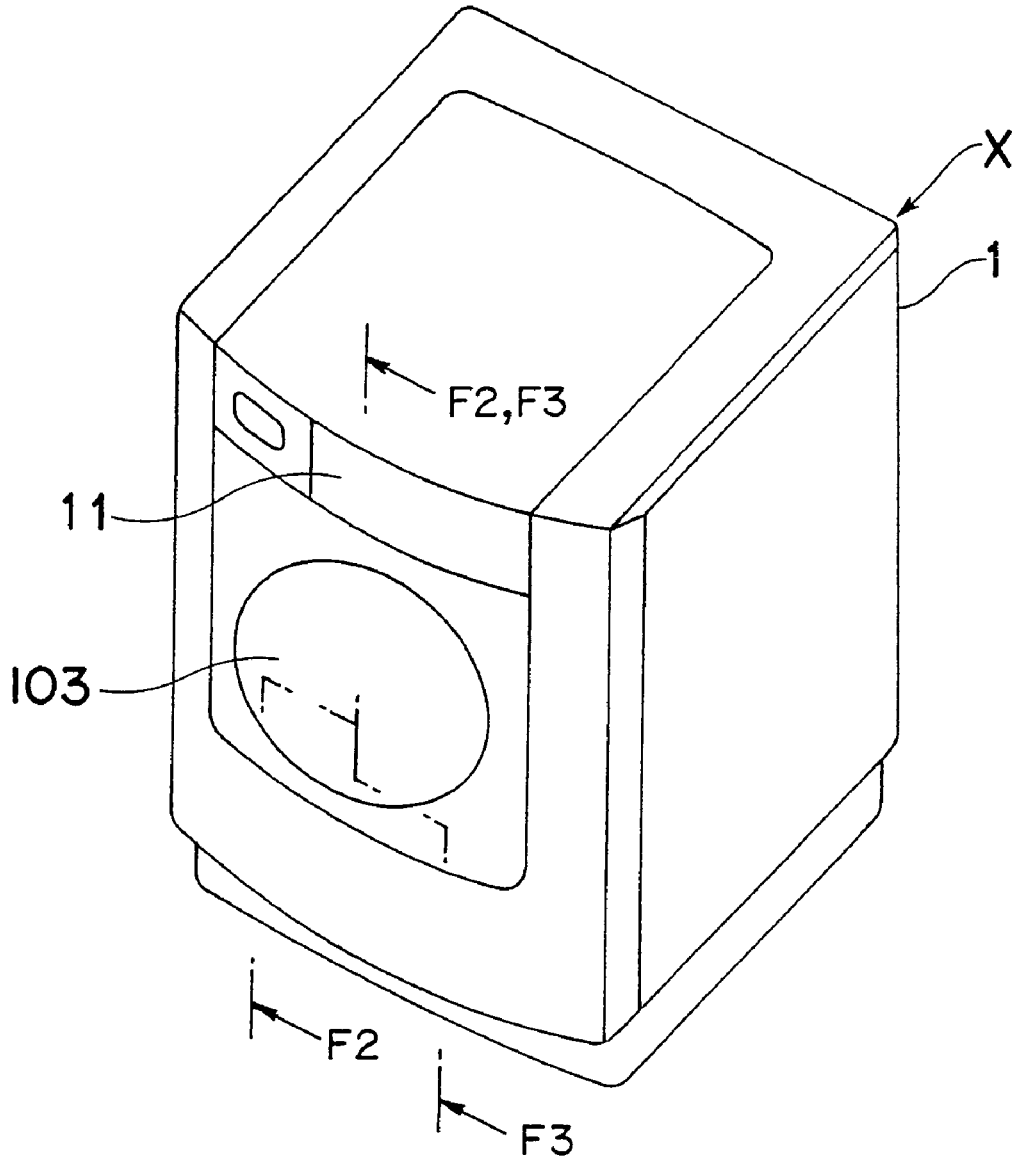
FIG. 13 is a sketch perspective of a drum type washing and drying machine according to a second embodiment of the invention.

FIG. 13 is a sketch perspective of a drum type washing and drying machine X according to a second embodiment of the invention. The drum type washing and drying machine X has an outer casing 1 which covers periphery thereof and which has an outer casing opening 111 (see FIG. 14), which will be described later, on a front face thereof, and a door 103 for opening/shutting the outer casing opening 111 is pivotably mounted on the outer casing 1 by a hinge mechanism. Reference numeral 11 in FIG. 13 denotes an operation panel.

Figure 14:
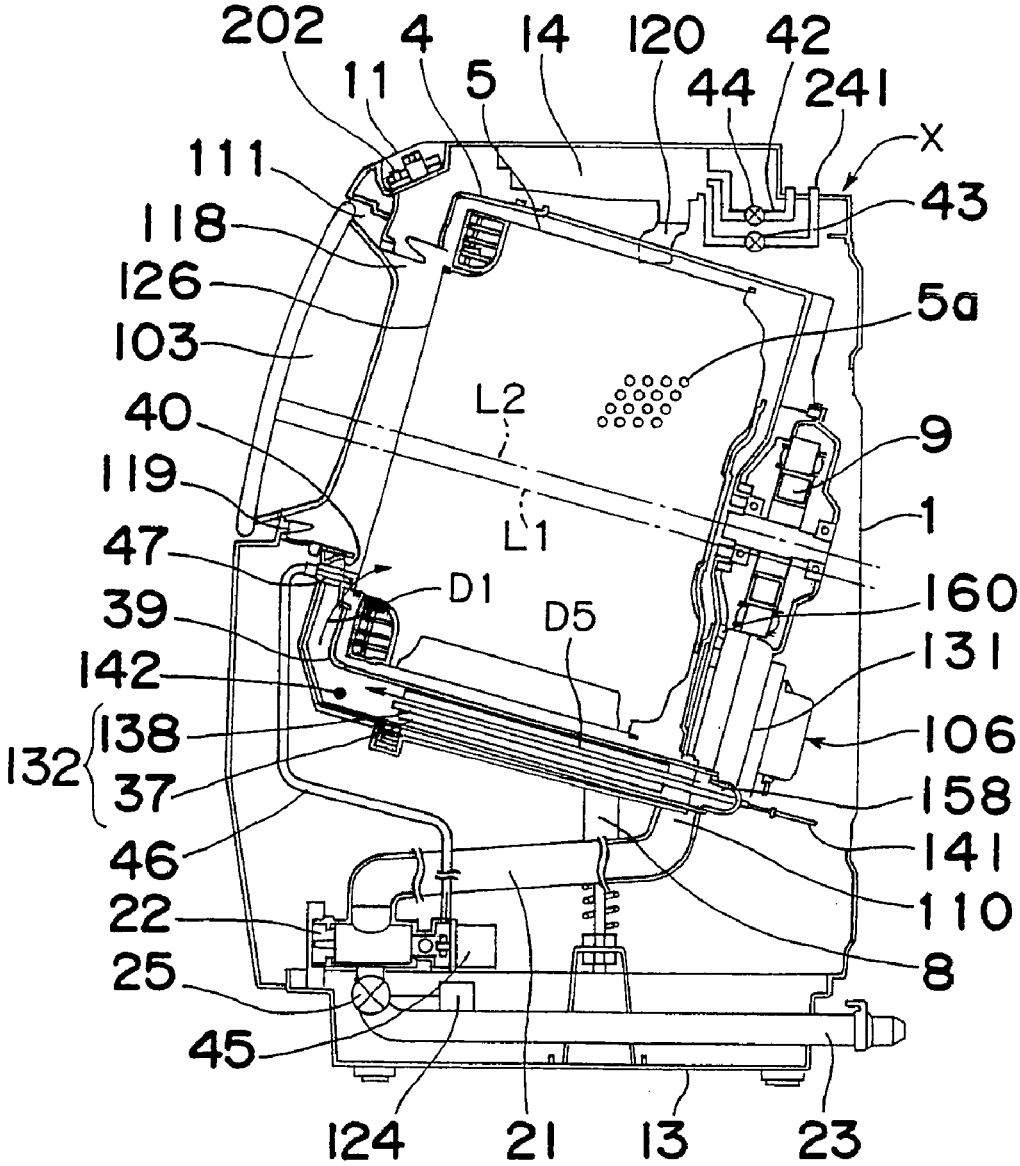
FIG. 14 is a section taken along line F2-F2 in FIG. 13.

FIG. 14 shows a schematic section taken along line F2-F2 in FIG. 13.

Formed on the front face of the outer casing 1 is the outer casing opening 111. The outer casing opening 111 is opened and shut by the door 103 that is pivotable with respect to the outer casing 1, as described above. An upper part of the front face of the outer casing 1 is provided with the operation panel 11 having operation keys, display units, and the like. A control unit 202 for controlling operation of the drum type washing and drying machine X is provided on the reverse side of the operation panel 11 (on a side of a water tank 4), and thus input into the operation panel 11 allows successive or separate performance of a washing process, a rinsing process, a dewatering process, and a drying process. The outer casing 1 elastically supports the water tank 4, which will be described later, through the medium of a suspension 8 as an example of an elastic support unit.

The outer casing 1 houses the water tank 4 having a shape of a bottomed cylinder with a water tank opening 118 that opens in face of the outer casing opening 111. The water tank 4 is positioned slantly so that the rear side of a central axis L1 passing through the centers of gravity in sections perpendicular to a cylinder axis of the water tank 4 is lowered.

The water tank 4 contains a rotary drum 5 having a shape of a bottomed cylinder with a drum opening 126 that opens in face of the water tank opening 118. The rotary drum 5 is connected to a motor 9 residing on backside of the rotary drum 5 and is supported so as to be rotatable in the water tank 4. The rotary drum 5 is positioned slantly so that the rear side of a central axis (rotation axis) L2 thereof is lowered. A plurality of small bores 5*a* are formed in the whole area of a circumferential wall of the rotary drum 5. The small bores 5*a* allow circulation of washing water, air, or the like between a space between the water tank 4 and the rotary drum 5 and a space in the rotary drum 5. The central axis L2 of the rotary drum 5 is positioned above the central axis L1 of the water tank 4.

In a lower part of a space in the water tank 4, there is placed a blower duct 39 through which warm air to be supplied into the rotary drum 5 flows. A front end of the blower duct 39 communicates with a blower port 40 positioned between a lower edge of the water tank opening 118 and a lower edge of the opening 126 of the rotary drum 5. Therefore, the air flowing through the blower duct 39 in a direction of an arrow D1 is forced to blow via the blower port 40 into the rotary drum 5. A rear end of the blower duct 39 is connected to a discharge opening 158 of a fan case 134 (see FIG. 16) that will be described later.

Inside the blower duct 39 is provided a heater unit 132, which is composed of a heater case 37 and a sheathed heater 138 of which major portion is housed in the heater case 37. The heater case 37 is composed of a main body made of metal and a frame for fixing the main body. The frame is made of heat resistant resin, and a front end of the frame is connected to the blower duct 39. The sheathed heater 138 is capable of heating air in the water tank 4, and is also capable of heating washing water in the water tank 4 because the heater is placed in an area to be soaked in the washing water in the water tank 4.

The front face of the water tank 4 is provided with the water tank opening 118 that faces the outer casing opening 111. A packing 119 composed of an elastic material such as rubber and soft resin is fixed at the water tank opening 118. When the door 103 is shut, in this arrangement, the door 103 is brought into intimate contact with the packing 119, so that liquid in the water tank 4 is prevented from leaking out of the water tank 4. To top of the water tank 4 is connected a lower end of a feed water duct 120 for feeding washing water into the water tank 4. On the other hand, an upper end of the feed water duct 120 is connected to a lower part of a detergent case 14. To the detergent case 14 are connected a tap water feeding channel 241 and a bath water feeding channel 42. A feed valve 43 is provided in the middle of the tap water feeding channel 241, and a bath water pump 44 is provided in the middle of the bath water feeding channel 42.

The water tank 4 is provided, at a lower part, with a drain hole 110 for draining washing water in the water tank 4. The drain hole 110 communicates with the blower duct 39. The drain hole 110 is positioned on downstream side of the blower 131. To the drain hole 110 is connected an upper end of a drain duct 21. A lower end of the drain duct 21 is connected through a filter unit 22 to a drain hose 23. Liquid flowing through the drain duct 21 passes through the filter unit 22 before flowing into the drain hose 23 or into a circulation hose 46. The filter unit 22 eliminates foreign matter such as lint from washing water having flowed through the drain duct 21, and thus prevents the foreign matter from entering the drain hose 23 or the circulation hose 46. Herein, the drain hole 110 is an example of a circulation inlet.

The drain hose 23 is provided with a drain valve 25 that is opened/shut by a drain motor 124. The drain valve 25 is controlled so as to be opened when washing water in the drain duct 21 is made to flow into the drain hose 23 and so as to be shut when washing water in the drain duct 21 is made to flow into the circulation hose 46. An upper end of the circulation hose 46 is connected to a circulation nozzle 47 that is positioned at a lower part of the front face of the water tank 4 and that is directed to inside of the rotary drum 5. On the other hand, a lower end of the circulation hose 46 is connected to a circulating pump 45 that is positioned behind the filter unit 22. The circulating pump 45 is operable to suck washing water in the drain duct 21, through the filter unit 22, and discharge the sucked washing water into the circulation hose 46. By activation of the circulating pump 45, washing water drained out of the water tank 4 through the drain hole 110 can be made to pass through the filter unit 22 and can thereafter be returned into the rotary drum 5. In the washing process and/or the rinsing process, washing water is kept clean by the removal of foreign matter while such circulation of the washing water is carried out.

A dryer system 106 is provided at an inlet to the drain hole 110 which communicates with the blower duct 39 to drain washing water from the water tank 4. The dryer system 106 has a blower 131 corresponding to the conventional blower 35, a heater unit 132 corresponding to the conventional heater 36, the blower duct 39, and a dehumidifying heat exchanger 133 (see FIG. 15 and FIG. 16) that will be described later. A filter 160 having metallic yarn woven reticularly is provided in a dehumidification channel 164 between the dehumidifying heat exchanger 133 and the blower 131. The blower 131, the heater unit 132, the dehumidifying heat exchanger 133, the filter 160, and the blower duct 39 are positioned below a plane including the center line L1 of the water tank 4 and including a horizontal axis orthogonal to the center line L1. Thus such members as the units of the dryer system 106 and the filter 160 are cleaned by being soaked in washing water in the washing process or the rinsing process. The heater unit 132, the dehumidifying heat exchanger 133, the blower 131, and the filter 160 are one example of the heater unit, the dehumidification unit, the blower unit, and the filter unit, respectively. Reference numeral 13 in FIG. 14 denotes a bottom platform.

Figure 15:
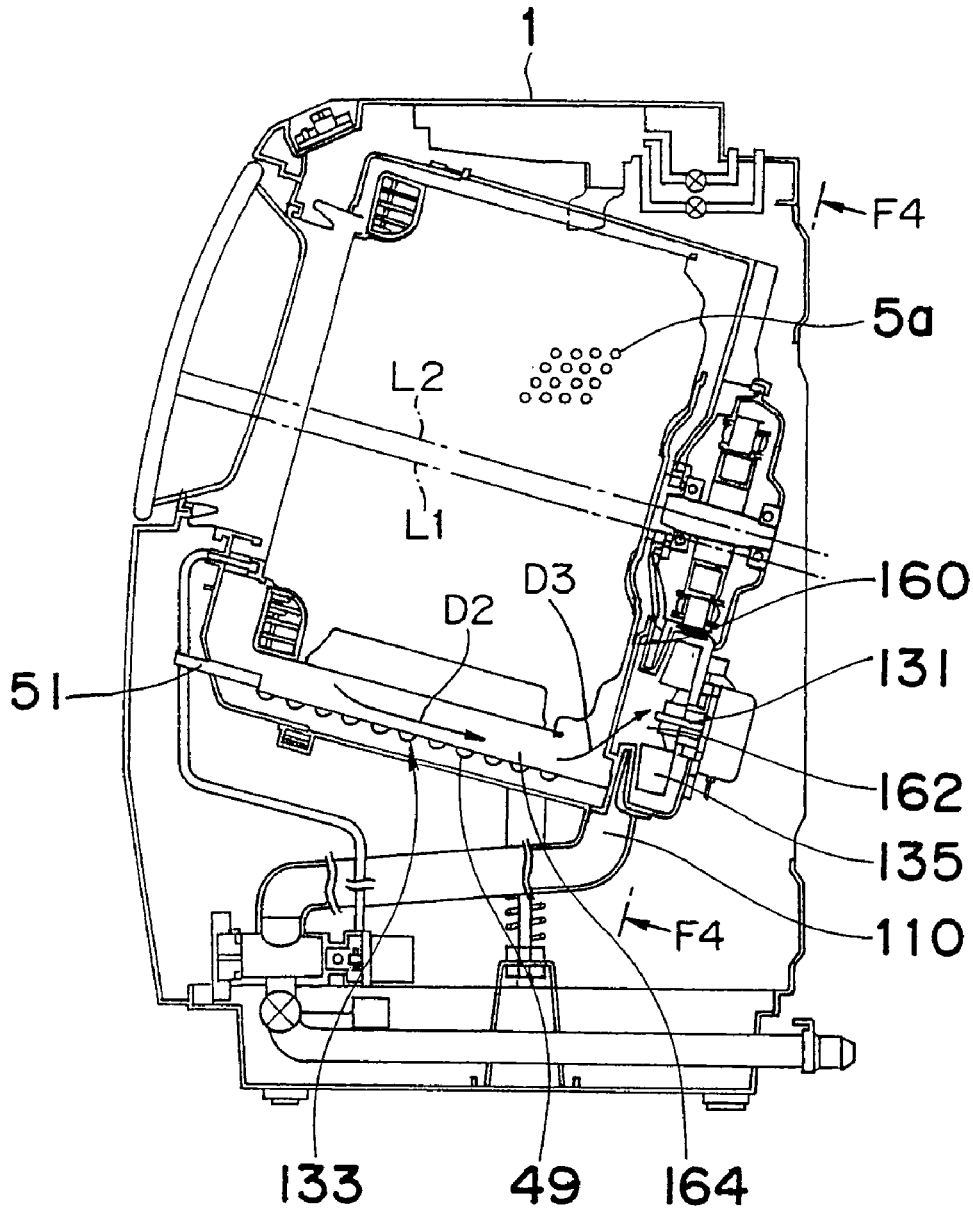
FIG. 15 is a section taken along line F3-F3 in FIG. 13.

FIG. 15 shows a schematic section taken along line F3-F3 in FIG. 13.

The dehumidifying heat exchanger 133 is connected upstream of the blower 131 mounted at a lower part of a rear face of the water tank 4. More particularly, the dehumidifying heat exchanger 133 is provided in a region that is between an inner circumferential surface of the water tank 4 and an outer circumferential surface of the rotary drum 5 and that is soaked in water in the washing process and the rinsing process. The dehumidifying heat exchanger 133 has a metal plate 49 that is positioned slantly so that the front side thereof is heightened, and fixation members 50 (see FIG. 16 and FIG. 17) that are made of stainless steel and that are installed on ends of the metal plate 49. A cooling nozzle 51 is provided above a front end of the metal plate 49. In the drying process, cooling water supplied from the cooling nozzle 51 flows over an upper surface of the metal plate 49 so as to cool the metal plate 49. In this manner, air is cooled by the cooling water and the cooled metal plate 49, and moisture that the air flowing there contains is thereby condensed effectively.

The blower 131 is mounted in a lower position of the rear face of the water tank 4. The blower 131 communicates with the water tank 4 via the inlet 162 and sucks in air in the water tank 4 with rotation of a blower fan 135. The inlet 162 is an example of a suction-side channel.

Figure 16:
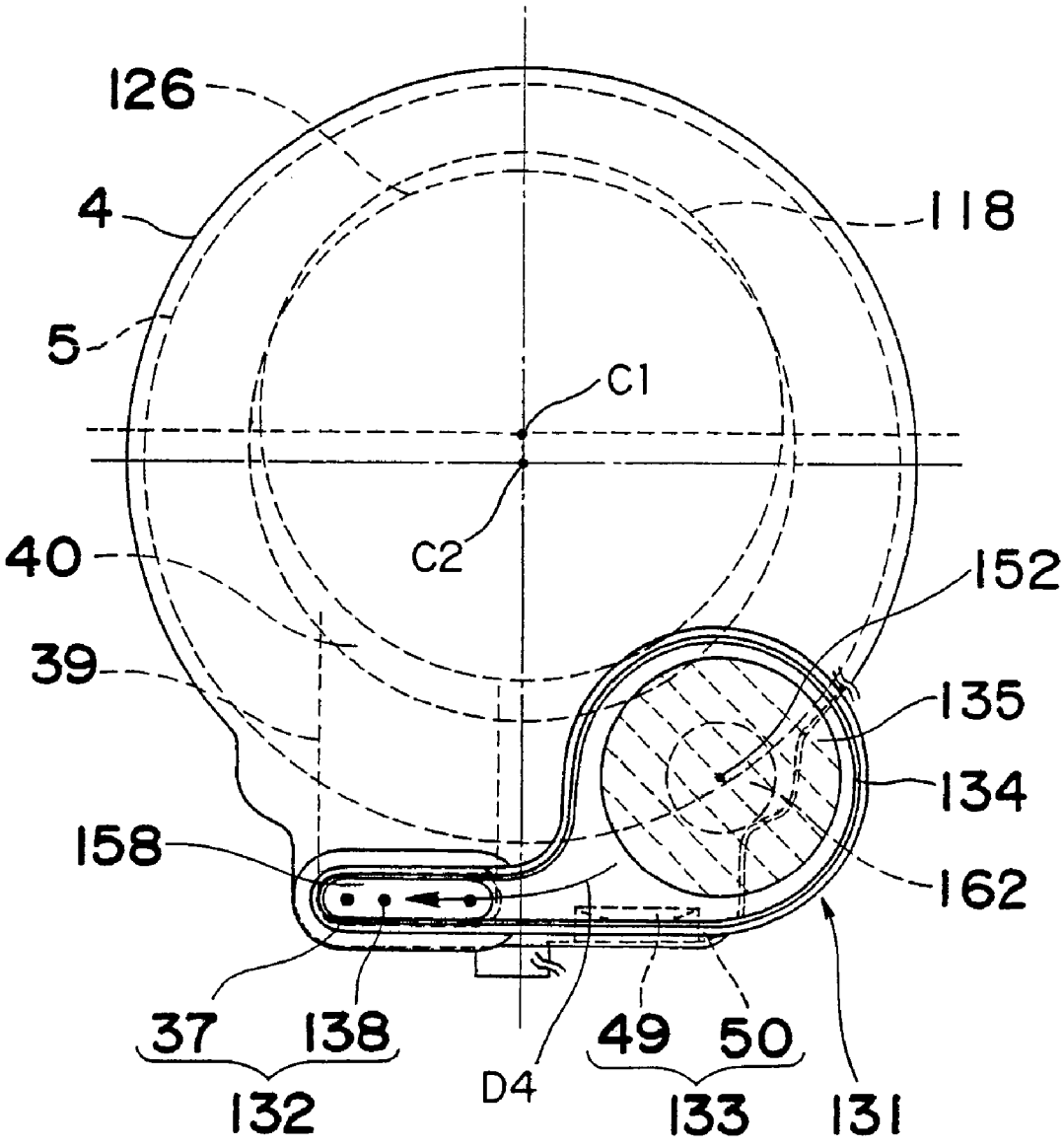
FIG. 16 is a section taken along line F4-F4 in FIG. 15.

FIG. 16 shows a schematic section taken along line F4-F4 in FIG. 15.

The water tank 4 has a shape protruding downward and the blower 131 is configured so as to fit the protruding shape. Periphery of the blower 131 is defined by a fan case 134, in which a blower fan 135 is contained. The fan case 134 extends horizontally across the protruding shape in the lower part of the water tank 4 and communicates with the heater unit 132 and the dehumidifying heat exchanger 133 provided in the lower part of the protruding shape, through the inlet 162 and the discharge opening 158, respectively.

A center C1 of the water tank opening 118 is nearer to a top face of the outer casing 1 than a center C2 of the drum opening 126 is. That is, the water tank opening 118 is shifted toward the top face of the outer casing 1 relative to the drum opening 126. Reference numeral 152 in FIG. 16 denotes a shaft, one end of which is connected to the blower fan 135.

Figure 17:
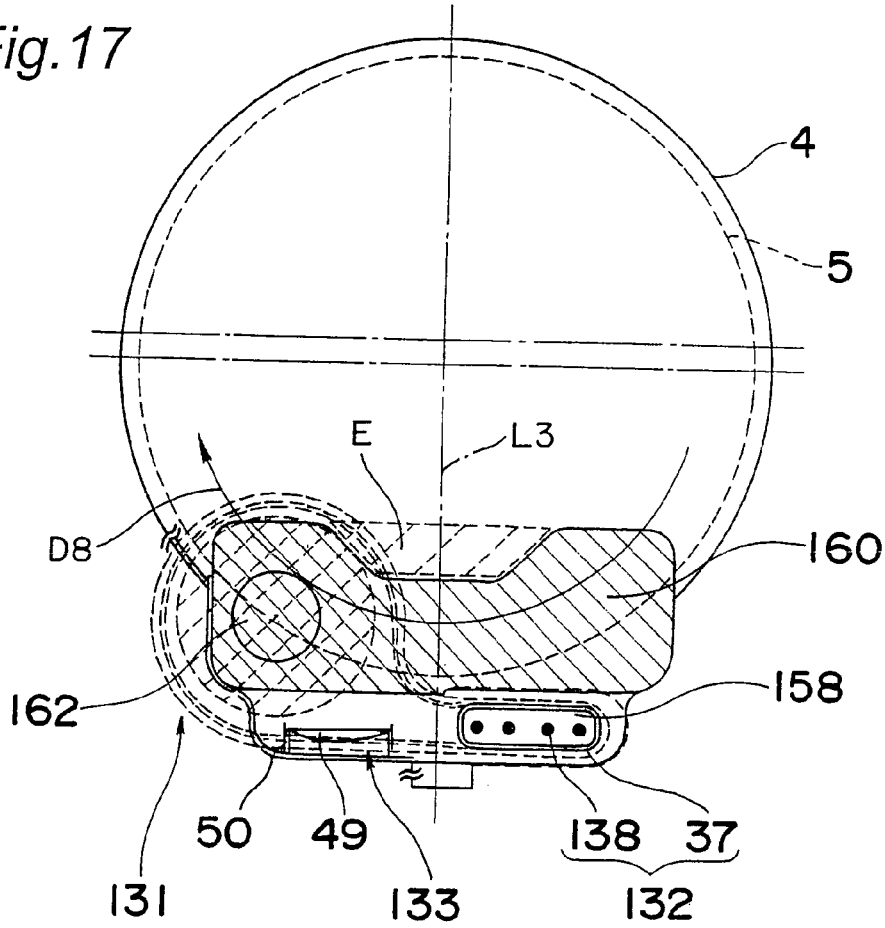
FIG. 17 is a schematic diagram of an inner bottom surface of a water tank of the drum type washing and drying machine according to the second embodiment of the invention.

FIG. 17 shows a schematic diagram of a bottom part of the water tank as seen from the front side.

Inside the lower part of the protruding shape of the water tank 4, the heater unit 132 is positioned on the right side, and the dehumidifying heat exchanger 133 is positioned on the left side. The heater unit 132 and the dehumidifying heat exchanger 133 are positioned so as to be parallel to the central axis L1 of the water tank 4 and, as will be described later, and the dehumidifying heat exchanger 133 and the heater unit 132 are located on upstream side and downstream side, respectively, with respect to circulating air, with the blower 131 therebetween.

Figure 20:
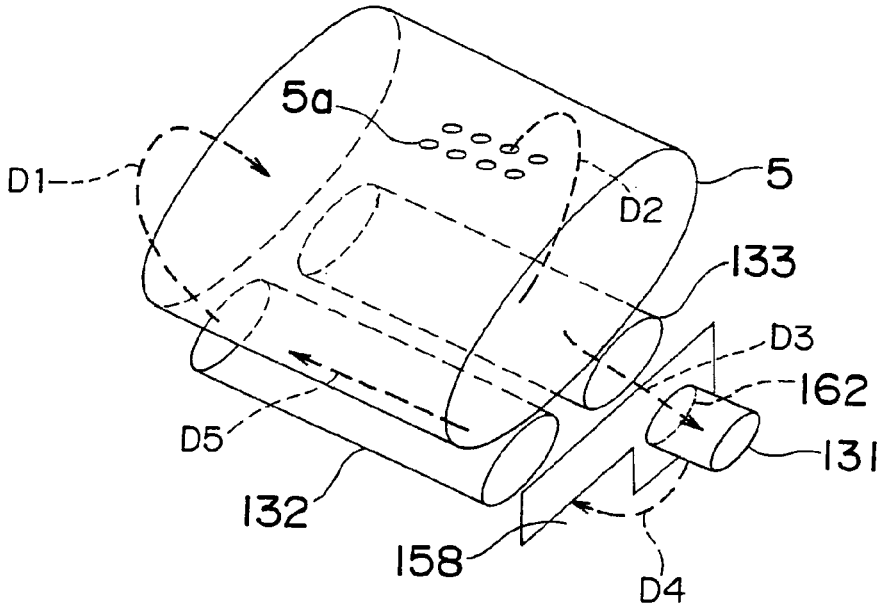
FIG. 20 is a schematic diagram showing a circulation circuit of air in the drying process.

In the drying process, as shown in FIGS. 14 through 16, air forwarded by the blower 131 is heated while passing through the heater unit 132 as shown by an arrow D5 (see FIG. 14) and is thereafter forced to blow from the water tank opening 118 into the rotary drum 5 as shown by an arrow D1 (see FIG. 14). The air, which has moisture vaporized from wet wash in the rotary drum 5 to become highly humid, flows out, through the small bores 5*a* in a circumferential surface of the rotary drum 5, into the space between the inner peripheral surface of the water tank 4 and the outer peripheral surface of the rotary drum 5 and further flows along the dehumidifying heat exchanger 133 as shown by an arrow D2 (see FIG. 15). The air having got highly humid is cooled and dehumidified by the dehumidifying heat exchanger 133 and the cooling water. The dehumidified air undergoes repetition of a cycle in which the dehumidified air enters through the inlet 162 into the blower 131 as shown by an arrow D3 (see FIG. 15), is fed from the discharge opening 158 into the heater unit 132 as shown by an arrow D4 (see FIG. 16), and is heated there. The process of drying the wash advances in this way. FIG. 20 schematically shows the flow of air in the drying process described above.

In the drying process, a wash is thus dried with the air in the water tank 4 sequentially passed and circulated through the dehumidifying heat exchanger 133, the blower 131, and the heater unit 132. In this process, minute dust such as cotton waste from the wash enters the fan case 134 and adheres to inside an inner wall of the fan case 134, one end of the shaft 152 or the blower fan 135; in the next washing process or the next rinsing process, however, the inside of the fan case 134, the one end of the shaft 152 or the blower fan 135 are soaked in washing water having flowed into the fan case 134, and the dust such as cotton waste is therefore washed away and removed by the washing water. This prevents constriction of the air channel in the fan case 134 and an increase in resistance against the rotation of the blower fan 135, and allows constant, efficient circulation of air for drying a wash.

Figure 18:
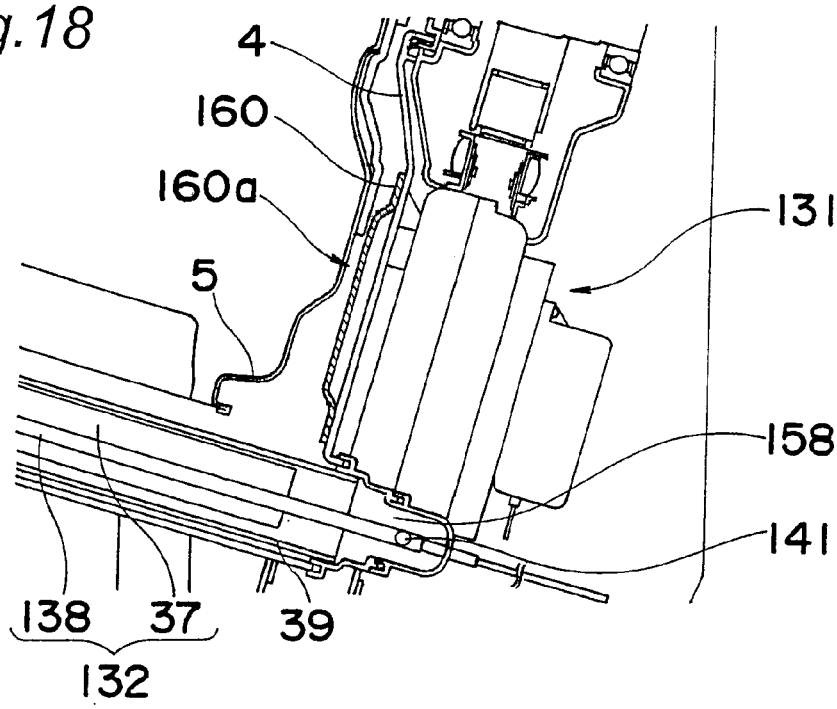
FIG. 18 is a detail of surroundings of a filter in FIG. 16.

FIG. 18 shows details of surroundings of the filter 160 in FIG. 14.

The blower 131 is mounted to the lower part of the rear face of the water tank 4. The blower 131 is connected to the water tank 4 through the discharge opening 158 that is an outlet of blast from the blower 131, and the discharge opening 158 is connected to the blower duct 39.

Figure 19:
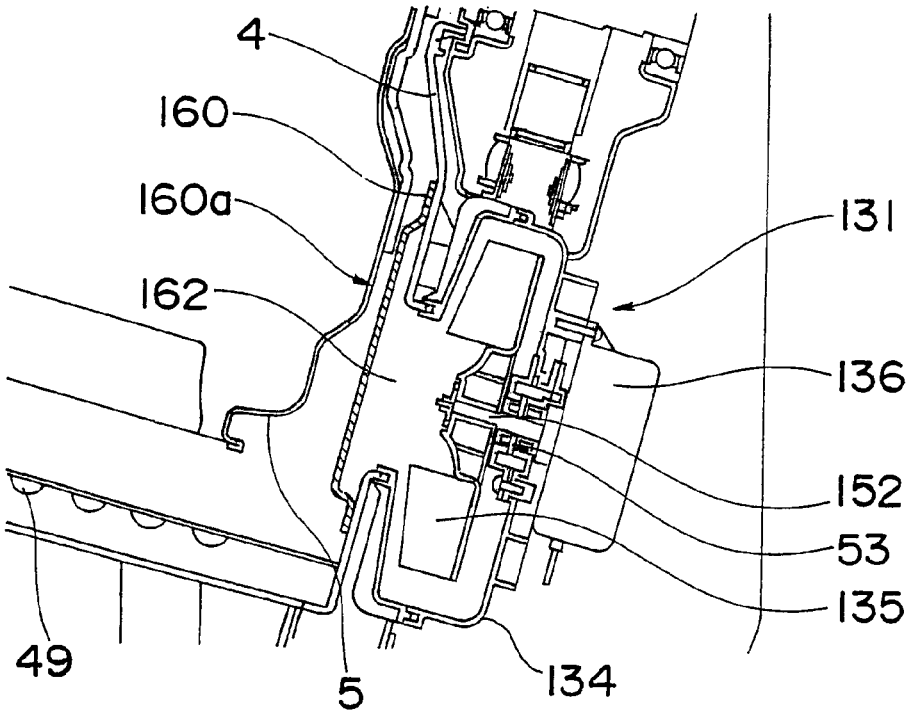
FIG. 19 is a detail of surroundings of a filter in FIG. 17.

FIG. 19 shows detail of surroundings of the filter 160 in FIG. 15.

The blower 131 has the fan case 134, the blower fan 135 that is positioned so as to be rotatable in the fan case 134, a fan motor 136 that drives the blower fan 135 to rotate, the shaft 152 that has one end connected to the blower fan 135 and the other end connected to the fan motor 136, and a seal receiving part 53 that is provided so as to radially surround the shaft 152. The shaft 152 receives a rotational driving force from the fan motor 136 and thus rotates with the blower fan 135. As described above, the one end of the shaft 152 is positioned so as to be soaked in washing water that flows into the fan case 134 in the washing process or the rinsing process. The blower fan 135, which makes air blow against the wash in the drying process, can be controlled so as to rotate also in the washing process and/or the rinsing process to produce water flow.

The blower 131 is also connected to the water tank 4 through the inlet 162 that is an entrance for blast of the blower 131. The filter 160 having metallic yarn woven reticularly is provided in a space between the inlet 162 and the metal plate 49, and is fixed so as to cover the inlet 162 in order that air in the water tank 4 may not pass through the inlet 162 without passage through the filter 160.

The filter 160 is provided inside and on a bottom face of the water tank 4, as shown in FIG. 17, is generally shaped like an arc in left-right symmetry about a center line L3 of the drum type washing and drying machine X, in plan view as viewed from inside of the water tank 4, and faces the inlet 162 (see FIG. 15) from the water tank on left side of FIG. 17. As shown in FIG. 16, the blower fan 135 is provided so as to face the inlet 162. FIG. 17 shows the dehumidifying heat exchanger 133 provided on the channel to the inlet 162.

As a result, air (washing water) having flowed in a direction perpendicular to the paper sheet of FIG. 17 through the dehumidification channel 164 (see FIG. 15) to the inlet 162 flows through the filter 160 into the blower 131. In the washing process and the rinsing process, washing water flows in the water tank 4 and the blower 131 and foreign matter as lint contained in the washing water is thus collected by passage of the washing water through the filter 160, so that the foreign matter is prevented from intruding into the blower 131. The foreign matter collected by the filter 160 is removed from a surface of the filter 160 by water flow produced by rotation of the rotary drum 5, and clogging of the filter 160 is accordingly eliminated. The inner circumferential surface of the water tank is shaped like a gentle arc and extends along directions of the rotation of the rotary drum, and foreign matter such as lint having sunk to the bottom of the water tank is therefore shaken in the directions of the rotation by the water flow produced by the rotation of the rotary drum; however, the filter 160 provided on the bottom face of the water tank 4 is resistant to readhesion of foreign matter to the filter 160. In the drying process, air flows through the water tank 4 and the blower 131, and foreign matter contained in the air is thus collected with passage of the air through the filter 160, so that the foreign matter is prevented from intruding into the blower 131.

In order to merely collect foreign matter such as lint in washing water or air that is circulated by the blower 131 as described above, the filter 160 has only to cover an area on which the suction force of the blower fan 135 acts, that is, a part that faces the inlet 162 and that is shown on the lower left side of the water tank 4 in FIG. 17. The lint conveyed by the washing water or air in the actual washing process, rinsing process or drying process, however, is accumulated on the filter 160 in a long span and, sooner or later, a large volume of lint accumulated on the filter 160 facing the inlet 162 will cause a decrease in suction efficiency.

In the second embodiment, therefore, the filter 160 is not only provided on the part on which the suction force of the blower fan 135 directly acts and which faces the inlet 162 on the lower left side of the water tank 4 in FIG. 17 but is extended to a right side part which does not face the blower 131. That is, the filter 160 is positioned over an area larger than an opening area of the inlet 162, as viewed in the direction of the central axis L1 of the water tank 4. In such a configuration, the lint initially adheres only onto the area facing the inlet 162 of the blower 131 and, with prolongation of operating time, a suction force in the part to which the lint has adhered decreases. Accordingly, lint does not further adhere to the part where the suction force is nullified, but shifts to a part where lint has not adhered yet, so that the area onto which lint adheres gradually expands and so that the adhesion of the lint is concentrated on the left side in FIG. 17, in the course of time.

In the second embodiment in which the filter 160 is extended to the right side part in FIG. 17 as described above, the right side part where lint has not adhered can be used as a filter, and a filtering effect can be maintained for an extremely long term even if the suction force in the left side part in FIG. 17 is decreased with the prolonged operating time.

The filter 160 used in the drum type washing and drying machine according to the second embodiment is not shaped like a simple flat plate but includes a swelling part 160*a* that swells in a direction of the rotary drum 5, i.e., in the direction of the metal plate 49 constituting the dehumidifying heat exchanger 133, as clearly shown in FIG. 18 and FIG. 19. Such slight swelling in the direction of the water tank 4 forms a blast channel between the bottom surface of the water tank 4 and the filter 160 and thereby ensures a long-term availability of the filter 160.

Though the filter 160 may be of a plastic molding or a metal plate from which small bores have been punched out, instead of metallic yarn woven reticularly, such a molded or punched article, in practice, may have burrs and return scrap around the filter bores, on which lint, fuzz or the like may be hooked, resulting in a cause of clogging of the small bores. Therefore, the filter 160 is desirably composed of a net structure having wires woven reticularly. Such a net structure is not only free from above-mentioned worry of burrs and return scrap but allows an increase in ratio of small-bore area to plate surface area (i.e., aperture ratio), resulting in excellent capability as a foreign matter collecting unit.

As the wires constituting the filter 160, resin wires and the like are conceivable other than metal wires; however, metal wires are preferable because metal wires have smooth surfaces and resist catching lint, pieces of thread and the like. To fix crossings of meshes of the wires, e.g., by resin coating of metallic yarn woven reticularly, prevents occurrence of problems such as variation in size of openings of the meshes that may be caused by foreign matter caught between the crossed wires, shift of the crossings or the like.

In this arrangement, the opening size of the meshes of the filter 160 may be between 1 mm and 3 mm. With this configuration, comparatively large foreign matter, such as lint and pieces of thread in washing water, is collected which is prone to be twisted around the shaft linking the blower fan to the fan motor and which greatly influences the blowing capacity of the blower unit. Early clogging of the filter 160, which may be caused by comparatively small foreign matter such as fluff, is therefore prevented.

The provision of such a filter 160 avoids problems including twining of foreign matter such as lint and fluff around the blower fan 135 or the shaft 152 thereof. Additionally, as described above, the area where the filter 160 is positioned extends not only over the part which faces the inlet 162 and on which the suction force of the blower fan 135 directly acts but also to the part distant from the blower fan 135, so that the suction force of the blower fan 135 can be kept strong for a long period.

Though the clogging of the filter 160 in the second embodiment is automatically eliminated by water flow produced by the rotation of the rotary drum 5 in the washing process and the rinsing process, blades 170 that facilitate producing water flow for cleaning surfaces of the filter 160 with the rotation of the rotary drum 5 are further provided on a back face of the rotary drum 5 facing the water tank 4, in order to eliminate the clogging of the filter 160 more reliably. Herein, the blades 170 are an example of the cleaning unit.

Figure 21:
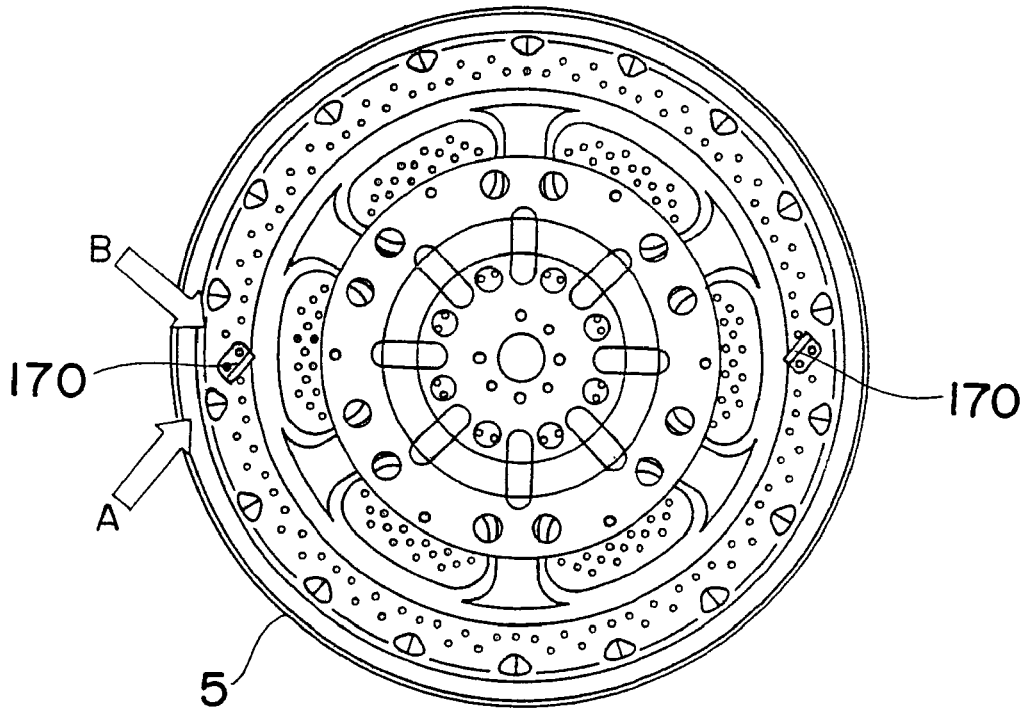
FIG. 21 is a schematic diagram of a back face of a rotary drum facing the water tank of the drum type washing and drying machine according to the second embodiment of the invention.
Figure 22A:
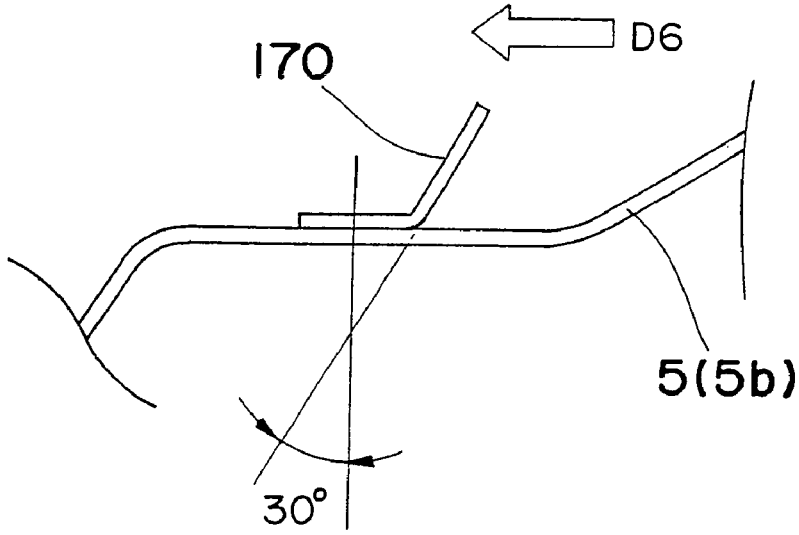
FIG. 22A is a schematic representation of a blade as viewed in a direction of an arrow A in FIG. 21.
Figure 22B:
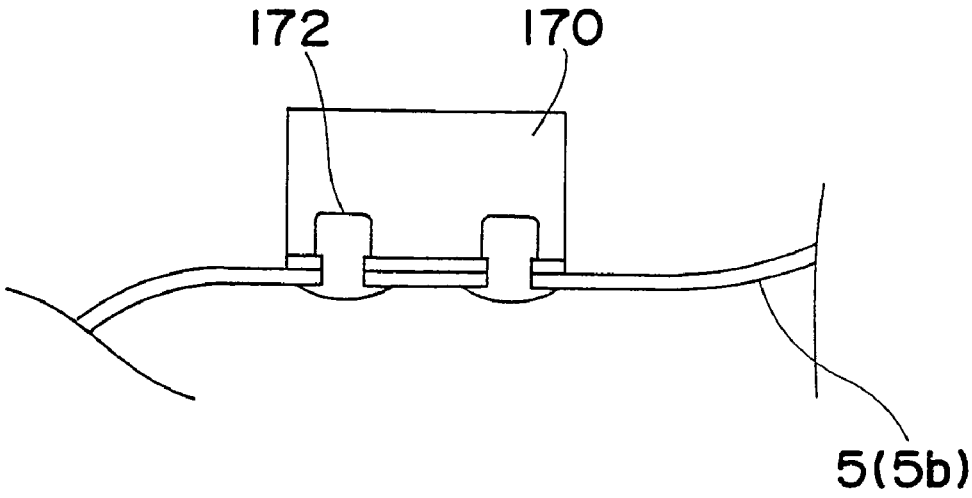
FIG. 22B is a schematic representation of the blade as viewed in a direction of an arrow B in FIG. 21.

FIG. 21 shows a schematic representation of the back face of the rotary drum 5 facing the water tank 4, FIG. 22A shows a schematic representation of the blade as viewed in a direction of an arrow A in FIG. 21, and FIG. 22B shows a schematic representation of the blade as viewed in a direction of an arrow B in FIG. 21.

On the back face of the rotary drum 5 facing the water tank 4, the blades 170 are mounted in positions in 180 degrees rotational symmetry. As shown in FIG. 21, the blades 170 are tilted by 45 degrees with respect to a direction of a diameter of the rotary drum 5 and are fixed onto the bottom surface of the rotary drum 5 by rivets 172 (see FIG. 22B). As shown in FIG. 22A, additionally, the blades 170 are tilted by 30 degrees with respect to an axis of rotation of the rotary drum 5 in a direction opposite to a rotation direction in the dewatering process which direction is shown by an arrow D6. The tilt angles of 45 degrees and of 30 degrees are provided in order to prevent the blades 170 from emitting wind noise owing to the rotation, as fast as 1000 rpm, of the rotary drum 5 in the direction of the arrow D6 in the dewatering process. Though the blades 170 are tilted with respect to the direction of the diameter of the rotary drum 5 and with respect to the axis of rotation of the rotary drum 5 in the second embodiment, the wind noise in the dewatering process can be reduced by adjustment of either one of the tilt angle with respect to the direction of the diameter of the rotary drum 5 and the tilt angle with respect to the direction of the axis of rotation of the rotary drum 5.

The blades 170 rotate about the rotation axis of the rotary drum 5, with the rotation of the rotary drum 5, so as to produce the water flow of washing water in the washing process and the rinsing process, and tracks of the rotation pass through a plane of projection of the filter 160 as shown by an arrow D8 in FIG. 17. The water flow of washing water produced by the rotation of the blades 170 acts on foreign matter having adhered onto the surfaces of the filter 160 and releases the foreign matter from the filter 160. The release action is particularly greater in positions that are nearer to the track of the passage of the blades 170, and thus the filter 160 of the second embodiment may have a concave shape in an area E near to the center of the rotary drum 5 as shown in FIG. 17. The blades 170 can be configured so that a plurality of distances exist between the blades 170 and the rotation axis of the rotary drum 5, therefore, the filter 160 can be wider and the cleaning effect can be imparted even to such a recessed area E.

The blades 170 are composed of a plurality of metal pieces fixed onto the bottom surface of the rotary drum 5 and are preferably provided in rotationally symmetrical positions, so as not to disturb a rotation balance of the rotary drum 5. Alternatively, the blades 170 can be provided at least at one site for correcting unbalance based on caulking of a circumferential wall of the rotary drum 5. The blades 170 are not necessarily made of metal but may be made of resin, for example.

Figure 23:
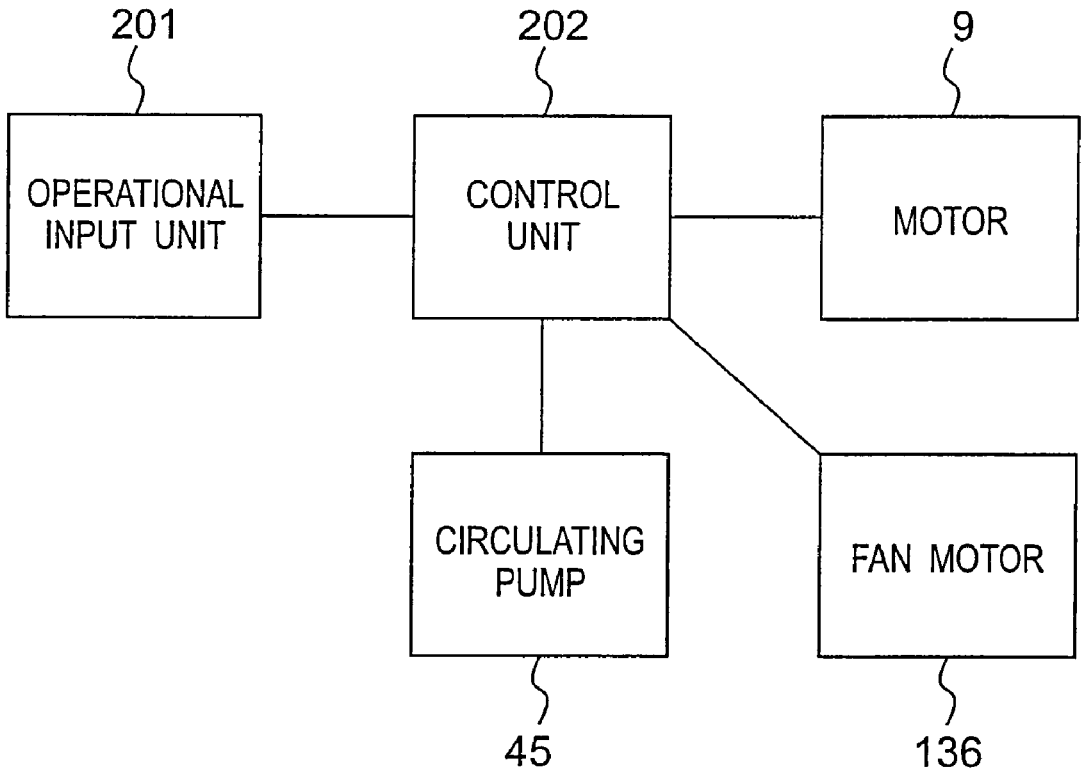
FIG. 23 is a block diagram of main components of the drum type washing and drying machine according to the second embodiment of the invention.

FIG. 23 shows a block diagram of main components of the drum type washing and drying machine X.

A control unit 202 shown in FIG. 23 has a computing unit such as CPU and a storage unit such as ROM and RAM, and generally controls the drum type washing and drying machine X. An operational input unit 201 shown in FIG. 23 is an interface for operational input that is provided on an operation panel 11 of the drum type washing and drying machine X. Operational input information from the operational input unit 201 is inputted into the control unit 202. With operational input into the operational input unit 201, a user selects an operation course from washing courses such as "standard," "soak," "large wash," "Ag rinse," "my-home style," and "dry" courses and from maintenance courses such as "tank wash" course for washing the water tank 4, the rotary drum 5 and the like and "filter wash" course that is designed specifically for removal of foreign matter from the filter 160 and, based on the selected course, the control unit 202 controls components of the drum type washing and drying machine X including the motor 9, the circulating pump 45, and the fan motor 136. The operational input unit 201, the control unit 202, the "standard" course, and the "filter wash" course are an example of the input unit, the rotary drum rotation control unit, the first control status, and the second control status, respectively.

Figure 24:
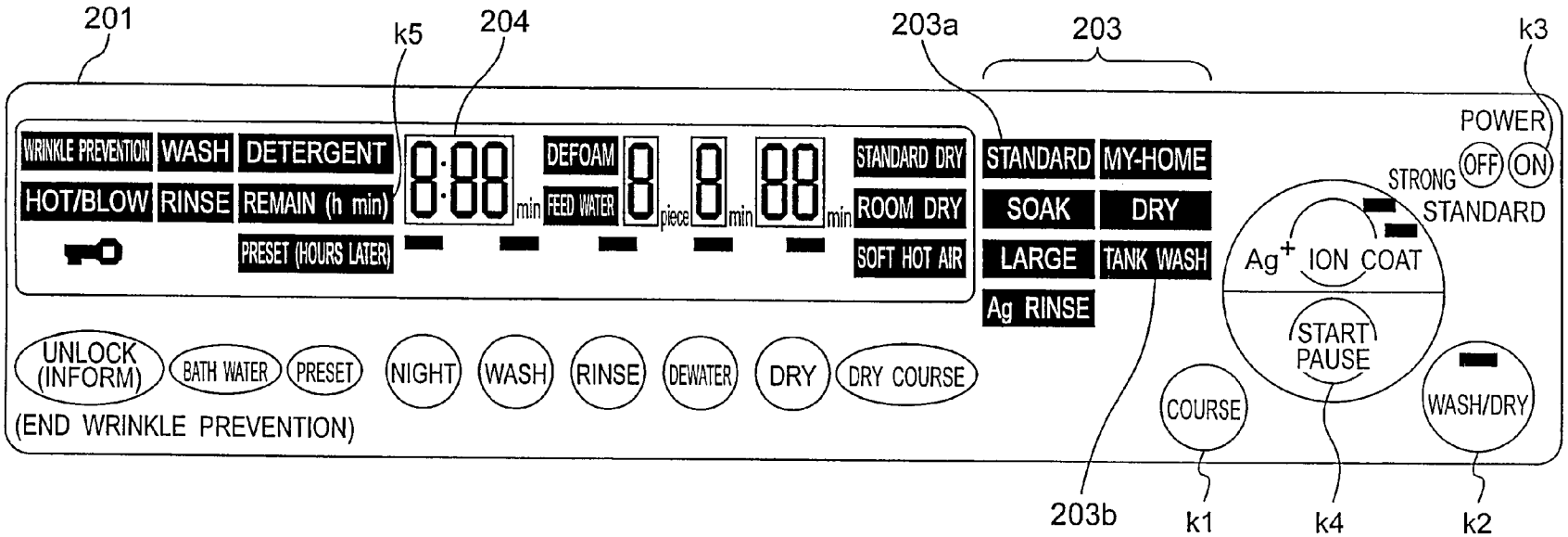
FIG. 24 is a front view of an operational input unit of the drum type washing and drying machine according to the second embodiment of the invention.

FIG. 24 shows detail of the operational input unit 201.

The operational input unit 201 includes a course key k1 for selecting an operation course, a course display section 203 for indicating which course is selected by the course key, a timer display section 204 for displaying remaining time before termination of the course in operation, remaining time before a preset start time of an operation, and the like, a wash/dry key k2 for selecting whether an operation including the drying process is to be automatically performed or not, a start key k4 for starting or temporarily stopping a washing operation, and the like.

When an operation course is selected by manipulation of the operational input unit 201, the control unit 202 counts number of times of pressing the course key k1 and accordingly turns on a display lamp corresponding to the selected operation course in the course display section 203 (that is, a lighted lamp in the course display section 203 is shifted with pressing operations of the course key k1). A user performs a predetermined confirm manipulation (e.g., a pressing operation of the wash/dry key k2 or the start key k4) on condition that a display lamp corresponding to the selected operation course has been turned on, and the control unit 202 then determines that performance of the operation course corresponding to the number of times of pressing the course key k1 has been requested. Without any manipulation of the course key k1 at power-on, a display lamp 203*a* for the "standard" course among the courses described above is lighted, meaning that the "standard" course has been selected. When the wash/dry key k2 or the start key k4 is pressed (i.e., the selection is confirmed) without any pressing operation of the course key k1 immediately after power-on, the control unit 202 starts control over the components that correspond to the "standard" course as will be described later. On condition that the "tank wash" course is to be performed, similarly, a user repeatedly presses the course key k1 and subsequently performs the predetermined confirm manipulation (e.g., the pressing operation of the wash/dry key k2 or the start key k4) in a status in which a display lamp 203*b* of "tank wash" in the display section 203 is lighted, and then the control unit 202 starts control over the components that correspond to the "tank wash" course as will be described later.

Figure 25:
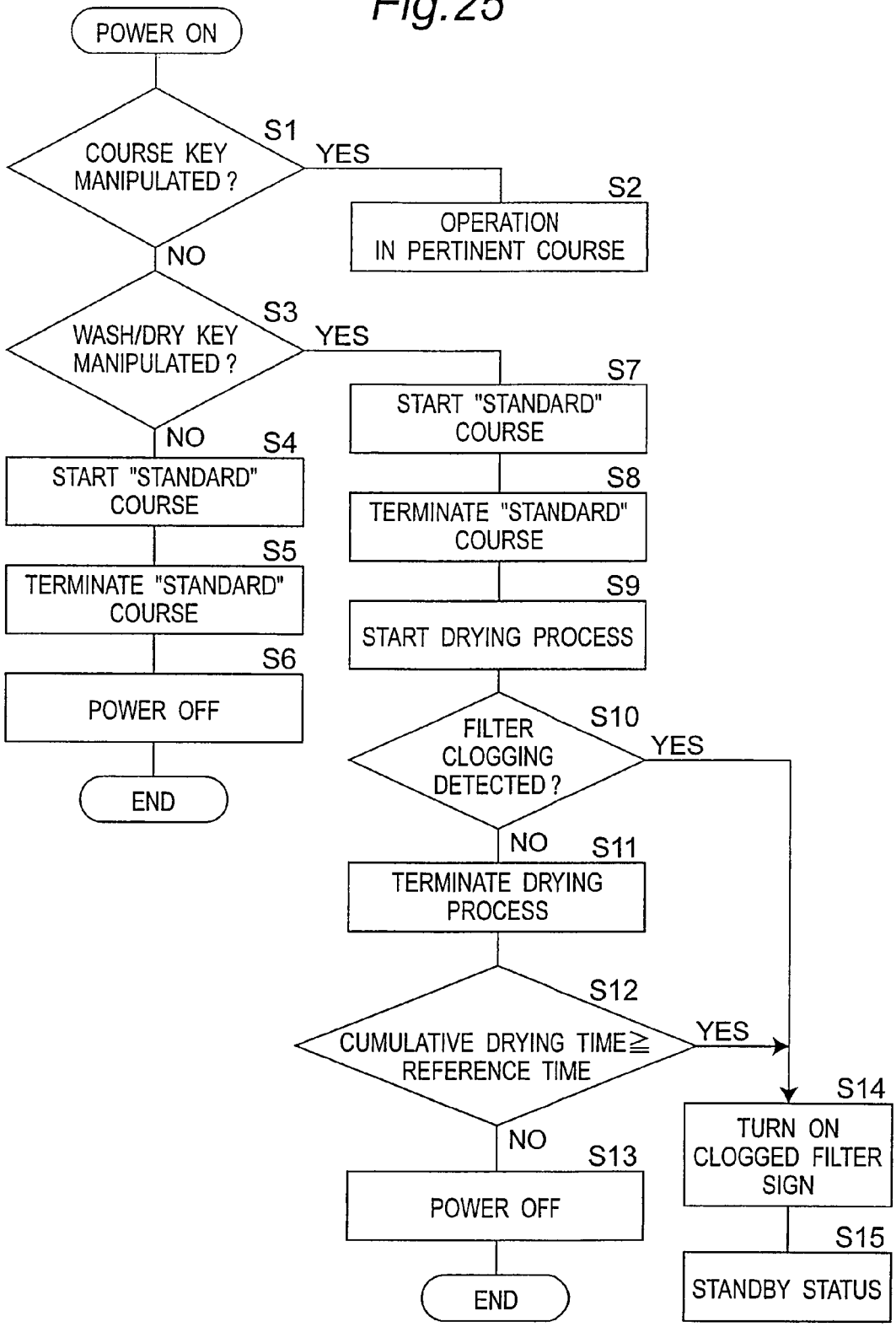
FIG. 25 is a flow chart showing a control procedure executed by a control unit of the drum type washing and drying machine according to the second embodiment of the invention.
Figure 26A:
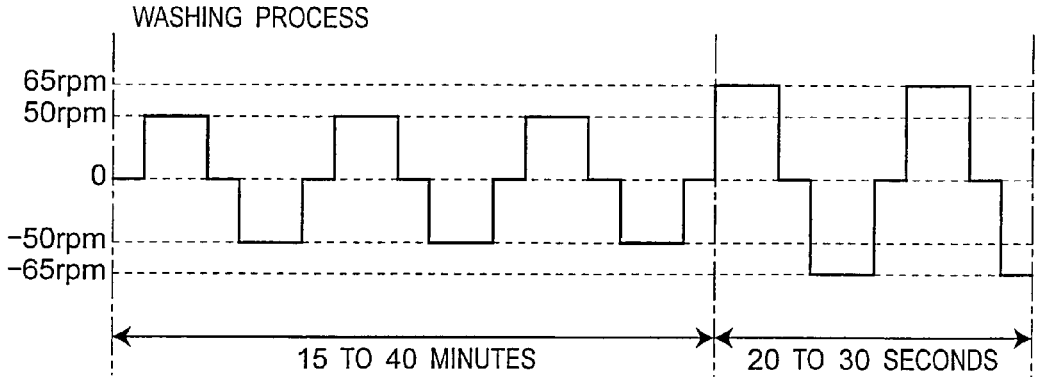
FIG. 26A is a timing chart representing directions and numbers of rotation of the rotary drum in a washing process effected by the control unit of the drum type washing and drying machine according to the second embodiment of the invention.
Figure 26B:
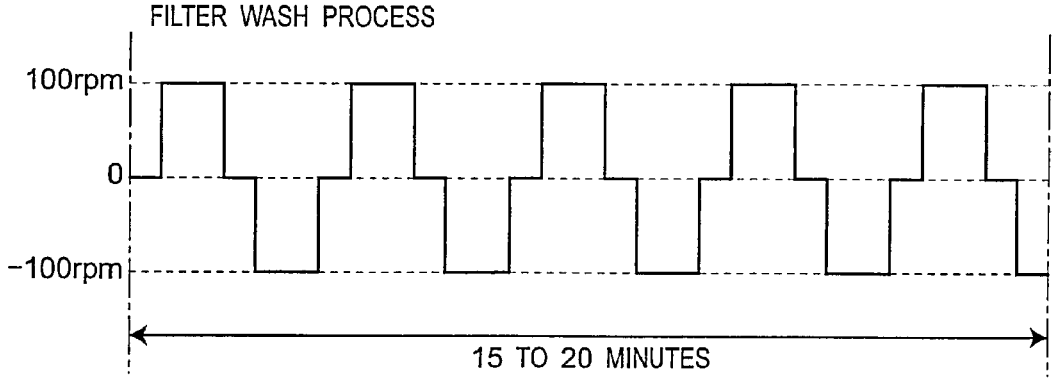
FIG. 26B is a timing chart representing directions and numbers of rotation of the rotary drum in a filter wash process effected by the control unit of the drum type washing and drying machine according to the second embodiment of the invention.
Figure 26C:
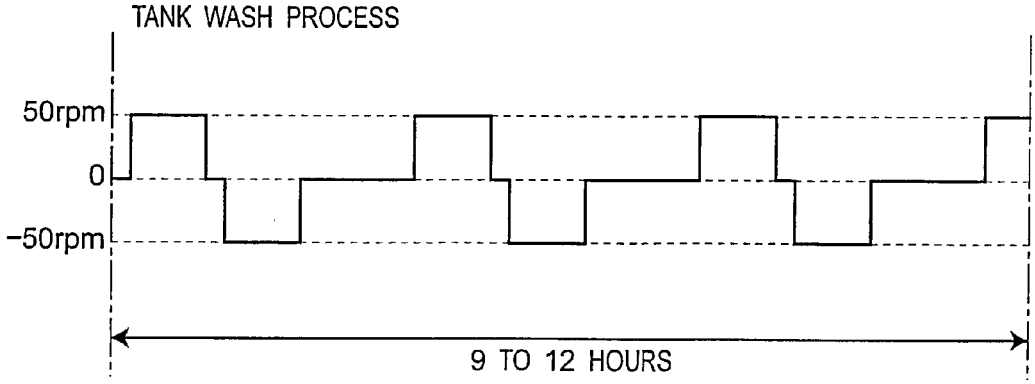
FIG. 26C is a timing chart representing directions and numbers of rotation of the rotary drum in a tank wash process effected by the control unit of the drum type washing and drying machine according to the second embodiment of the invention.

FIG. 25 shows a flow chart representing a processing procedure of the control unit 202. FIG. 26A, FIG. 26B, and FIG. 26C show timing charts representing directions and numbers of rotation of the rotary drum 5 in the washing process in the "standard" course, a filter washing process in the "filter wash" course, and a tank washing process in the "tank wash" course, respectively.

Hereinbelow, contents of process control performed by the control unit 202 of the drum type washing and drying machine X will be described with reference to FIGS. 24 through 26C. Steps of the flow shown in FIG. 25 are carried out under control of the control unit 202 over the components of the drum type washing and drying machine X including the motor 9, the circulating pump 45, and the fan motor 136. Reference characters S1, S2, . . . in FIG. 25 represent process step numbers, and the process is started from step S1 upon power-on for the drum type washing and drying machine X, i.e., when a user presses a power-on key k3 shown in FIG. 24.

In the step S1, the control unit 202 determines whether the course key k1 has been pressed or not in the operational input unit 201. At power-on, as described above, the display lamp 203*a* for the "standard" course is lighted, meaning that the "standard" course has been selected. Accordingly, the step S1 corresponds to determining whether a user requests the "standard" course to start or not. If the predetermined confirm manipulation (e.g., a pressing operation of the wash/dry key k2 or the start key k4) is carried out after the course key k1 is pressed at least one time (YES in the step S1), the flow goes to a step S2. Each pressing operation of the course key k1 changes the selected course from "standard," to "soaking," and then to "large wash," and then to "Ag rinsing," and then to "my-home style," and then to "dry," and then to "tank wash" and finally to "filter wash," and a further pressing operation of the course key k1 with the "filter wash" selected causes the selected status to return to the "standard" course. That is, the status returns to that in the step S1. Herein, the operational input unit 201 is an example of the control status switching unit."

In the step S2, the control unit 202 controls the components in accordance with the course selected in the step S1. The washing courses of "soaking," "large wash," "Ag rinsing," "my-home style," and "dry" are different from the "standard" course in speed at which the motor 9 rotates the rotary drum 5, downtime in which the rotary drum 5 is not rotated, and the like. Also, the washing courses of "soaking," "large wash," "Ag rinsing," "my-home style," and "dry" may be provided with functions having no relation to characteristics of the invention and, in those courses, the elimination of foreign matter (such as lint) from the filter 160 and the elimination of foreign matter (such as fluff) from the blower fan 135 and the drying channel, which are characteristic of the invention, are performed in the same manner as in the "standard" course. Therefore, the control that is characteristic of the invention will be described below with use of the "standard" course as an example.

If the control unit 202 determines that the wash/dry key k2 has been pressed in a status where the "standard" course has been selected, such as a status where the course key k1 has not yet been pressed (YES in the step S3), the flow goes to a step S7. If it is determined that the "standard" course has been selected (NO in the step S1) and that the start key k4 has been pressed (NO in the step S3), the flow goes to a step S4 in which the control unit 202 performs the processing in the "standard" course. In the status where the "standard" course (ditto for the washing courses of "soaking," "large wash," "Ag rinsing," "my-home style," and "dry") has been selected, a pressing operation of the wash/dry key k2 (the confirm operation) means a request input for execution of the drying process in addition to the washing process, the rinsing process, and the dewatering process.

In the step S4, the control unit 202 controls the components for the washing and rinsing processes of the "standard" course, for washing, rinsing, dewatering a wash, and removing foreign matter that has adhered to the filter 160, the blower fan 135 and the drying channel. The following will describe the control in the "standard" course for removing foreign matter such as lint that has adhered to the filter 160 in the drum type washing and drying machine X of the second embodiment of the invention.

The "standard" course has three processes, i.e., the washing process, the rinsing process, and the dewatering process. In the washing process, as shown in the term chart of FIG. 26A, the control unit 202 controls the motor 9 to rotate the rotary drum 5 clockwise and counterclockwise alternately at 50 rpm, which is a first rotation speed. When the direction of the rotation is switched, a stop interval (a first interval, on the order of 2 to 4 seconds) is inserted in which the motor 9 is not driven. Such rotational drive continues ordinarily for 15 to 40 minutes, on basis of a quantity of wash contained in the rotary drum 5 or settings a user provides. An indication "50 rpm" shown in FIG. 26A designates status in which the rotary drum 5 is rotating clockwise, and an indication "−50 rpm" designates status in which the rotary drum 5 is rotating counterclockwise. The clockwise and counterclockwise directions will collectively be referred to as reciprocal directions hereinbelow.

Minute foreign matter such as fluff or fuzz that cannot perfectly be collected by the filter 160 passes through the filter 160 and then may adhere onto the blower fan 135 or onto some other locations in the drying channel (the channel extending along the arrows D1 through D5 in FIG. 20) in the dryer system 106. In the washing process in which washing water exists in the water tank 4 and in which the drying channel is soaked in the washing water, the control unit 202 controls and drives the fan motor 136 to rotate the blower fan 135 soaked in the washing water. Then water flow produced by the blower fan 135 washes away the foreign matter such as lint or fuzz having adhered onto the blower fan 135 and into the drying channel.

During tens of seconds, which is predetermined time, after the blower fan 135 starts rotating, the control unit 202 controls and operates the circulating pump 45 in synchronization with the blower fan 135, in order to circulate the washing water through the channel from the drain duct 21 to the circulation hose 46. In a status in which only the blower fan 135 is rotating, the washing water flows linearly in a direction shown in FIG. 20 from the discharge opening 158 to the heater unit 132, so as to remove lint in and around the heater unit 132. In a status in which the blower fan 135 and the circulating pump 45 are simultaneously run, there occurs suction of the washing water from the drain hole 110 shown in FIG. 14, and flow of the washing water in vicinity of the discharge opening 158 is thereby curved, so that the fluff or fuzz in the vicinity of the discharge opening 158 is removed. That is, a region where fluff should be removed can be switched by the operation of the circulating pump 45.

Just before the termination of the washing process, the control unit 202 controls the motor 9 to rotate the rotary drum 5 for about 20 to 30 seconds in the reciprocal directions alternately at 65 rpm, which is a second rotation speed higher than the first rotation speed. The control unit 202 is an example of the operating speed control unit.

As described above, foreign matter having adhered onto the surface of the filter 160 is removed by the water flow produced by the rotation of the rotary drum 5 and of the blades 170 provided at the bottom thereof. Strength of the water flow that removes foreign matter on the surface of the filter 160 is influenced by the rotation speed of the rotary drum 5. The control unit 202 controls the rotation speed of the rotary drum 5 by control over the motor 9 and is thus capable of adjusting the strength of the water flow that removes foreign matter on the filter 160 and that is produced by the rotary drum 5 and by the blades 170 provided at the bottom thereof. That is, the capability for removing foreign matter from the filter 160 can be improved by the increase in the rotation speed of the rotary drum 5 from 50 rpm to 65 rpm.

With the rotation of the rotary drum 5 at 65 rpm just before the termination of the washing process, namely, strong water flow is produced in vicinity of the filter 160 by the rotary drum 5 and by the blades 170, and foreign matter that has not been removed and remains on the filter 160 is thereby removed. After the rotating operation at the second rotation speed for a specified period of time (20 to 30 seconds in the embodiment), the control unit 202 controls the drain motor 124 (see FIG. 14) to open the drain valve 25 and thus drains the washing water out of the water tank 4 through the drain duct 21. Herein, the drain motor 124, the drain valve 25, and the drain duct 21 are an example of the drain unit. In order to remove foreign matter (such as lint) from the filter 160, the control unit 202 may then rotate the rotary drum 5 in the reciprocal directions alternately at the speed as high as 65 rpm during the drain operation. When the direction of the rotation of the rotary drum 5 is switched during the drain operation, stop interval or intervals are inserted in which the rotary drum 5 is not rotated. The stop interval (a second stop interval, on order of 1 second) for the rotary drum 5 during the drain operation is set so as to be shorter than the stop interval (the first stop interval, on order of 2 to 4 seconds) on occasion when the rotary drum 5 is rotating at 50 rpm. That is, water level of the washing water in the water tank 4 continues to decrease during the stop interval in the switching of the direction of the rotation, and setting the stop interval short therefore causes the water flow to act as uniformly as possible on the front face of the filter 160 with short intermissions. The decrease in the water level in the stop interval may be prevented by control of shutting the drain valve 25 during the stop interval. Once the drainage of the washing water out of the water tank 4 through the drain duct 21 is completed, the washing process is terminated.

Upon the termination of the washing process, the rinsing process is subsequently carried out. In the rinsing process, the control unit 202 controls the motor 9 to rotate the rotary drum 5 in the reciprocal directions alternately at 50 rpm that is the first rotation speed, in a status in which washing water has been supplied into the water tank 4 in the same manner as in the washing process. When the direction of the rotation is switched, a stop interval (a first interval, on order of 2 to 4 seconds) is inserted in which the motor 9 is not driven. Such rotational drive continues ordinarily for 5 to 15 minutes, on basis of a quantity of wash contained in the rotary drum 5 or settings a user provides. Then the fan motor 136 may be controlled and driven in a manner similar to the washing process so that foreign matter such as lint or fuzz having adhered to the blower fan 135, the shaft 152, the drying channel and the like is washed away. Moreover, the circulating pump 45 may be activated in synchronization with the drive control over the fan motor 136.

Just before the termination of the rinsing process, the control unit 202 controls the motor 9 to rotate the rotary drum 5 for about 20 to 30 seconds in the reciprocal directions alternately at 65 rpm which is the second rotation speed higher than the first rotation speed.

After the rotation of the rotary drum at the second rotation speed for a specified period of time (20 to 30 seconds in the embodiment), the control unit 202 opens the drain valve 25 to drain the washing water out of the water tank 4. Then the drain operation may be carried out while the rotary drum 5 is rotated, in the same manner as in the washing process. The rinsing process is terminated after the rinsing operation proceeding from water feeding into the water tank, through the rotation control over the rotary drum, to the drainage out of the water tank is carried out one time or is repeated a plurality of times. The operation of the rotary drum 5 at 65 rpm may be performed just before the termination of either the washing process or the rinsing process or may be performed every time just before the termination of both the processes, as in the embodiment.

Upon the termination of the rinsing process, the dewatering process is subsequently carried out. In the dewatering process, the control unit 202 controls the motor 9 to subject the wash in the rotary drum 5 to centrifugal dewatering at a maximum number of revolutions of 1000 rpm. The dewatering operation is performed for a specified period of time, and the dewatering process is thereafter terminated. Upon completion of all of the washing process, the rinsing process, and the dewatering process, the control unit 202 terminates the "standard" course (step S5) and automatically turns off a power supply for the drum type washing and drying machine X (step S6).

The following will describe the control performed by the control unit 202 over the components on condition that the flow goes from the step S3 to a step S7.

In the step S7 and later, the control unit 202 performs processing in the drying process (step S9) in addition to the processes (the washing, rinsing and dewatering processes) in the "standard" course (step S7) as in the step S4. The step S7 and the step S8 are the same as the step S4 and the step S5, respectively, which have been described above. In the step S9 (drying process) following the step S8, the control unit 202 performs processing for drying the wash that has already been washed. The drying process has the same contents as have already been detailed in the description on the dryer system 106 (see FIG. 14). Just before the termination of the drying process, the control unit 202 detects whether the clogging of the filter 160 has occurred or not (step S10). Such clogging can be detected on basis of temperatures of dry air at some points in the drying channel, or the like.

If the clogging is not detected (NO in the step 10), the flow goes to the step S11, and the control unit 202 terminates the control concerning the drying process. Upon the termination of the step S11, the flow goes to a step S12. If the clogging is detected in the step S10 (YES in the step 10), on the other hand, the flow goes to a step S14.

In the step S12, the control unit 202 compares cumulative drying time (cumulative length of time in which the drying process has heretofore been performed) with a predetermined reference time. Such reference time has been stored in the storage unit that the control unit 202 has. If it is determined that the cumulative drying time is shorter than the reference time (NO in the step S12), the flow goes to a step S13 and the control unit 202 turns off the power supply to terminate the control. If the control unit 202 determines that the cumulative drying time is not shorter than the reference time (YES in the step S12), on the other hand, the flow goes to a step S14.

Provided that the clogging of the filter 160 is detected in the step S10 or provided that the cumulative drying time exceeds the reference time, there is a great possibility that an amount of air forwarded by the blower 131 has decreased, so that control should be carried out so as to eliminate the clogging of the filter 160. In the step S14 and later, the control unit 202 urges the user to effect the "filter wash" course so as to eliminate the clogging of the filter 160. In the step S14, namely, the control unit 202 flashes on and off a "tank wash" display lamp 203*b* provided in the operational input unit 201. At the same time, the timer display section 204 displays "0:20." In the embodiment, lighting of the "tank wash" display lamp 203*b* indicates that the "tank wash" course has been selected as the operation course. Though a display section designed exclusively for displaying that the "filter wash" course has been selected is not provided in the embodiment, the display section may be provided as necessary.

In the step S15 following S14, the control unit 202 stands by until the user carries out the confirm manipulation for the "filter wash" course (e.g., a pressing operation of the start key k4) through the operational input unit 201. If the confirm manipulation input is carried out, the control unit 202 performs the processing in the "filter wash" course.

Hereinbelow will be described the operation in the "tank wash" course and the "filter wash" course of the drum type washing and drying machine X of the second embodiment of the invention, with use of FIG. 26A through FIG. 26C.

The "tank wash" course is a course for washing inside of the water tank 4 and is a course in which the rotary drum 5 is rotated in the reciprocal directions alternately at 50 rpm, as shown in FIG. 26C, with a tank cleaner liquid present in the water tank 4. In the "tank wash" course also, the control unit 202 controls and drives the fan motor 136 to rotate the blower fan 135, in a manner similar to the washing process, so as to wash the blower fan 135, the shaft 152, the drying channel and the like. The control unit 202 activates the circulating pump 45 while the fan motor 136 is driven and rotated.

The "filter wash" course is a course for removing foreign matter that has adhered to the filter 160. In a status in which the water tank 4 is filled with washing water (or the tank cleaner liquid or the like), the control unit 202 controls the motor 9 to rotate the rotary drum 5, as shown in FIG. 26B, in the reciprocal directions alternately at a third rotation speed, e.g., of 100 rpm, higher than the first rotation speed or the rotation speed in the "tank wash" course of 50 rpm and higher than the second rotation speed of 65 rpm, for around 20 minutes (as long as the time displayed in the timer display section 204). Namely, the blades 170 provided at the bottom of the rotary drum 5 are then driven and rotated at a higher speed than when the control unit 202 (the operating speed control unit) rotates the rotary drum 5 at the first rotation speed (50 rpm in the embodiment) or at the second rotation speed (65 rpm in the embodiment), and performance for removing foreign matter from the filter 160 is extremely increased. The control unit 202 is an example of the high-speed operation control unit.

During such high-speed rotation at the third rotation speed, the control unit 202 periodically drives the blower fan 135 to rotate and activates the circulating pump 45, in a manner similar to that in the washing process and the rinsing process of the "standard" course. After the rotary drum 5 is rotated for about 15 to 20 minutes, the drain valve 25 is opened and the washing water is drained out of the water tank 4, then the "filter wash" course has been completed. The control unit 202 is an example of the blower fan control unit and the circulating pump control unit.

The drum type washing and drying machine X of the second embodiment of the invention, as described above, has an increased effect of washing away foreign matter adhering to the filter 160, which prevents intrusion of lint into the blower 131 in the "standard" course and other washing courses.

By input from the operational input unit 201 (input unit, an example of the control status switching unit), selective switching can be done among the "standard" course (the first control status under control of the operating speed control unit), the "tank wash" course, the "filter wash" course (the second control status under control of the high-speed operation control unit), and the like, and the "filter wash" course for washing the filter 160 can be carried out as necessary on condition that the clogging of the filter 160 or the like has occurred.

In addition, lint or the like having adhered to the blower fan 135, the shaft 152, and the drying channel can be removed by the operation of the blower fan 135 and of the circulating pump 45 with the water tank 4 filled with washing water.

Though the washing machine that automatically carries out the processes from washing to drying has been described as an example, it is needless to say that the invention can be applied, as a matter of course, to a so-called semiautomatic washing machine that manually carries out some part of the processes.

The second embodiment employs the filter 160 that is shaped like an arc positioned equally in general on left and right sides of the center of the washing machine, in order that a cycle of cleaning the filter 160 may be kept long by an increase in the area of the filter 160 on basis of the fact that foreign matter is accumulated locally on the filter 160 facing the blower fan 135 that is provided on one side, as described above. Provided that the clogging of the filter 160 intrinsically does not occur so frequently, accordingly, it is not necessary to ensure such a large filter area as described above and a right half or the like of the filter 160 in FIG. 17 can be configured as a wall surface including no filter, for example.

In the above second embodiment has been given the description of the example in which operational input from the operational input unit 201 (one example of the input unit) allows selective switching between the "standard" course (the first control status under control of the operating speed control unit) and the "filter wash" course (the second control status under control of the high-speed operation control unit); however, the invention is not limited thereto. That is, an arrangement is conceivable in which the control unit 202 automatically performs the shift from the "standard" course to the "filter wash" course on basis of a detection result such as clogging of the filter 160.

Third Embodiment

Figure 27:
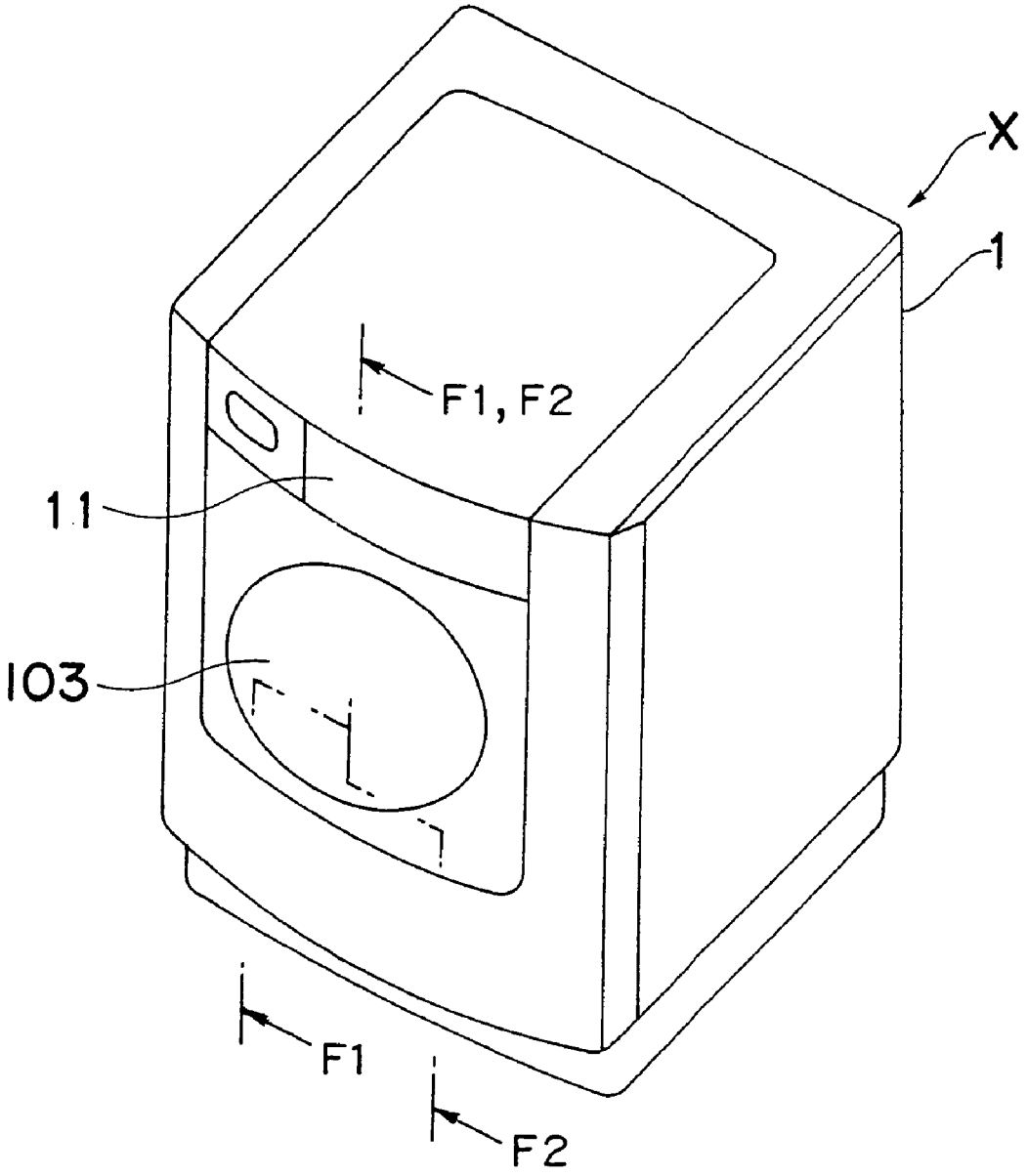
FIG. 27 is a sketch perspective of a drum type washing and drying machine according to a third embodiment of the invention.

FIG. 27 is a sketch perspective of a drum type washing and drying machine X according to a third embodiment of the invention. The drum type washing and drying machine X has an outer casing 1 which covers periphery thereof and which has an outer casing opening 111 (see FIG. 28), which will be described later, on a front face thereof, and a door 103 for opening/shutting the outer casing opening 111 is pivotably mounted on the outer casing 1 by a hinge mechanism. Reference numeral 11 in FIG. 27 denotes an operation panel.

Figure 28:
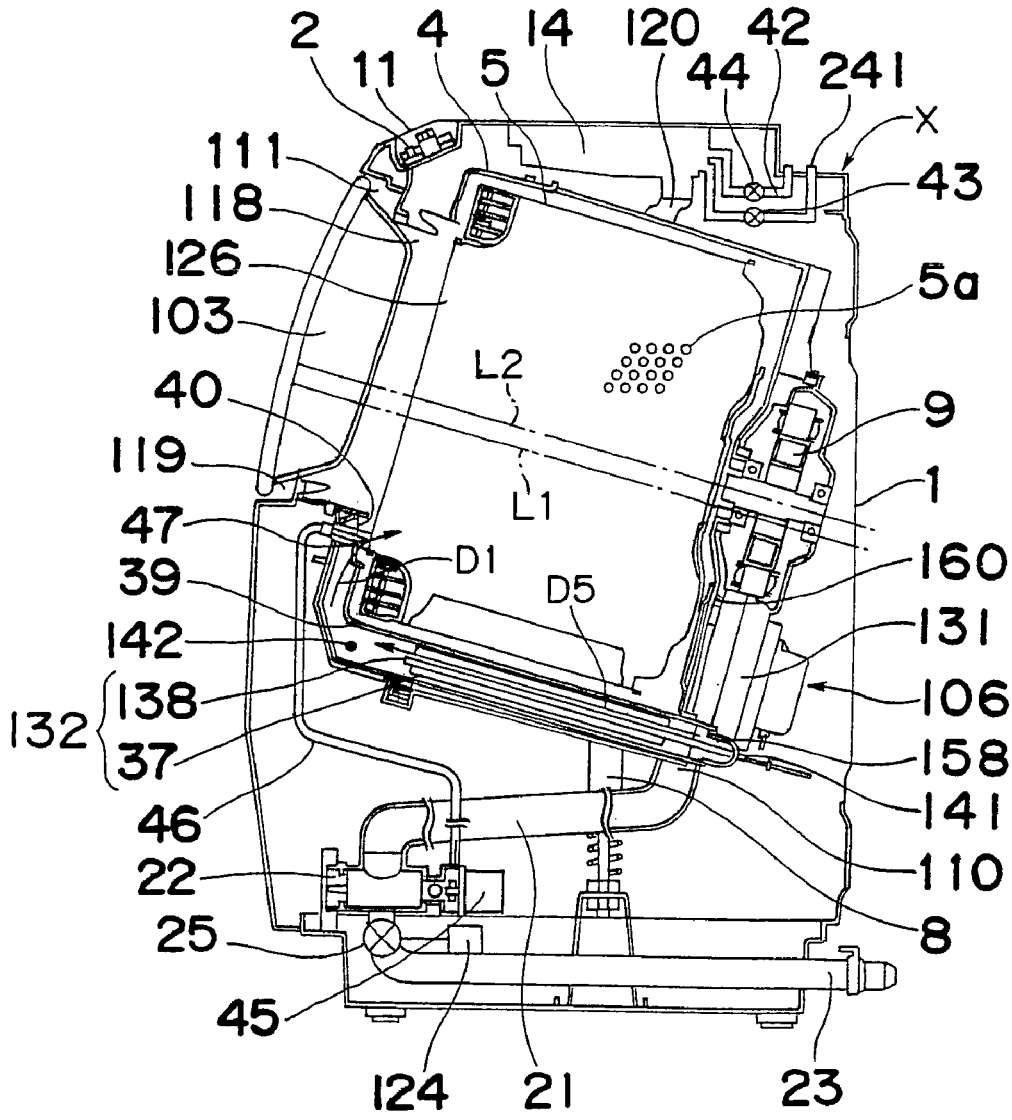
FIG. 28 is a section taken along line F1-F1 in FIG. 27.

FIG. 28 shows a schematic section taken along line F1-F1 in FIG. 27.

Formed on the front face of the outer casing 1 is the outer casing opening 111. The outer casing opening 111 is opened and shut by the door 103 that is pivotable with respect to the outer casing 1, as described above. An upper part of the front face of the outer casing 1 is provided with the operation panel 11 having operation keys, display units, and the like. A control unit 202 for controlling operation of the drum type washing and drying machine X is provided on the reverse side of the operation panel 11 (on a side of a water tank 4), and thus input into the operation panel 11 allows successive or separate performance of a washing process, a rinsing process, a dewatering process, and a drying process. The outer casing 1 elastically supports the water tank 4, which will be described later, through the medium of a suspension 8 as an example of an elastic support unit.

The outer casing 1 houses the water tank 4 having a shape of a bottomed cylinder with a water tank opening 118 that opens in face of the outer casing opening 111. The water tank 4 is positioned slantly so that the rear side of a central axis L1 passing through the centers of gravity in sections perpendicular to a cylinder axis of the water tank 4 is lowered.

The water tank 4 contains a rotary drum 5 having a shape of a bottomed cylinder with a drum opening 126 that opens in face of the water tank opening 118. The rotary drum 5 is connected to a motor 9 residing on backside of the rotary drum 5 and is supported so as to be rotatable in the water tank 4. The rotary drum 5 is positioned slantly so that the rear side of a central axis (rotation axis) L2 thereof is lowered. A plurality of small bores 5*a* are formed in the whole area of a circumferential wall of the rotary drum 5. The small bores 5*a* allow circulation of washing water, air, or the like between a space between the water tank 4 and the rotary drum 5 and a space in the rotary drum 5. The central axis L2 of the rotary drum 5 is positioned above the central axis L1 of the water tank 4.

In a lower part of a space in the water tank 4, there is placed a blower duct 39 through which warm air to be supplied into the rotary drum 5 flows. A front end of the blower duct 39 communicates with a blower port 40 positioned between a lower edge of the water tank opening 118 and a lower edge of the opening 126 of the rotary drum 5. Therefore, the air flowing through the blower duct 39 in a direction of an arrow D1 is forced to blow via the blower port 40 into the rotary drum 5. A rear end of the blower duct 39 is connected to a discharge opening 158 of a fan case 134 (see FIG. 30) that will be described later.

Inside the blower duct 39 is provided a heater unit 132, which is composed of a heater case 37 and a sheathed heater 138 of which major portion is housed in the heater case 37. The heater case 37 is composed of a main body made of metal and a frame for fixing the main body. The frame is made of heat resistant resin, and a front end of the frame is connected to the blower duct 39. The sheathed heater 138 is capable of heating air in the water tank 4, and is also capable of heating washing water in the water tank 4 because the heater is placed in an area to be soaked in the washing water in the water tank 4.

The front face of the water tank 4 is provided with the water tank opening 118 that faces the outer casing opening 111. A packing 119 composed of an elastic material such as rubber and soft resin is fixed at the water tank opening 118. When the door 103 is shut, in this arrangement, the door 103 is brought into intimate contact with the packing 119, so that liquid in the water tank 4 is prevented from leaking out of the water tank 4. To top of the water tank 4 is connected a lower end of a feed water duct 120 for feeding washing water into the water tank 4. On the other hand, an upper end of the feed water duct 120 is connected to a lower part of a detergent case 14. To the detergent case 14 are connected a tap water feeding channel 241 and a bath water feeding channel 42. A feed valve 43 is provided in the middle of the tap water feeding channel 241, and a bath water pump 44 is provided in the middle of the bath water feeding channel 42.

The water tank 4 is provided, at a lower part, with a drain hole 110 for draining washing water in the water tank 4. The drain hole 110 communicates with the blower duct 39. The drain hole 110 is positioned on downstream side of the blower 131. To the drain hole 110 is connected an upper end of a drain duct 21. A lower end of the drain duct 21 is connected through a filter unit 22 to a drain hose 23. Liquid flowing through the drain duct 21 passes through the filter unit 22 before flowing into the drain hose 23 or into a circulation hose 46. The filter unit 22 eliminates foreign matter such as lint from washing water having flowed through the drain duct 21, and thus prevents the foreign matter from entering the drain hose 23 or the circulation hose 46.

The drain hose 23 is provided with a drain valve 25 that is opened/shut by a drain motor 124. The drain valve 25 is controlled so as to be opened when washing water in the drain duct 21 is made to flow into the drain hose 23 and so as to be shut when washing water in the drain duct 21 is made to flow into the circulation hose 46. An upper end of the circulation hose 46 is connected to a circulation nozzle 47 that is positioned at a lower part of the front face of the water tank 4 and that is directed to inside of the rotary drum 5. On the other hand, a lower end of the circulation hose 46 is connected to a circulating pump 45 that is positioned behind the filter unit 22. The circulating pump 45 is operable to suck washing water in the drain duct 21, through the filter unit 22, and discharge the sucked washing water into the circulation hose 46. By activation of the circulating pump 45, washing water drained out of the water tank 4 through the drain hole 110 can be made to pass through the filter unit 22 and can thereafter be returned into the rotary drum 5. In the washing process and/or the rinsing process, washing water is kept clean by the removal of foreign matter while such circulation of the washing water is carried out.

A dryer system 106 is provided at an inlet to the drain hole 110 which communicates with the blower duct 39 to drain washing water from the water tank 4. The dryer system 106 has a blower 131 corresponding to the conventional blower 35, a heater unit 132 corresponding to the conventional heater 36, the blower duct 39, and a dehumidifying heat exchanger 133 (see FIG. 29 and FIG. 30) that will be described later. A filter 160 having metallic yarn woven reticularly is provided in a dehumidification channel 164 (see FIG. 29) between the dehumidifying heat exchanger 133 and the blower 131. The blower 131, the heater unit 132, the dehumidifying heat exchanger 133, the filter 160, and the blower duct 39 are positioned below a plane including the center line L1 of the water tank 4 and including a horizontal axis orthogonal to the center line L1. Thus such members as the units of the dryer system 106 and the filter 160 are cleaned by being soaked in washing water in the washing process or the rinsing process. The heater unit 132, the dehumidifying heat exchanger 133, the blower 131, and the filter 160 are one example of the heater unit, the dehumidification unit, the blower unit, and the filter unit, respectively.

Figure 29:
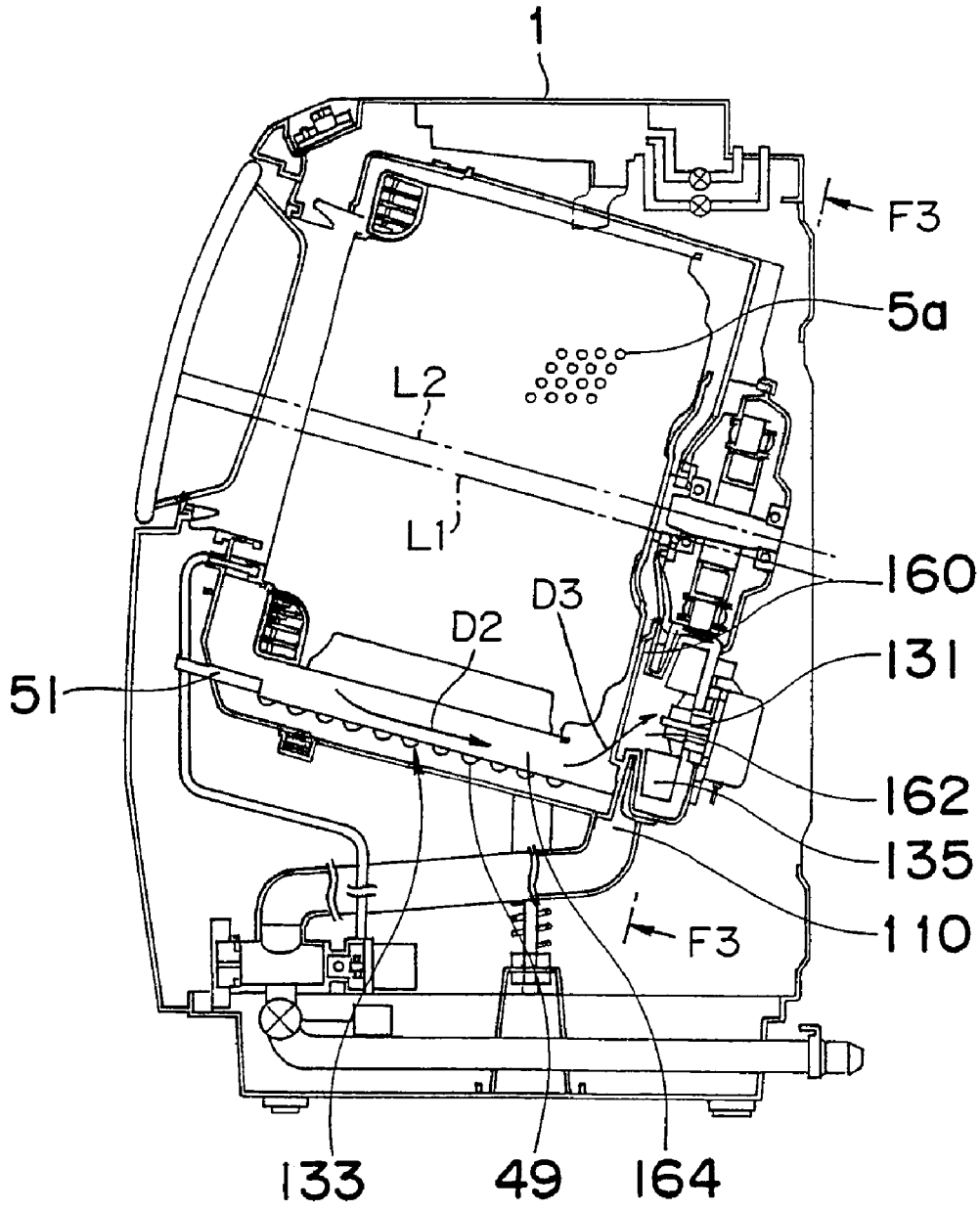
FIG. 29 is a section taken along line F2-F2 in FIG. 27.

FIG. 29 shows a schematic section taken along line F2-F2 in FIG. 27.

The dehumidifying heat exchanger 133 is connected upstream of the blower 131 mounted at a lower part of a rear face of the water tank 4. More particularly, the dehumidifying heat exchanger 133 is provided in a region that is between an inner circumferential surface of the water tank 4 and an outer circumferential surface of the rotary drum 5 and that is soaked in water in the washing process and the rinsing process. The dehumidifying heat exchanger 133 has a metal plate 49 that is positioned slantly so that the front side thereof is heightened, and fixation members 50 (see FIG. 30 and FIG. 31) that are made of stainless steel and that are installed on ends of the metal plate 49. A cooling nozzle 51 is provided above a front end of the metal plate 49. In the drying process, cooling water supplied from the cooling nozzle 51 flows over an upper surface of the metal plate 49 so as to cool the metal plate 49. In this manner, air is cooled by the cooling water and the cooled metal plate 49, and moisture that the air flowing there contains is thereby condensed effectively.

The blower 131 is mounted in a lower position of the rear face of the water tank 4. The blower 131 communicates with the water tank 4 via the inlet 162 and sucks in air in the water tank 4 with rotation of a blower fan 135. The inlet 162 is an example of a suction-side channel.

Figure 30:
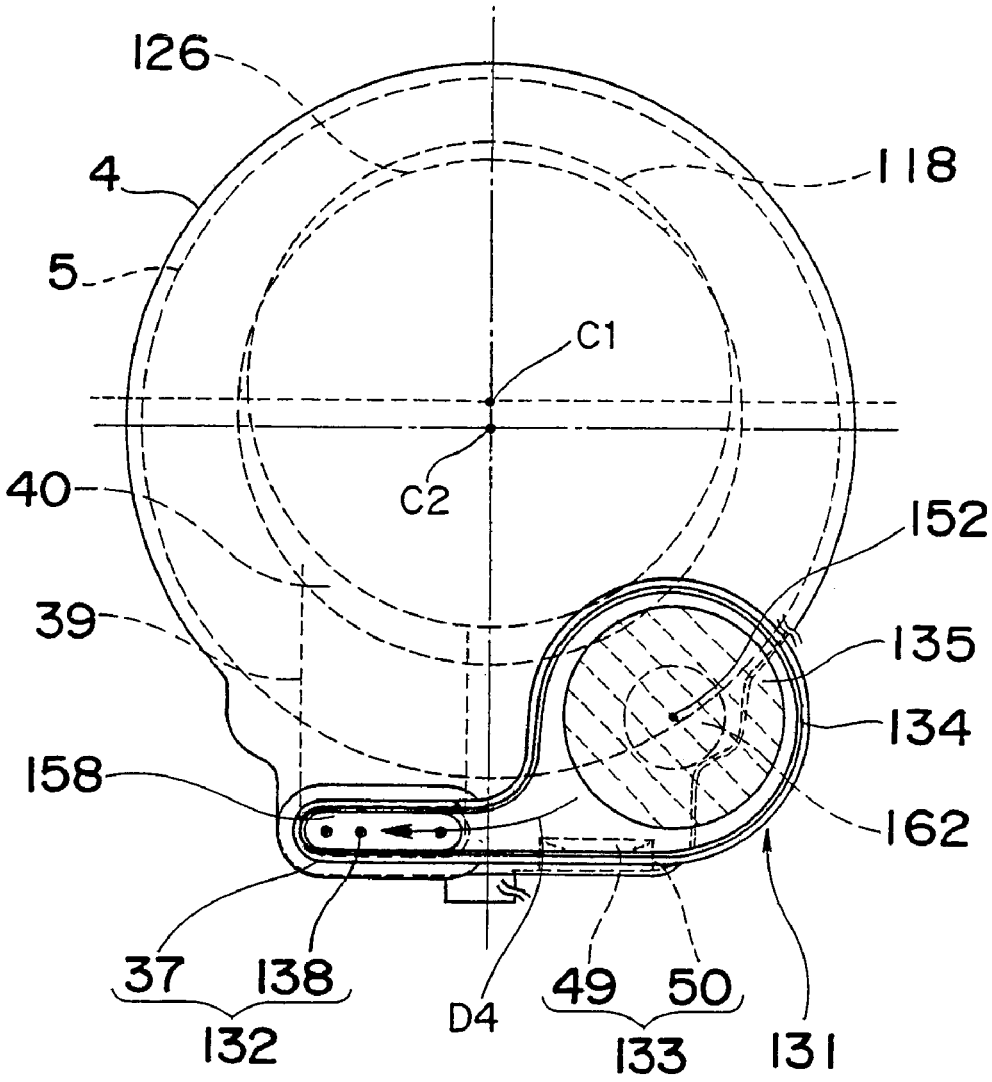
FIG. 30 is a section taken along line F3-F3 in FIG. 29.

FIG. 30 shows a schematic section taken along line F3-F3 in FIG. 29.

The water tank 4 has a shape protruding downward and the blower 131 is configured so as to fit the protruding shape. Periphery of the blower 131 is defined by a fan case 134, in which a blower fan 135 is contained. The fan case 134 extends horizontally across the protruding shape in the lower part of the water tank 4 and communicates with the heater unit 132 and the dehumidifying heat exchanger 133 provided in the lower part of the protruding shape, through the inlet 162 and the discharge opening 158, respectively.

A center C1 of the water tank opening 118 is nearer to a top face of the outer casing 1 than a center C2 of the drum opening 126 is. That is, the water tank opening 118 is shifted toward the top face of the outer casing 1 relative to the drum opening 126. Reference numeral 152 in FIG. 30 denotes a shaft, one end of which is connected to the blower fan 135.

Figure 31:
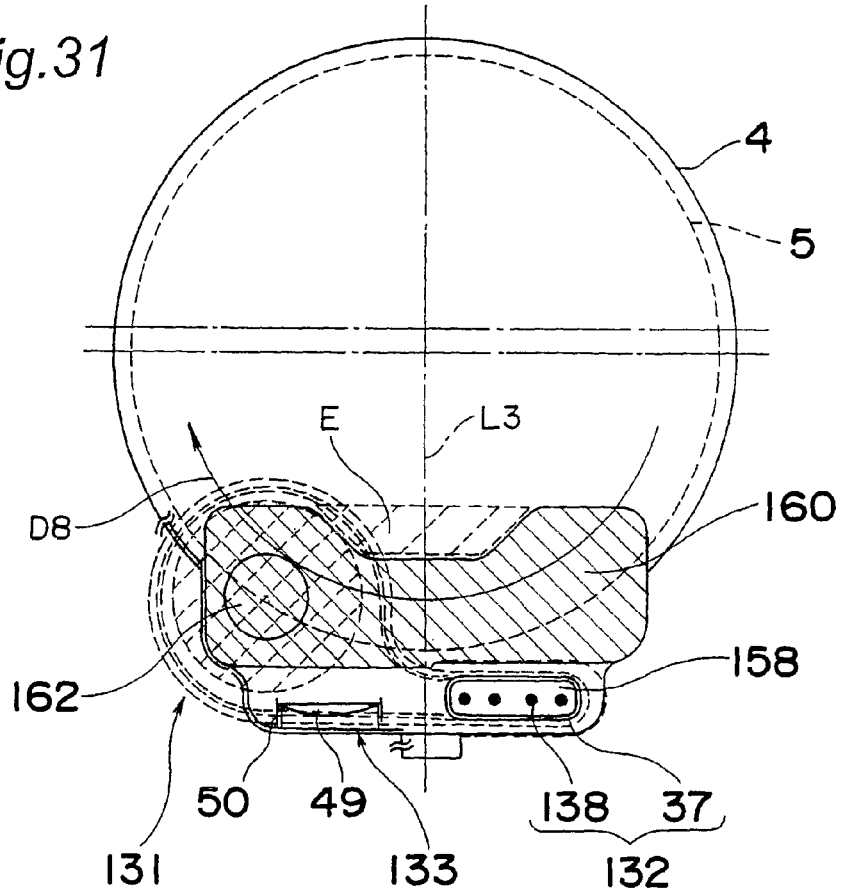
FIG. 31 is a schematic diagram of an inner bottom surface of a water tank of the drum type washing and drying machine according to the third embodiment of the invention.

FIG. 31 shows a schematic diagram of a bottom part of the water tank as seen from the front side.

Inside the lower part of the protruding shape of the water tank 4, the heater unit 132 is positioned on the right side, and the dehumidifying heat exchanger 133 is positioned on the left side. The heater unit 132 and the dehumidifying heat exchanger 133 are positioned so as to be parallel to the central axis L1 of the water tank 4 and, as will be described later, and the dehumidifying heat exchanger 133 and the heater unit 132 are located on upstream side and downstream side, respectively, with respect to circulating air, with the blower 131 therebetween.

Figure 34:
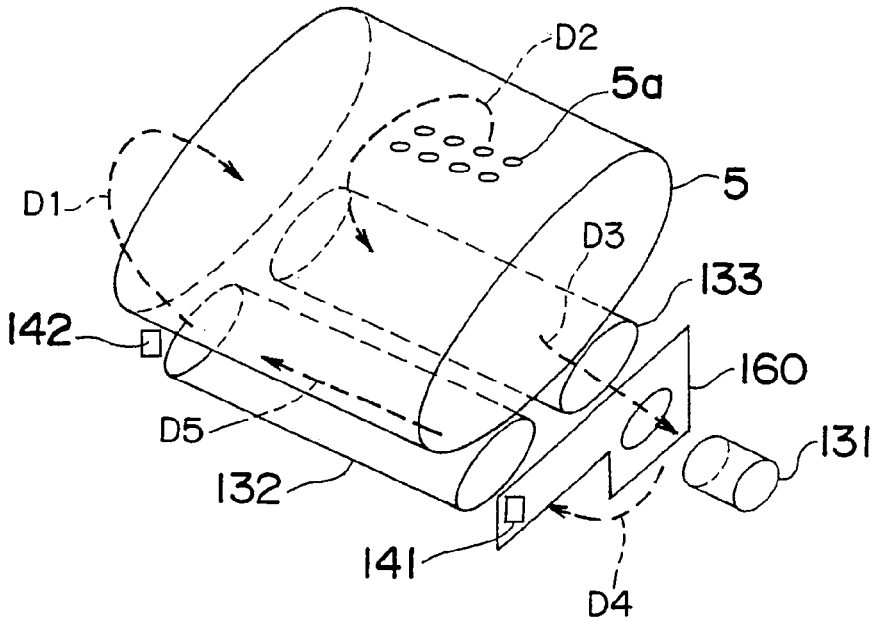
FIG. 34 is a schematic diagram showing a circulation circuit of air in the drying process.

In the drying process, as shown in FIGS. 28 through 30, air forwarded by the blower 131 is heated while passing through the heater unit 132 as shown by an arrow D5 (see FIG. 28) and is thereafter forced to blow from the water tank opening 118 into the rotary drum 5 as shown by an arrow D1 (see FIG. 28). The air, which has moisture vaporized from wet wash in the rotary drum 5 to become highly humid, flows out, through the small bores 5*a* in a circumferential surface of the rotary drum 5, into the space between the inner peripheral surface of the water tank 4 and the outer peripheral surface of the rotary drum 5 and further flows along the dehumidifying heat exchanger 133 as shown by an arrow D2 (see FIG. 29). The air having got highly humid is cooled and dehumidified by the dehumidifying heat exchanger 133 and the cooling water. The dehumidified air undergoes repetition of a cycle in which the dehumidified air enters through the inlet 162 into the blower 131 as shown by an arrow D3 (see FIG. 29), and is fed from the discharge opening 158 into the heater unit 132 as shown by an arrow D4 (see FIG. 30). The process of drying the wash advances in this way. FIG. 34 schematically shows the flow of air in the drying process described above.

In the drying process, a wash is thus dried with the air in the water tank 4 sequentially passed and circulated through the dehumidifying heat exchanger 133, the blower 131, and the heater unit 132. In this process, minute dust such as cotton waste from the wash enters the fan case 134 and adheres to inside an inner wall of the fan case 134, one end of the shaft 152 or the blower fan 135; in the next washing process or the next rinsing process, however, the inside of the fan case 134, the one end of the shaft 152 or the blower fan 135 are soaked in washing water having flowed into the fan case 134, and the dust such as cotton waste is therefore washed away and removed by the washing water. This prevents constriction of the air channel in the fan case 134 and an increase in resistance against the rotation of the blower fan 135, and allows constant, efficient circulation of air for drying a wash.

Figure 32:
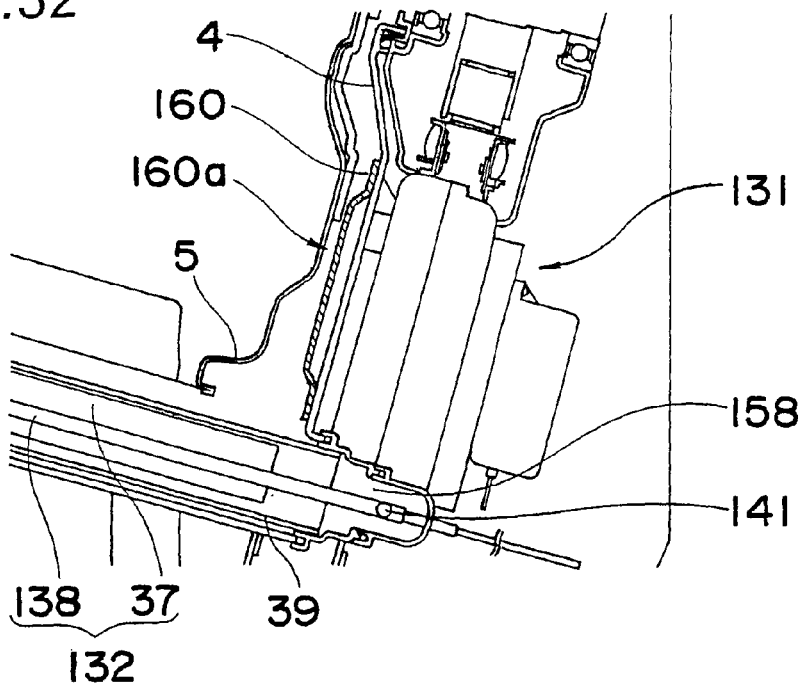
FIG. 32 is a detail of surroundings of a filter in FIG. 30.

FIG. 32 shows details of surroundings of the filter 160 in FIG. 28.

The blower 131 is mounted to the lower part of the rear face of the water tank 4. The blower 131 is connected to the water tank 4 through the discharge opening 158 that is an outlet of blast from the blower 131, and the discharge opening 158 is connected to the blower duct 39.

Figure 33:
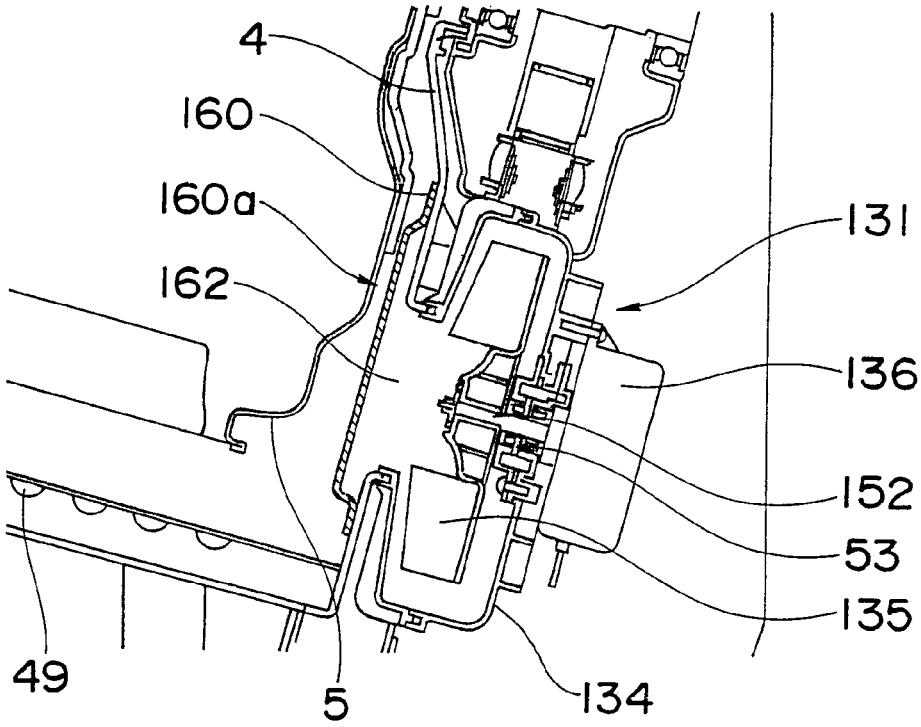
FIG. 33 is a detail of surroundings of a filter in FIG. 31.

FIG. 33 shows detail of surroundings of the filter 160 in FIG. 29.

The blower 131 has the fan case 134, the blower fan 135 that is positioned so as to be rotatable in the fan case 134, a fan motor 136 that drives the blower fan 135 to rotate, the shaft 152 that has one end connected to the blower fan 135 and the other end connected to the fan motor 136, and a seal receiving part 53 that is provided so as to radially surround the shaft 152. The shaft 152 receives a rotational driving force from the fan motor 136 and thus rotates with the blower fan 135. As described above, the one end of the shaft 152 is positioned so as to be soaked in washing water that flows into the fan case 134 in the washing process or the rinsing process. The blower fan 135, which makes air blow against the wash in the drying process, can be controlled so as to rotate also in the washing process and/or the rinsing process to produce water flow.

The blower 131 is also connected to the water tank 4 through the inlet 162 that is an entrance for blast of the blower 131. The filter 160 having metallic yarn woven reticularly is provided in a space between the inlet 162 and the metal plate 49, and is fixed so as to cover the inlet 162 in order that air in the water tank 4 may not pass through the inlet 162 without passage through the filter 160.

The filter 160 is provided inside and on a bottom face of the water tank 4, as shown in FIG. 31, is generally shaped like an arc in left-right symmetry about a center line L3 of the drum type washing and drying machine X, in plan view as viewed from inside of the water tank 4, and faces the inlet 162 (see FIG. 29) from the water tank on left side of FIG. 31. As shown in FIG. 30, the blower fan 135 is provided so as to face the inlet 162. FIG. 31 shows the dehumidifying heat exchanger 133 provided on the channel to the inlet 162.

As a result, air (washing water) having flowed in a direction perpendicular to the paper sheet of FIG. 31 through the dehumidification channel 164 (see FIG. 29) to the inlet 162 flows through the filter 160 into the blower 131. In the washing process and the rinsing process, washing water flows in the water tank 4 and the blower 131 and foreign matter as lint contained in the washing water is thus collected by passage of the washing water through the filter 160, so that the foreign matter is prevented from intruding into the blower 131. The foreign matter collected by the filter 160 is removed from a surface of the filter 160 by water flow produced by rotation of the rotary drum 5, and clogging of the filter 160 is accordingly eliminated. The inner circumferential surface of the water tank is shaped like a gentle arc and extends along directions of the rotation of the rotary drum, and foreign matter such as lint having sunk to the bottom of the water tank is therefore shaken in the directions of the rotation by the water flow produced by the rotation of the rotary drum; however, the filter 160 provided on the bottom face of the water tank 4 is resistant to readhesion of foreign matter to the filter 160. In the drying process, air flows through the water tank 4 and the blower 131, and foreign matter contained in the air is thus collected with passage of the air through the filter 160, so that the foreign matter is prevented from intruding into the blower 131.

In order to merely collect foreign matter such as lint in washing water or air that is circulated by the blower 131 as described above, the filter 160 has only to cover an area on which the suction force of the blower fan 135 acts, that is, a part that faces the inlet 162 and that is shown on the lower left side of the water tank 4 in FIG. 31. The lint conveyed by the washing water or air in the actual washing process, rinsing process or drying process, however, is accumulated on the filter 160 in a long span and, sooner or later, a large volume of lint accumulated on the filter 160 facing the inlet 162 will cause a decrease in suction efficiency.

In the third embodiment, therefore, the filter 160 is not only provided on the part on which the suction force of the blower fan 135 directly acts and which faces the inlet 162 on the lower left side of the water tank 4 in FIG. 31 but is extended to a right side part which does not face the blower 131. That is, the filter 160 is positioned over an area larger than an opening area of the inlet 162, as viewed in the direction of the central axis L1 of the water tank 4. In such a configuration, the lint initially adheres only onto the area facing the inlet 162 of the blower 131 and, with prolongation of operating time, a suction force in the part to which the lint has adhered decreases. Accordingly, lint does not further adhere to the part where the suction force is nullified, but shifts to a part where lint has not adhered yet, so that the area onto which lint adheres gradually expands and so that the adhesion of the lint is concentrated on the left side in FIG. 31, in the course of time.

In the third embodiment in which the filter 160 is extended to the right side part in FIG. 31 as described above, the right side part where lint has not adhered can be used as a filter, and a filtering effect can be maintained for an extremely long term even if the suction force in the left side part in FIG. 31 is decreased with the prolonged operating time.

The filter 160 used in the drum type washing and drying machine X according to the third embodiment is not shaped like a simple flat plate but includes a swelling part 160*a* that swells toward the water tank 4, i.e., in the direction of the metal plate 49 constituting the dehumidifying heat exchanger 133, as clearly shown in FIG. 32 and FIG. 33. Such slight swelling in the direction of the water tank 4 forms a blast channel between the bottom surface of the water tank 4 and the filter 160 and thereby ensures a long-term availability of the filter 160.

Though the filter 160 may be of a plastic molding or a metal plate from which small bores have been punched out, instead of metallic yarn woven reticularly, such a molded or punched article, in practice, may have burrs and return scrap around the filter bores, on which lint, fuzz or the like may be hooked, resulting in a cause of clogging of the small bores. Therefore, the filter 160 is desirably composed of a net structure having wires woven reticularly. Such a net structure is not only free from above-mentioned worry of burrs and return scrap but allows an increase in ratio of small-bore area to plate surface area (i.e., aperture ratio), resulting in excellent capability as a foreign matter collecting unit.

As the wires constituting the filter 160, resin wires and the like are conceivable other than metal wires; however, metal wires are preferable because metal wires have smooth surfaces and resist catching lint, pieces of thread and the like. To fix crossings of meshes of the wires, e.g., by resin coating of metallic yarn woven reticularly, prevents occurrence of problems such as variation in size of openings of the meshes that may be caused by foreign matter caught between the crossed wires, shift of the crossings or the like.

In this arrangement, the opening size of the meshes of the filter 160 may be between 1 mm and 3 mm. With this configuration, comparatively large foreign matter, such as lint and pieces of thread in washing water, is collected which is prone to be twisted around the shaft linking the blower fan to the fan motor and which greatly influences the blowing capacity of the blower unit. Early clogging of the filter 160, which may be caused by comparatively small foreign matter such as fluff, is therefore prevented.

In the drum type washing and drying machine X according to the third embodiment, the blower fan 135, sheathed heater 138 and the metal plate 49 are soaked in water during the washing process and the rinsing process, so that the lint or the like adhering to these parts are removed therefrom by water for washing and rinsing water. The blower unit, the heater unit, and the dehumidifying unit may be placed in upper positions as necessary such that those units are prevented from getting wet with water.

The provision of such a filter 160 avoids problems including twining of foreign matter such as lint and fluff around the blower fan 135 or the shaft 152 thereof. Additionally, as described above, the filter 160 covers a wide area that extends not only over the part which faces the inlet 162 and on which the suction force of the blower fan 135 directly acts but also to the parts distant from the blower fan 135, so that the suction force of the blower fan 135 can be kept strong for a long period.

Though the clogging of the filter 160 in the third embodiment is automatically eliminated by water flow produced by the rotation of the rotary drum 5 in the washing process and the rinsing process, blades 170 that facilitate producing water flow for cleaning surfaces of the filter 160 with the rotation of the rotary drum 5 are further provided on a back face of the rotary drum 5 facing the water tank 4, in order to eliminate the clogging of the filter 160 more reliably. Herein, the blades 170 are an example of the cleaning unit.

As shown in FIG. 28, the drum type washing and drying machine X has a thermistor 141 placed in vicinity of the discharge opening 158 that is an air outlet of the blower 131 and a thermistor 142 placed in vicinity of the blower port 40 of the blower duct 39. The thermistor 141 and the thermistor 142 are an example of the inflow air temperature detector and an example of the outflow air temperature detector, respectively.

In the drum type washing and drying machine X in the drying process, the thermistor 141 and the thermistor 142 are controlled by the control unit 2 so that temperatures of air passing through given positions are detected and inputted into the control unit 2. The temperature detection by the thermistor 141 and the thermistor 142 is carried out only in the drying process, from the viewpoint of electric power saving.

Figure 35:
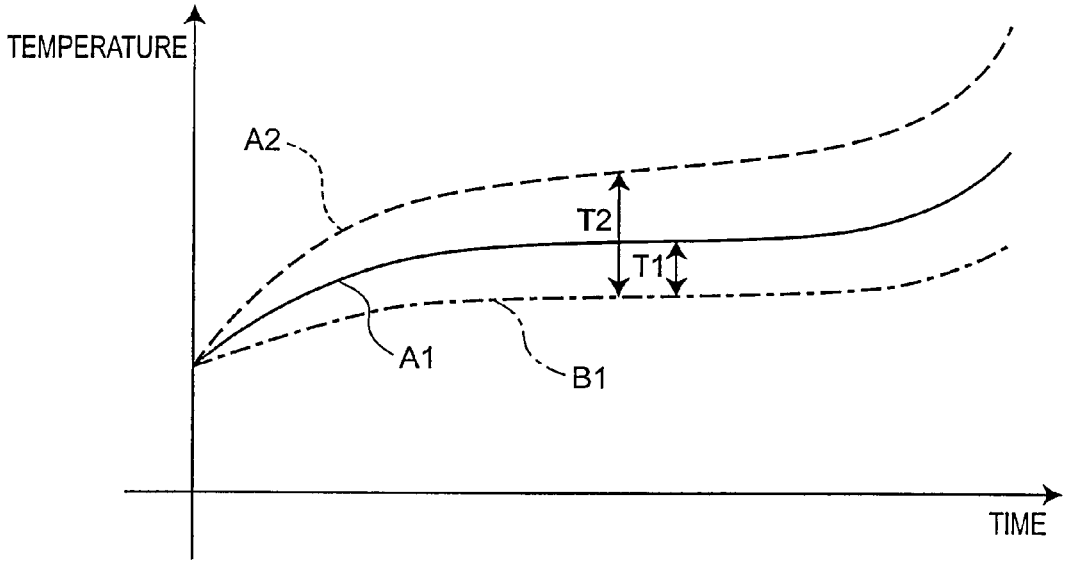
FIG. 35 is a graph showing transition of temperatures detected by thermistors.

FIG. 35 is a graph showing transition of the temperatures detected by the thermistor 141 and the thermistor 142. Herein, the transition of the temperatures detected by the thermistor 141 and the thermistor 142 will be described with use of FIG. 35. In FIG. 35, reference character A1 denotes the temperatures detected by the thermistor 142 under condition that the clogging of the filter 160 has not occurred, A2 denotes the temperatures detected by the thermistor 142 under condition that the clogging of the filter 160 has occurred, and B1 denotes the temperatures detected by the thermistor 141.

When clogging has occurred in the filter 160, a volume of air that is supplied by the blower fan 135 to the heater unit 132 in the drying process is decreased, so that air passing through the heater unit 132 is heated for a longer period of time than in normal condition. Accordingly, as shown by the graph of FIG. 35, an increase rate of the temperature A2 detected by the thermistor 142 under the condition that clogging has occurred in the filter 160 is larger than an increase rate of the temperature A1 detected by the thermistor 142 under the condition that clogging has not occurred in the filter 160. In the drum type washing and drying machine X, the increase rate of the temperature detected by the thermistor 142 under the condition that clogging has occurred in the filter 160 (which will be referred to as an upper limit increase rate, hereinbelow) has been stored in advance in a storage unit (not shown) provided in the control unit 2. The upper limit increase rate may be changeable arbitrarily by manipulation of the operation panel 11. In clogging detection processings that will be described later (see a flow chart in FIG. 36), the upper limit increase rate is used as an index for detection of occurrence of clogging in the filter 160.

Next, relations between the temperatures A1, A2 detected by the thermistor 142 and the temperatures B1 detected by the thermistor 141 will be described with use of FIG. 35.

As shown in FIG. 35, a difference between the temperature A1 detected by the thermistor 142 under the condition that clogging has not occurred in the filter 160 and the temperature B1 detected by the thermistor 141 changes within a range not exceeding a temperature difference T1. On the other hand, a difference between the temperature A2 detected by the thermistor 142 under the condition that clogging has occurred in the filter 160 and the temperature B1 detected by the thermistor 141 reaches a temperature difference T2 not smaller than the temperature difference T1. In the drum type washing and drying machine X, a difference between the temperatures detected by the thermistor 141 and the thermistor 142 under the condition that clogging has occurred in the filter 160 (e.g., the temperature difference T2, which will be referred to as an upper limit temperature difference, hereinbelow) has been stored in advance in the storage unit (not shown) provided in the control unit 2. The upper limit temperature difference may be changeable arbitrarily by manipulation of the operation panel 11. In clogging detection processings that will be described later (see a flow chart of FIG. 37), the upper limit temperature difference is used as an index for detection of occurrence of clogging in the filter 160.

In the drum type washing and drying machine X according to the embodiment of the invention, occurrence of clogging in the filter 160 is automatically detected by the clogging detection processings that are performed by the control unit 2 and that will be described later.

(1) FIRST EXAMPLE OF CLOGGING DETECTION PROCEDURES

Figure 36:
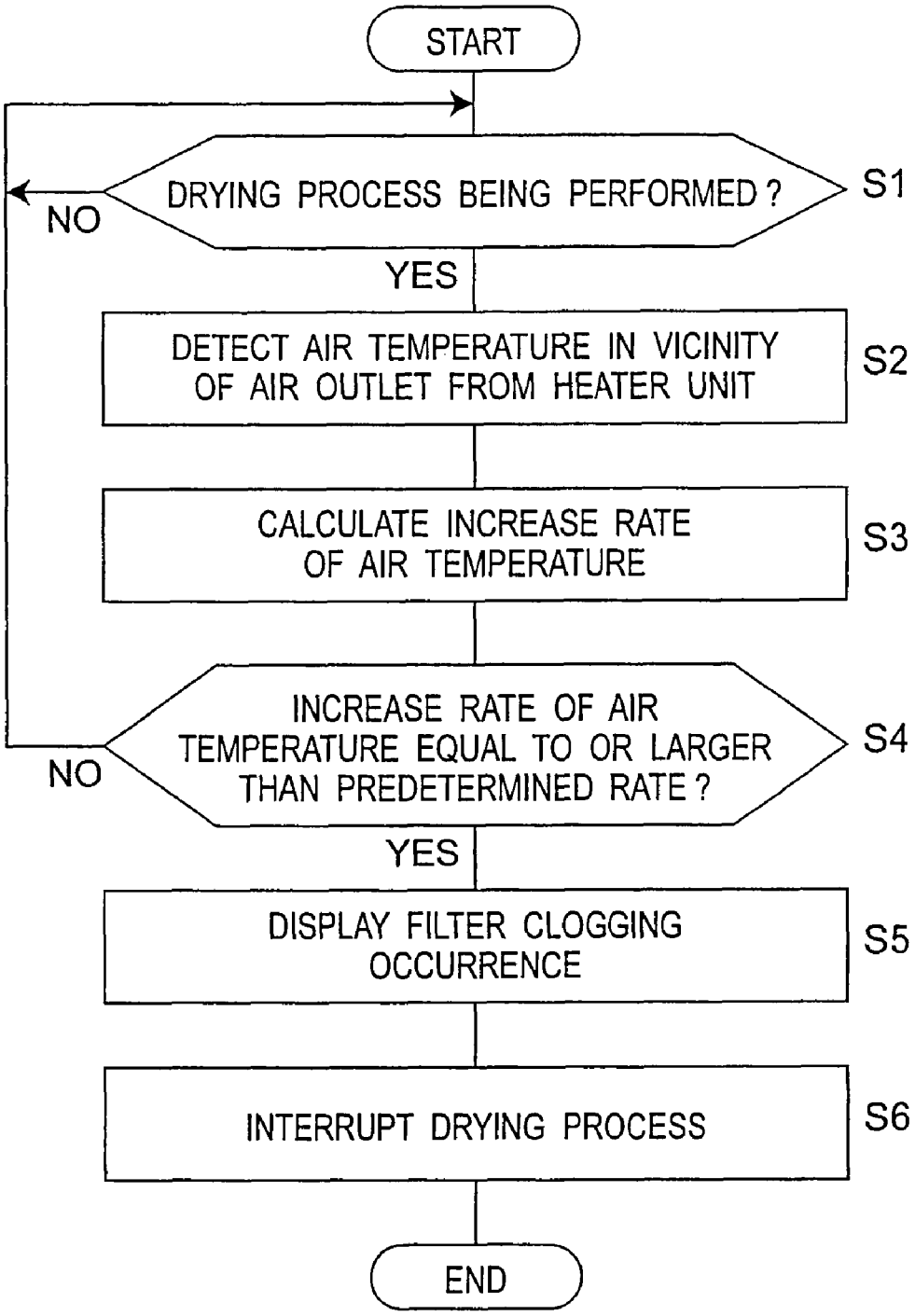
FIG. 36 is a flow chart of a first example of procedures for clogging detection performed in the drum type washing and drying machine according to the third embodiment of the invention.

In accordance with the flow chart of FIG. 36, initially, there will be described a first example of the clogging detection procedures that are performed by the control unit 2. Reference characters S1, S2, . . . in the drawing represent procedural step numbers.

In a step S1, the control unit 2 determines whether the drying process is being carried out or not in the drum type washing and drying machine X. If it is determined that the drying process is being carried out (YES in S1), the processing goes to a step S2. In the step S2, a temperature in the vicinity of the outlet of air from the heater unit 132 is detected by the thermistor 142. If, on the other hand, it is determined that the drying process is not being carried out (No in S1), the processing involves repeated performance of the step S1. That is, the thermistor 142 is controlled by the control unit 2 so as to detect the temperature in the vicinity of the outlet of air from the heater unit 132 only during the performance of the drying process, and such control is desirable in terms of electric power saving.

In a subsequent step S3, an increase rate of the air temperature detected by the thermistor 142 is calculated by the control unit 2. In a step S4, the control unit 2 determines whether the increase rate calculated in the step S3 equals or exceeds the upper limit increase rate stored in the storage unit in the control unit 2 or not. If the increase rate calculated in the step S3 equals or exceeds the upper limit increase rate (YES in S4), the control unit 2 determines that clogging has occurred in the filter 160 and the processing goes to a step S5. That is, the control unit 2 detects occurrence of clogging in the filter 160 as the increase rate calculated in the step S3 equals or exceeds the upper limit increase rate. The control unit 2 is an example of the clogging detection unit. It is determined that clogging has not occurred in the filter 160 and the processings in the steps S1 through S4 are repetitively carried out while it continues to be determined that the increase rate calculated in the step S3 is smaller than the upper limit increase rate stored in the storage unit in the control unit 2 (NO in S4).

In the subsequent step S5, the control unit 2 controls the operation panel 11 to indicate by sound, letters, light or the like that clogging has occurred in the filter 160. For example, a filter wash alarm lamp provided in the display units of the operation panel 11 is lighted or flashed on and off. Herein, the operational panel 11 is an example of the indication unit. This step allows a user to easily recognize occurrence of clogging in the filter 160 and necessity of cleaning the filter 160.

In a step S6, the control unit 2 interrupts the drying process in the drum type washing and drying machine X. The control unit 2 is an example of the drying process interruption processing unit. This step prevents overheating of air in the drum type washing and drying machine X and thus protects a wash being damaged. The interruption of the drying process may be automatically performed by the control unit 2. Alternatively, a user may be allowed to make selection of continuation or discontinuation of the drying process.

(2) SECOND EXAMPLE OF CLOGGING DETECTION PROCEDURES

Figure 37:
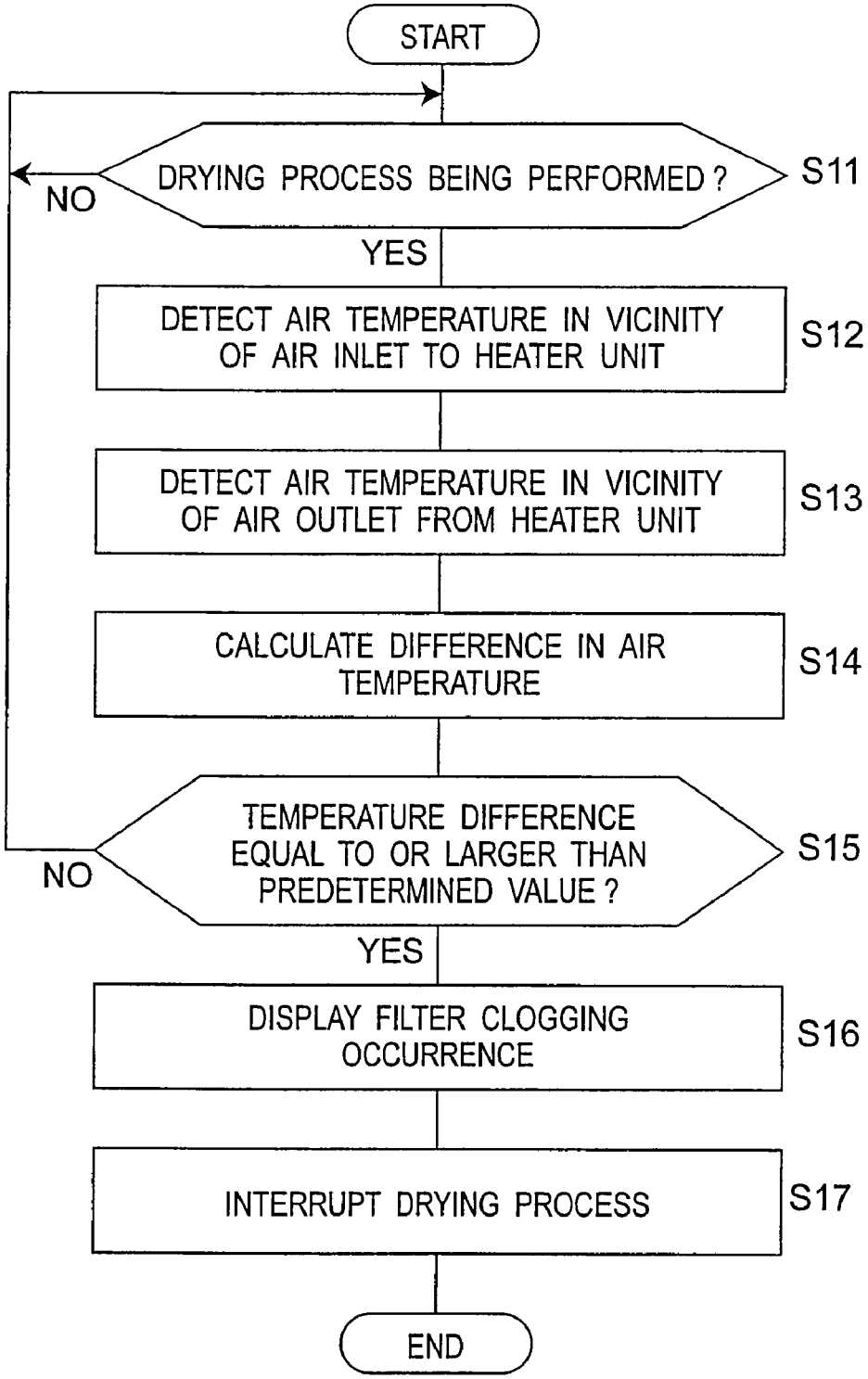
FIG. 37 is a flow chart of a second example of the procedures for clogging detection performed in the drum type washing and drying machine according to the third embodiment of the invention.

Referring to the flow chart of FIG. 37, there will be described a second example of the clogging detection processings that are performed by the control unit 2. Reference characters S11, S12, . . . in the drawing represent procedural step numbers. In a step S11, initially, the control unit 2 determines whether the drying process is being carried out or not in the drum type washing and drying machine X. If it is determined that the drying process is being carried out (YES in S11), the processing goes to a step S12. In the step S12, a temperature in the vicinity of the inlet of air to the heater unit 132 is detected by the thermistor 141 and, in a subsequent step S13, a temperature in the vicinity of the outlet of air from the heater unit 132 is detected by the thermistor 142. If it is determined that the drying process is not being carried out (No in S11), on the other hand, the processing involves repeated performance of the step S11. That is, the thermistor 141 and the thermistor 142 are controlled by the control unit 2 so as to detect the temperature in the vicinity of the inlet of air to the heater unit 132 and the temperature in the vicinity of the outlet of air from the heater unit 132 only during the performance of the drying process, and such control is desirable in terms of electric power saving.

Subsequently, in a step S14, a difference between the air temperatures detected by the thermistor 141 and the thermistor 142 is calculated by the control unit 2.

In a step S15, the control unit 2 determines whether the temperature difference calculated in the step S14 equals or exceeds the upper limit temperature difference stored in the storage unit in the control unit 2 or not. If the temperature difference calculated in the step S14 equals or exceeds the upper limit temperature difference (YES in S15), the control unit 2 determines that clogging has occurred in the filter 160 and the processing goes to a step S16. That is, the control unit 2 detects occurrence of clogging in the filter 160 as the temperature difference calculated in the step S14 equals or exceeds the upper limit temperature difference. Herein, the control unit 2 is an example of the clogging detection unit. While it is determined that the temperature difference calculated in the step S14 is smaller than the upper limit temperature difference stored in the storage unit in the control unit 2 (NO in S15), it is determined that clogging has not occurred in the filter 160 and the processings in the steps S11 through S15 are repetitively carried out.

In the subsequent step S16, the control unit 2 controls the operation panel 11 to indicate by sound, letters, light or the like that clogging has occurred in the filter 160. For example, the filter wash alarm lamp provided in the display units of the operation panel 11 is lighted or flashed on and off. Herein, the operational panel 11 is an example of the indication unit. This step allows a user to easily recognize occurrence of clogging in the filter 160 and necessity of cleaning the filter 160. In a step S17, the control unit 2 interrupts the drying process in the drum type washing and drying machine X. Herein, the control unit 2 is an example of the drying process interruption processing unit. This step prevents overheating of air in the drum type washing and drying machine X and thus protects a wash being damaged. Though it does not matter if the interruption of the drying process is automatically performed by the control unit 2, a user may be requested to make selection of continuation or interruption of the drying process.

(3) THIRD EXAMPLE OF CLOGGING DETECTION PROCEDURES

Figure 38:
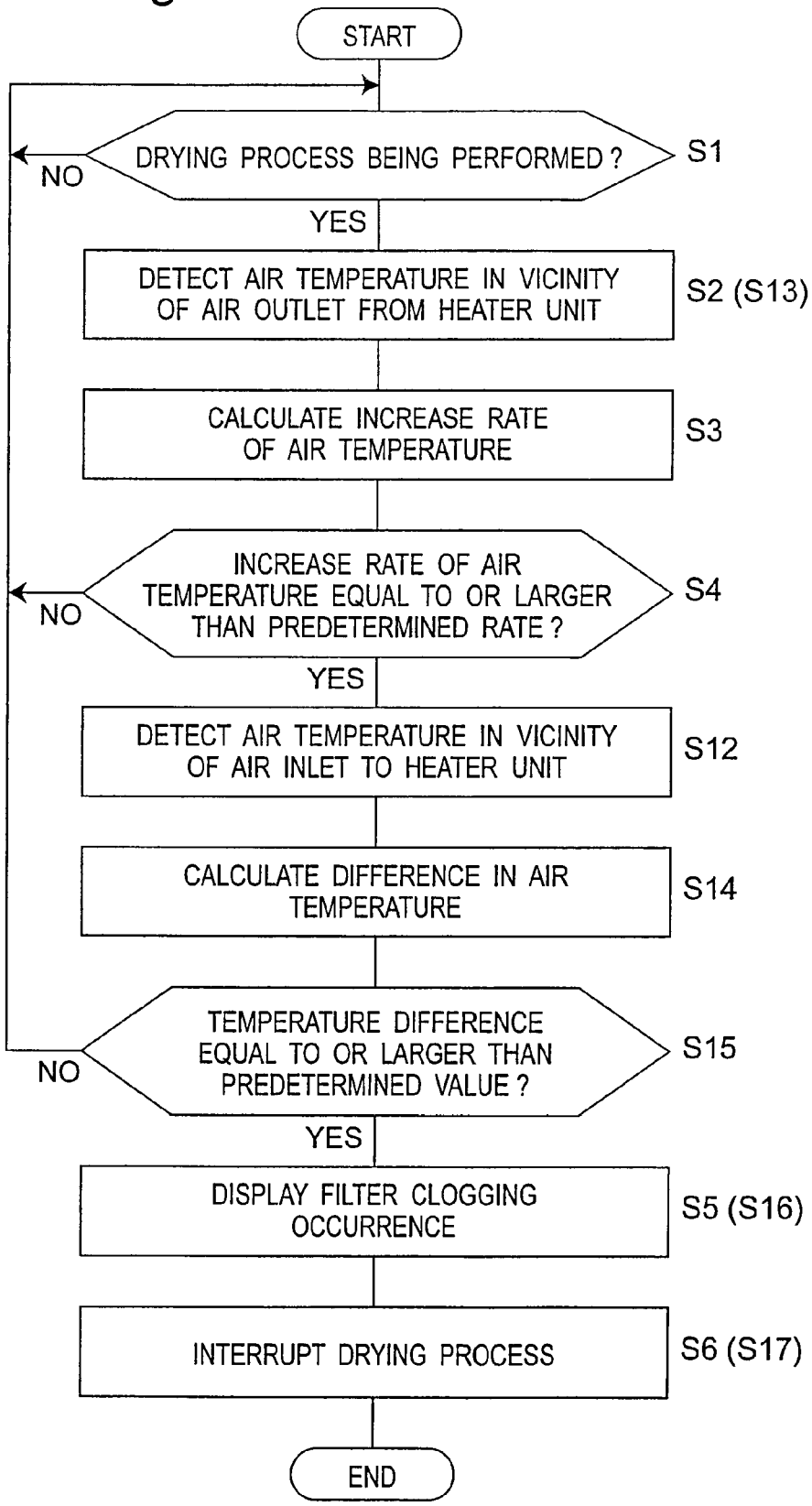
FIG. 38 is a flow chart of a third example of the procedures for clogging detection performed in the drum type washing and drying machine according to the third embodiment of the invention.

Referring to a flow chart of FIG. 38, there will be described a third example of the clogging detection procedures that are performed by the control unit 2. Processings in FIG. 38 similar to those in the flow charts of FIG. 36 and FIG. 37 are given the same procedural step numbers, and description thereof is omitted. In the clogging detection processings, as shown in FIG. 38, it is determined whether or not the air temperature increase rate detected by the thermistor 142 equals or exceeds the upper limit increase rate stored in the storage unit in the control unit 2 (S4) and, if the increase rate equals or exceeds the upper limit increase rate (YES is S4), the control unit 2 determines whether a difference between an air temperature detected by the thermistor 141 and an air temperature detected by the thermistor 142 equals or exceeds the upper limit temperature difference stored in the storage unit in the control unit 2 or not (S15). That is, the control unit 2 detects occurrence of clogging in the filter 160 only when the air temperature increase rate detected by the thermistor 142 equals or exceeds the upper limit increase rate and when the difference between the air temperature detected by the thermistor 141 and the air temperature detected by the thermistor 142 equals or exceeds the upper limit temperature difference, and reliability of the detection result is thereby increased.

(4) FOURTH EXAMPLE OF CLOGGING DETECTION PROCEDURES

Next will be described a fourth example of procedures for detecting clogging in the filter 160 on the basis of frequency of performance of the drying process. In the drum type washing and drying machine X, the frequency of performing the drying process by the control unit 2 in the drum type washing and drying machine X is stored as frequency information in the storage unit provided in the control unit 2. As the frequency information, there can be enumerated, for example, number of times of successive performance that only the drying process is successively performed in the drum type washing and drying machine X, successive performance time during which only the drying process is successively performed, performance number ratio which is a ratio of the number of times of performance of the drying process to the number of times of performance of the washing and rinsing processes, performance time ratio between the washing and rinsing processes and the drying process, cumulative number of times of performance since a specified point of time, cumulative performance time since a specified point of time, and the like. The embodiment will be described with use of the number of times of successive performance of the drying process as the frequency information.

In the drum type washing and drying machine X, the number of times of successive performance of the drying process entailing a danger that clogging will occur in the filter 160 (which will be referred to as an upper limit number of times, hereinbelow) has been stored in advance in the storage unit (not shown) provided in the control unit 2. The upper limit number of times may be arbitrarily changeable by manipulation of the operation panel 11. In clogging detection processings that will be described later (see a flow chart of FIG. 39), the upper limit number of times is used as an index for detection of occurrence of clogging in the filter 160.

Referring to the flow chart of FIG. 39, hereinbelow, there will be described an example of the clogging detection processings that are performed by the control unit 2 in the drum type washing and drying machine X configured accordingly. Reference characters S21, S22, . . . in the drawing represent procedural step numbers.

In a step S21, the control unit 2 determines whether start of the drying process has been requested or not in the drum type washing and drying machine X. Specifically determined is whether a starting manipulation for the drying process has been carried out or not by a user on the operation panel 11 or whether a starting manipulation for the washing process including the drying process has been carried out or not. If it is determined that the start of the drying process has been requested (YES in S21), the processing goes to a step S22. While it is determined that the start of the drying process has not been requested (No in S21), on the other hand, the processing of the step S21 is repetitively carried out.

In the step S22, the control unit 2 reads out the number of times of successive performance of the drying process in the drum type washing and drying machine X, from the storage unit in the control unit 2. Herein, the control unit 2 is an example of the frequency information acquisition unit.

In a step S23, the control unit 2 determines whether the number of times of successive performance acquired in the step S22 equals or exceeds the upper limit number of times stored in the storage unit in the control unit 2 or not. If the number of times of successive performance acquired in the step S22 equals or exceeds the upper limit number of times (YES in S23), the control unit 2 determines that clogging has occurred in the filter 160 and the processing goes to a step S24. That is, the control unit 2 detects occurrence of clogging in the filter 160 as the number of times of successive performance acquired in the step S22 equals or exceeds the upper limit number of times. Herein, the control unit 2 is an example of the clogging detection unit. If it is determined that the number of times of successive performance acquired in the step S22 is smaller than the upper limit number of times stored in the storage unit in the control unit 2 (NO in S23), it is determined that clogging has not occurred in the filter 160 and the clogging detection processing is terminated.

In the subsequent step S24, the control unit 2 causes the operation panel 11 to indicate by sound, letters, light or the like that clogging has occurred in the filter 160. For example, the filter wash alarm lamp provided in the display units of the operation panel 11 is lighted or flashed on and off. Herein, the operational panel 11 is an example of the indication unit. This step allows a user to easily recognize occurrence of clogging in the filter 160 and necessity of cleaning the filter 160. With this operation, it may be indicated that the number of times of successive performance is approaching the upper limit number of times. For example, there may be indicated in advance a number of times remaining until the number of times of successive performance reaches the upper limit number of times. With this arrangement, the filter 160 can be washed by performance of the washing process and the rinsing process before the number of times reaches the upper limit.

In a step S25, the control unit 2 interrupts the drying process in the drum type washing and drying machine X. Herein, the control unit 2 is an example of the drying process interruption processing unit. This step prevents overheating of air in the drum type washing and drying machine X and thus protects a wash being damaged.

Figure 39:
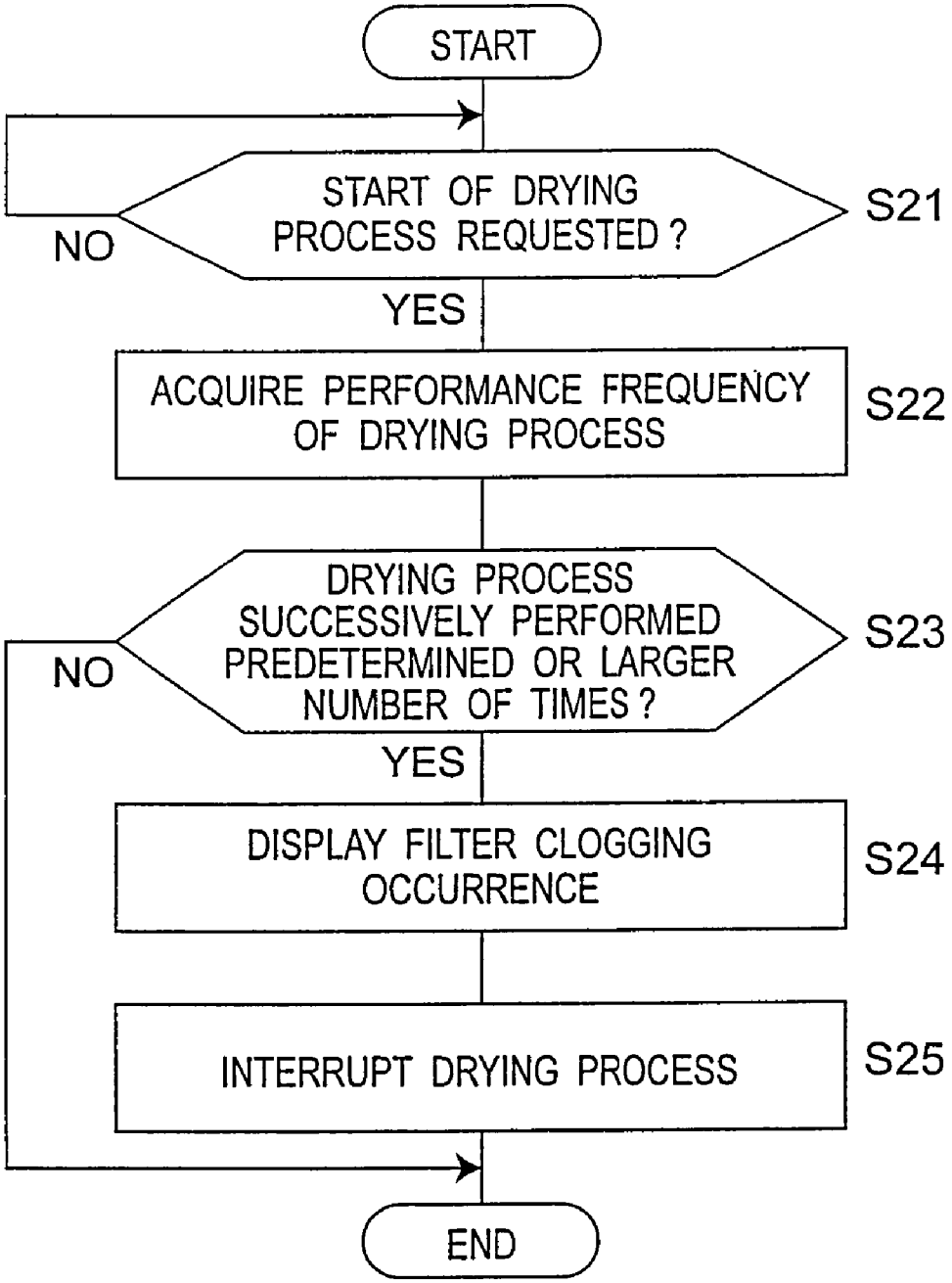
FIG. 39 is a flow chart of a fourth example of the procedures for clogging detection performed in the drum type washing and drying machine according to the third embodiment of the invention.

Another embodiment is conceivable in which the clogging detection processings described in the above embodiment (see the flow charts of FIG. 36 through FIG. 38) are additionally carried out in the concerned clogging detection processing (see the flow chart shown in FIG. 39). For example, the processings of detecting occurrence of clogging in the filter 160 on the basis of the temperature in the vicinity of the heater unit 132 (see the flow charts of FIG. 36 through FIG. 38) are carried out in a step following the step S23 (in the step preceding the step S24 or before the completion of the clogging detection processing).

By such use of the two detection methods in combination, occurrence of clogging in the filter 160 can be detected, for example, even if one of the methods does not function normally and only the other functions normally, and reliability is thus increased.

Embodiments of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. A drum type washing and drying machine comprising:

a water tank;

a rotary drum rotatably provided in the water tank;

a dehumidification unit for dehumidifying air introduced from inside of the rotary drum;

a heater unit for heating the air dehumidified by the dehumidification unit;

a blower unit for introducing the air in the rotary drum into the dehumidification unit and for delivering into the rotary drum the air heated by the heater unit;

a filter unit placed in a suction-side channel between the rotary drum and the blower unit and on an upstream side of air flow produced by the blower unit in a drying process, the filter unit being placed in a space between the rotary drum and the water tank so as to be soaked in water in the water tank in a washing process or in a rinsing process; and a cleaning unit for producing a flow of the water and thereby removing foreign matter that has adhered to the filter unit.

2. A drum type washing and drying machine as claimed in claim 1, wherein the filter unit is placed on a bottom surface of the water tank.

3. A drum type washing and drying machine as claimed in claim 1, wherein the filter unit has an area larger than a cross-sectional area of the suction-side channel.

4. A drum type washing and drying machine as claimed in claim 1, wherein the filter unit has a structure in which wires are woven reticularly.

5. A drum type washing and drying machine as claimed in claim 4, wherein a length of one side of a mesh of the filter unit is not smaller than 1 mm and not larger than 3 mm.

6. A drum type washing and drying machine as claimed in claim 4, wherein crossings of the wires of the filter unit woven reticularly are fixed.

7. A drum type washing and drying machine comprising:
a water tank;
a rotary drum rotatably provided in the water tank;
a dehumidification unit for dehumidifying air introduced from inside of the rotary drum;
a heater unit for heating the air dehumidified by the dehumidification unit;
a blower unit for introducing the air in the rotary drum into the dehumidification unit and for delivering into the rotary drum the air heated by the heater unit;
a filter unit placed in a suction-side channel between the rotary drum and the blower unit and on an upstream side of air flow produced by the blower unit in a drying process,
the filter unit being placed so as to be soaked in water supplied into the water tank in a washing process or in a rinsing process; and
a cleaning unit for producing a flow of the water and thereby removing foreign matter that has adhered to the filter unit,
wherein the cleaning unit is provided on an outer surface of the rotary drum and produces the flow of the water according to rotation of the rotary drum.

8. A drum type washing and drying machine as claimed in claim 7, wherein the filter unit is placed on a bottom surface of the water tank and wherein the cleaning unit is provided on a back face of the rotary drum.

9. A drum type washing and drying machine as claimed in claim 8, wherein the cleaning unit has a blade member protruding from the back face of the rotary drum toward the bottom surface of the water tank so that a side of the member facing in a rotational direction of the rotary drum in a dewatering process forms an obtuse angle.

10. A drum type washing and drying machine as claimed in claim 7, further comprising a rotary drum rotation control unit that makes a shift from an ordinary rotation speed to a higher rotation speed in the rotary drum in the washing process or in the rinsing process.

11. A drum type washing and drying machine as claimed in claim 10, wherein the rotary drum rotation control unit comprises an operating speed control unit that controls the rotary drum to rotate, in the washing process or in the rinsing process, at a first rotation speed mainly for washing laundry and at a second rotation speed mainly for removing foreign matter having adhered to the filter unit, the second rotation speed being higher than the first rotation speed.

12. A drum type washing and drying machine as claimed in claim 11, wherein the rotary drum rotation control unit controls the rotary drum to rotate at the second rotation speed immediately before termination of the washing process or the rinsing process.

13. A drum type washing and drying machine as claimed in claim 12, wherein when controlling the rotary drum to rotate at the first rotation speed, the rotary drum rotation control unit controls the rotary drum to rotate in reciprocal directions alternately and to stop for a first interval before switching the directions of rotation of the rotary drum, and when controlling the rotary drum to rotate at the second rotation speed, the rotary drum rotation control unit controls the rotary drum to rotate in reciprocal directions alternately and to stop for a second interval shorter than the first interval before switching the directions of rotation.

14. A drum type washing and drying machine as claimed in claim 11, further comprising a drain unit for draining the water out of the water tank,
wherein the rotary drum rotation control unit controls the rotary drum to rotate at the second rotation speed when the washing water supplied into the water tank in the washing process or in the rinsing process is drained out of the water tank by the drain unit.

15. A drum type washing and drying machine as claimed in claim 14, wherein when controlling the rotary drum to rotate at the first rotation speed, the rotary drum rotation control unit controls the rotary drum to rotate in reciprocal directions alternately and to stop for a first interval before switching the directions of rotation of the rotary drum, and when controlling the rotary drum to rotate at the second rotation speed, the rotary drum rotation control unit controls the rotary drum to rotate in reciprocal directions alternately and to stop for a second interval shorter than the first interval before switching the directions of rotation.

16. A drum type washing and drying machine as claimed in claim 11, wherein the drum type washing and drying machine has an operation exclusively for washing the filter unit and the rotary drum rotation control unit controls the rotary drum to rotate at a third rotation speed higher than the second rotation speed in the operation exclusively for washing the filter unit.

17. A drum type washing and drying machine comprising:
a water tank;
a rotary drum rotatably provided in the water tank;
a dehumidification unit for dehumidifying air introduced from inside of the rotary drum;
a heater unit for heating the air dehumidified by the dehumidification unit;
a blower unit for introducing the air in the rotary drum into the dehumidification unit and for delivering into the rotary drum the air heated by the heater unit; and
a filter unit placed in a suction-side channel between the rotary drum and the blower unit and on an upstream side of air flow produced by the blower unit in a drying process,
the filter unit being placed so as to be soaked in water supplied into the water tank in a washing process or in a rinsing process,
the water tank and the rotary drum being slanted such that rear sides thereof are lowered, with the blower unit being mounted at a lower part of a rear face of the water tank.

* * * * *